United States Patent [19]

Hirata et al.

[11] Patent Number: 5,056,312

[45] Date of Patent: Oct. 15, 1991

[54] HYDRAULIC DRIVE SYSTEM FOR CONSTRUCTION MACHINES

[75] Inventors: Toichi Hirata, Ushiku; Genroku Sugiyama, Ibaraki; Yusuke Kajita, Tsuchiura; Yukio Aoyagi, Ibaraki; Tomohiko Yasudi, Kashiwa; Gen Yasuda, Ibaraka; Hiroshi Watanabe, Ushiku; Eiki Izumi, Ibaraki; Yasuo Tanaka, Tsukuba; Hiroshi Onoue, Ibaraki; Shigetaka Nakamura, Tsuchiura, all of Japan

[73] Assignee: Hitachi Construction Machinery Co., Ltd., Tokyo, Japan

[21] Appl. No.: 449,845

[22] PCT Filed: Jul. 7, 1989

[86] PCT No.: PCT/JP89/00691

§ 371 Date: Nov. 22, 1989

§ 102(e) Date: Nov. 22, 1989

[87] PCT Pub. No.: WO90/00683

PCT Pub. Date: Jan. 25, 1990

[30] Foreign Application Priority Data

| | | | |
|---|---|---|---|
| Jul. 8, 1988 | [JP] | Japan | 63-169065 |
| Jul. 21, 1988 | [JP] | Japan | 63-180196 |
| Sep. 12, 1988 | [JP] | Japan | 63-226365 |
| Nov. 2, 1988 | [JP] | Japan | 63-276015 |

[51] Int. Cl.[5] ..... F15B 11/00; F15B 11/05; F15B 11/16

[52] U.S. Cl. ..... 60/426; 60/427; 60/444; 60/452; 91/517; 91/518; 91/531

[58] Field of Search ..... 60/426, 427, 444, 452; 91/517, 518, 529, 531

[56] References Cited

U.S. PATENT DOCUMENTS

| | | | |
|---|---|---|---|
| 4,617,854 | 10/1986 | Kropp | 91/531 X |
| 4,726,186 | 2/1988 | Tatsumi et al. | 60/434 |
| 4,739,617 | 4/1988 | Kreth et al. | 91/517 X |
| 4,759,183 | 7/1988 | Kreth et al. | 60/422 |
| 4,768,339 | 9/1988 | Aoyagi et al. | 60/427 |
| 4,856,278 | 8/1989 | Widmann et al. | 60/426 X |
| 4,864,822 | 9/1989 | Wachs et al. | 60/427 |
| 4,967,557 | 11/1990 | Izumi et al. | 91/518 X |

FOREIGN PATENT DOCUMENTS 13422165 12/1984 Fed. Rep. of Germany .

*Primary Examiner*—Edward K. Look
*Assistant Examiner*—George Kapsalas
*Attorney, Agent, or Firm*—Fay, Sharpe, Beall, Fagan, Minnich & McKee

[57] ABSTRACT

A hydraulic system for a construction machine comprising plural hydraulic actuators (23–28) driven by fluid supplied from a pump (22), first and second flow control valves (29–34) for controlling flows of fluid supplied to the first and second actuators, and first and second distribution compensating valves (35–40) for controlling first differential pressure (ΔP v1–ΔP v6) produced between inlets and outlets of the first and second flow control valves. The first and second distribution compensating valves have respective drives (**45–50, 35*c*–40*c*) for applying control forces (Fc1–Fc2) in accordance with the second differential pressure to the associated distribution compensating valves, to thereby set target values of the first differential pressures. The hydraulic system includes first means (59) for detecting the second differential pressure (ΔP LS) from the discharge pressure (P s) of the pump (22) and the maximum load pressure (P amax) out of the first and second actuators; second means (61) for calculating individual values (Fc1–Fc6), as values of the control forces applied from the drives (45–50, 35C–40C) of the first and second distribution compensating valves (35–40), in accordance with at least the second differential pressure detected by the first means; and first and second control pressure generators (62*a*–62*f*) provided in association with the first and second distribution compensating valves. The first and second control pressure generators (62*a*–62*f*) produce control pressures (P c1–P c6) dependent on the individual values obtained by the second means and output the control pressures to the drives (35*c*–40*c***) of the first and second distribution compensating valves.

15 Claims, 31 Drawing Sheets

CONTROLLER
61A
65A
66A

HYDRAULIC DRIVE SYSTEM FOR CONSTRUCTION MACHINES

DESCRIPTION

BACKGROUND OF THE INVENTION

1. Field of the Invention

The present invention relates to a hydraulic drive system for construction machines such as hydraulic excavators, and more particularly, to a hydraulic drive system for construction machines which includes distribution compensating valves for controlling differential pressures across respective flow control valves, and in which a control force in accordance with a differential pressure between the discharge pressure of a hydraulic pump under load-sensing control and the maximum load pressure among a plurality of actuators is applied to each of the distribution compensating valves to thereby set a target value of the differential pressure across the flow control valve.

2. Description of the Prior Art

Recently, in a hydraulic drive system for construction machines, such as hydraulic excavators and cranes, each equipped with a plurality of hydraulic actuators for driving a plurality of driven members, it is customary to control the discharge pressure of a hydraulic pump in response to load pressures or demanded flow rates, and to arrange pressure compensating valves in association with flow control valves for controlling the differential pressures across the flow control valves by the associated pressure compensating valves, so that the supplied flow rates are steadily controlled when simultaneously driving the hydraulic actuators. Load-sensing control is known as a typical example of controlling the discharge pressure of the hydraulic pump in response to the load pressures.

The load-sensing control is to control the discharge rate of a hydraulic pump such that the discharge pressure of the hydraulic pump becomes higher a fixed value than the maximum load pressure among a plurality of hydraulic actuators. This control increases and decreases the discharge rate of the hydraulic pump in response to the load pressures of the hydraulic actuators, thereby permitting economical operation.

Since the discharge rate of the hydraulic pump has an upper limit, i.e., available maximum flow rate, the pump discharge rate will become not enough, when the hydraulic pump reaches the available maximum flow rate in case of simultaneously driving the plural actuators. This is generally known as saturation of the hydraulic pump. If saturation occurs, a hydraulic fluid discharged from the hydraulic pump will flow into the actuator(s) on the lower pressure side in preference to other actuator(s) on the higher pressure side, the latter actuator(s) being hence supplied with the deficient hydraulic fluid. This results in that the plural actuators cannot be driven simultaneously.

To solve the above problem, with a hydraulic drive system as described in DE-A1-3422165 (corresponding to JP-A-60-11706), two drive parts respectively acting in the valve-opening and -closing directions are provided on each pressure compensating valve for controlling the differential pressure across a flow control valve, in place of a spring conventionally provided for setting a target value of the differential pressure across the flow control valve. The discharge pressure of a hydraulic pump is introduced to the drive part acting in the valve-opening direction, and the maximum load pressure among plural actuators is introduced to the drive part acting in the valve-closing direction. This causes a control force in accordance with a differential pressure between the pump discharge pressure and the maximum load pressure to act in the valve-opening direction for setting a target value of the differential pressure across the flow control valve. When saturation of the hydraulic pump occurs in the above arrangement, the differential pressure between the pump discharge pressure and the maximum load pressure is reduced correspondingly. Therefore, the target value of the differential pressure across the flow control valve for each pressure compensating valve is also reduced and the pressure compensating valve associated with the actuator on the lower pressure side is further restricted, so that the hydraulic fluid from the hydraulic pump is prevented from flowing into the actuator on the lower pressure side with preference. This allows the hydraulic fluid from the hydraulic pump to be distributed corresponding to ratio of the demanded flow rates (opening degrees) of the flow control valves and supplied to the plural actuators, thereby permitting appropriate simultaneous drive of the actuators.

Under such an arrangement, the pressure compensating valve eventually offers a function of reliably distributing and supplying the hydraulic fluid from the hydraulic pump to the plural actuators irrespective of any discharge condition of the hydraulic pump. Therefore, that function is called a "distribution compensating" function and the pressure compensating valve is called "a distribution compensating valve" in this description for convenience.

Meanwhile, in the conventional hydraulic drive system as mentioned above, the control force in accordance with the differential pressure between the discharge pressure of the hydraulic pump under load-sensing control and the maximum load pressure among the plural actuators is applied, as the target value of the differential pressure across the flow control valve, to each of the distribution compensating valves. Therefore, provided that all the drive parts have the same pressure receiving area, the degree of the control force applied to the respective distribution compensating valves becomes equal and all the distribution compensating valves give a similar pressure compensating characteristic. During combined operation to simultaneously drive two or more actuators, for example, the proportion of flow rates supplied to the respective actuators, i.e., distribution ratio, is thus uniquely determined dependent on the opening degrees of the flow control valves regardless of various combinations of the actuators simultaneously driven. This leads to a problem that in some type of combined operation, the hydraulic fluid may be distributed overly or insufficiently to one of the actuators, resulting in a reduction of operability and/or working efficiency.

It is an object of the present invention to provide a hydraulic drive system for construction machines which can give individual pressure compensating characteristics to separate distribution compensating valves, and improve operability and/or working efficiency.

SUMMARY OF THE INVENTION

To achieve the above object, the present invention provides a hydraulic drive system for a construction machine comprising a hydraulic pump, at least first and second hydraulic actuators driven by a hydraulic fluid supplied from the hydraulic pump, first and second flow control valves for controlling flows of the hydraulic fluid supplied to the first and second actuators, respectively, first and second distribution compensating valves for controlling first differential pressures produced between inlets and outlets of the first and second flow control valves, respectively, and discharge control means responsive to a second differential pressure between a discharge pressure of the hydraulic pump and a maximum load pressure out of the first and second actuators for controlling a flow rate of the hydraulic fluid discharged from the hydraulic pump, the first and second distribution compensating valves having respective drive means for applying control forces in accordance with the second differential pressure to the associated distribution compensating valves, to thereby set target values of the first differential pressures, wherein the hydraulic drive system further comprises first means for detecting the second differential pressure from the discharge pressure of the hydraulic pump and the maximum load pressure out of the first and second actuators; second means for calculating individual values, as values of the control forces applied from the respective drive means of the first and second distribution compensating valves, in accordance with at least the second differential pressure detected by the first means; and first and second control pressure generator means provided in association with the first and second distribution compensating valves, respectively, the first and second control pressure generator means producing control pressures dependent on the individual values obtained by the second means and outputting the control pressures to the respective drive means of the first and second distribution compensating valves.

With the present invention thus arranged, the second means calculates the individual values, as values of the control forces applied from the respective drive means of the first and second distribution compensating valves, in accordance with the second differential pressure, and the first and second control pressure generator means produce the control pressures dependent on those individual values and output the control pressures to the respective drive means of the first and second distribution compensating valves. This gives individual pressure compensating characteristics to the first and second distribution compensating valves, permitting to provide the optimum distribution ratio dependent on types of the actuators and improve operability and/or working efficiency during combined operation of the first and second actuators simultaneously driven.

In one aspect of the present invention, the second means may have first arithmetic means for deriving values of first and second control forces corresponding to the second differential pressure, based on both the second differential pressure detected by the first means and first and second functions preset associated with the first and second distribution compensating valves.

In the case where the first actuator is an actuator for driving an inertial load and the second actuator is an actuator for driving a normal load, the first and second functions are preferably set to have such relationships between the second differential pressure and the values of the first and second control forces that as the second differential pressure is reduced, the target values of the first differential pressures are reduced with rates of reduction different from each other.

In the case where the first actuator is an actuator for driving an inertial load and the second actuator is an actuator for driving a normal load, at least the first function associated with the first actuator is preferably set to have such relationship between the second differential pressure and the value of the first control force that when the second differential pressure exceeds above a predetermined value, the target value of the first differential pressure is suppressed from further increasing.

In the case where the first and second actuators are travel actuators, the first and second functions are both preferably set to have such relationships between the second differential pressure and the values of the first and second control forces that the target values of the first differential pressures become larger than the second differential pressure.

In the case where the first actuator is one of travel actuators and the second actuator is an actuator for digging work, the second control means preferably also has second arithmetic means which provide a relatively large time delay for change of the value of the first control force derived from the first function and a relatively small time delay for change of the value of the second control force derived from the second function.

In the case where the first actuator is a hydraulic motor and a second actuator is a hydraulic cylinder, the hydraulic drive system of the present invention further comprises third means for detecting a temperature of the hydraulic fluid discharged from the hydraulic pump, and the second means also has third arithmetic means for deriving a temperature-depedent modification factor based on both the temperature of the hydraulic fluid detected by the third means and a third function preset, and fourth arithmetic means for calculating the value of the second control force derived from the second function and the temperature-dependent modification factor to thereby modify the value of the second control force.

In another aspect of the present invention, the hydraulic drive system of the present invention may further comprise fourth means for outputting select command signals dependent on types or contents of the works to be performed by driving the first and second actuators, and the second means has fifth arithmetic means for deriving values of third and fourth control forces based on the second differential pressure detected by the first means, fourth and fifth functions preset respectively associated with the first and second distribution compensating valves, and the select command signals output from the fourth means.

In this case, the fifth arithmetic means preferably includes, as each of the fourth and fifth functions, a plurality of functions having respective characteristics different from each other, select ones of the plurality of functions dependent on the respective select command signals output from the fourth means, and derive the values of the third and fourth control forces corresponding to the second differential pressure, based on both the second differential pressure detected by the first means and the selected functions.

In still another aspect of the present invention, in the case where the first actuator is an actuator for driving an inertial load and the second actuator is an actuator for driving a normal load, the hydraulic drive system of the present invention may further comprise fifth means for detecting the discharge pressure of the hydraulic pump, and the second means may/have sixth arithmetic means for deriving a value of a fifth control force corresponding to the second differential pressure, based on both the second differential pressure detected by the first means and a sixth function preset, and setting that value as a value of the control force applied from the drive means of the first distribution compensating valve, and seventh arithmetic means for deriving a value of a sixth control force required to hold the discharge pressure at a predetermined value, based on both the discharge pressure detected by the fifth means and a seventh function preset, and setting either one of the values of the fifth and sixth control forces which makes larger the target value of the first differential value, as a value of the control force applied from the drive means of the second distribution compensating valve.

In this case, the hydraulic drive system may further comprise sixth means operable from the outside for outputting a select command signal for a predetermined value of the discharge pressure, and the seventh arithmetic means may modify a characteristic of the seventh function responsive to the select command signal to change the predetermined value of the discharge pressure.

Moreover, in another aspect of the present invention, the first actuator is an actuator for driving an inertial load and the second actuator is an actuator for driving a normal load, the hydraulic drive system of the present invention may further comprise seventh means for detecting operation of the first actuator and eighth means for setting a flow increasing speed of the hydraulic fluid supplied through the first distribution compensating valve, and the second means may have eighth arithmetic means for deriving a value of a seventh control force corresponding to the second differential pressure, based on both the second differential pressure detected by the first means and an eighth function preset, and setting that value as a value of the control force applied from the drive means of the second distribution compensating valve, and ninth arithmetic means for deriving a value of an eighth control force, which is changed at a speed below the change rate corresponding to the flow increasing speed, with the value of the seventh control force set as a target value, and setting the value of the eighth control force as the value of the control force applied from the drive means of the second distribution compensating valve.

In this case, the hydraulic drive system of the present invention may further comprise ninth means for detecting operation of the second actuator, and the ninth arithmetic means may derive the value of the eighth control force when the seventh and ninth means detect start of operation of the first and second actuators.

In still another aspect of the present invention, the hydraulic drive system of the present invention may further comprise tenth means for detecting the discharge pressure of the hydraulic pump, and the second means may have tenth arithmetic means for calculating, based on the second differential pressure derived by the first means, such a differential pressure target discharge rate of the hydraulic pump as to hold the second differential pressure constant, eleventh arithmetic means for calculating an input limiting target discharge rate of the hydraulic pump based on both the discharge pressure detected by the tenth means and a preset input limiting function of the hydraulic pump, twelfth arithmetic means for deriving a deviation between the differential pressure target discharge rate and the input limiting target discharge rate, and thirteenth arithmetic means for calculating individual values, as the values of the control forces applied from the respective drive means of the first and second distribution compensating valves in accordance with the deviation between the two target discharge rates, when the input limiting target discharge rate is selected, as a discharge rate target value of the hydraulic pump, out of the differential pressure target discharge rate and the input limiting target discharge rate.

In still another aspect of the present invention, preferably, the hydraulic drive system of the present invention further comprises drive means, separate from the first-mentioned drive means, provided on the first and second distribution compensating valves for urging the respective distribution compensating valves in the valve-opening direction, and pilot pressure supply means for leading a substantially constant common pilot pressure to the separate drive means, the first-mentioned drive means being disposed on the side to act on the first and second distribution compensating valves in the valve-closing direction.

DETAILED DESCRIPTION OF THE PREFERRED EMBODIMENTS

The following is description of preferred embodiments of the present invention, which are implemented in a hydraulic excavator, with reference to the drawings.

FIRST EMBODIMENT

To begin with, a first embodiment of the present invention will be described by referring to FIGS. 1–3.

Figure 1:
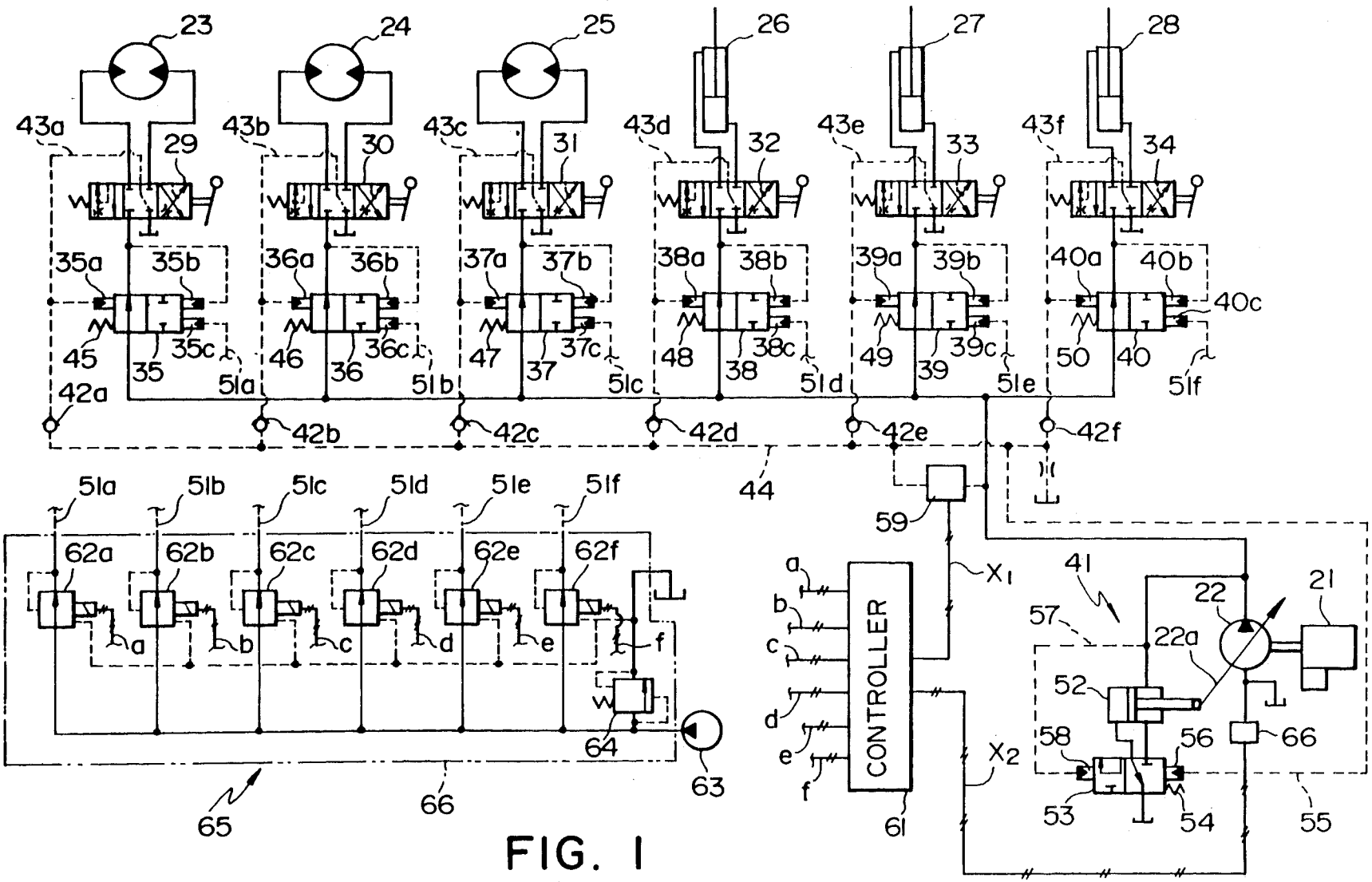
FIG. 1 is a circuit diagram showing an overall hydraulic drive system for construction machines according to a first embodiment of the present invention.

Referring to FIG. 1, a hydraulic drive system of this embodiment, applied to a hydraulic excavator, comprises a prime mover 21, one hydraulic pump of variable displacement type driven by the prime mover 21, i.e., main pump 22, a plurality of hydraulic actuators driven by a hydraulic fluid discharged from the main pump 22, i.e., a swing motor 23, a left travel motor 24, a right travel motor 25, a boom cylinder 26, an arm cylinder 27 and a bucket cylinder 28, flow control valves for respectively controlling flows of the hydraulic fluid supplied to the plurality of actuators, i.e., a swing directional control valve 29, a left travel directional control valve 30, a right travel directional control valve 31, a boom directional control valve 32, an arm directional control valve 33 and a bucket directional control valve 34, and pressure compensating valves, i.e., distribution compensating valves 35, 36, 37, 38, 39 and 40, disposed upstream of the associated flow control valves for respectively controlling the differential pressures produced between inlets and outlets of the flow control valves, namely, differential pressures ΔP v1, ΔP v2, ΔP v3, ΔP v4, ΔP v5 and ΔP v5 across the flow control valves.

The hydraulic drive system of this embodiment also comprises a discharge control device 41 of the load-sensing control type which controls the discharge rate of the main pump 22 such that in accordance with a differential pressure ΔP LS between the discharge pressure P s of the main pump 22 and the maximum load pressure P amax among the actuators 23–28, the discharge pressure P s is held higher a fixed value than the maximum load pressure P amax within a range until the main pump 22 will reach its available maximum discharge rate.

Connected to the flow control valves 29–34 are load lines 43*a*, 43*b*, 43*c*, 43*d*, 43*e* and 43*f* having check valves 42*a*, 42*b*, 42*c*, 42*d*, 42*e* and 42*f* for taking out load pressures of the actuators 23–28 when driven, respectively. The load lines 43*a*–43*f* are in turn connected to a common maximum load line 44.

The distribution compensating valves 35–40 are constructed as follows. The distribution compensating valve 35 has a drive part 35*a* which is supplied with an outlet pressure of the swing directional control valve 29 for urging a valve body of the distribution compensating valve 35 in the valve-opening direction, a drive part 35*b* which is supplied with an inlet pressure of the swing directional control valve 29 for urging the valve body of the distribution compensating valve 35 in the valve-closing direction, a spring 45 for urging the valve body of the distribution compensating valve 35 in the valve-opening direction with a force f, and a drive part 35*c* which is supplied with a control pressure P c1 (described later) through a pilot line 51*a* for urging the valve body of the distribution compensating valve 35 in the valve-closing direction with a control force Fc1. Thus, the drive parts 35*a*, 35*b* apply a first control force in accordance with the differential pressure ΔP v1 across the swing directional control valve 29 to the valve body of the distribution compensating valve 35 in the valve-closing direction, while the spring 45 and the drive part 35*c* apply a second control force f - Fc1 to the valve body of the distribution compensating valve 35 in the valve-opening direction. The balanced condition between the first and second control forces determines a restricting degree of the distribution compensating valve 35 to control the differnential pressure ΔP v1 across the swing directional control valve 29. Here, the second control force f - Fc1 serves to set a target value of the differential pressure ΔP v1 across the swing directional control valve 29.

The other distribution compensating valves 36–40 are constructed in a similar fashion. More specifically, the distribution compensating valves 36–40 have pairs of opposite drive parts 36*a*, 36*b*; 37*a*, 37*b*; 38*a*, 38*b*; 39*a*, 39*b*; 40*a*, 40*b* for urging their valve bodies with first control forces in accordance with the differential pressures ΔP v2–ΔP v6 across the flow control valves 30–34, respectively, springs 46, 47, 48, 49, 50 for urging the valve bodies in the valve-opening direction with the force f, and drive parts 36*c*, 37*c*, 38*c*, 39*c*, 40*c* supplied with control pressures P c2, P c3, P c4, P c5, P c6 (described later) through pilot lines 51*b*, 51*c*, 51*d*, 51*e*, 51*f* for urging the valve bodies in the valve-closing direction with control forces Fc2, Fc3, Fc4, Fc5, Fc6, respectively.

The discharge control device 41 comprises a hydraulic cylinder unit 52 for driving a swash plate 22*a* of the main pump 22 to regulate the displacement volume thereof, and a control valve 53 for controlling a positional shift of the hydraulic cylinder unit 52. The control valve 53 has a spring 54 for setting the differential pressure ΔP LS between the discharge pressure P s of the main pump 22 and the maximum load pressure P amax among the actuators 23–28, a drive part 56 supplied with the maximum load pressure P amax among the actuators 23–28 through a line 55, and a drive part 58 supplied with the discharge pressure P s of the main pump 22 through a line 58. If the maximum load pressure P amax is raised up, the control valve 53 is operated leftward on the view correspondingly to shift the hydraulic cylinder unit 52 also leftward on the view for increasing the displacement volume of the main pump 22 and hence the discharge rate thereof. This enables to constantly hold the discharge pressure P s of the main pump 22 at a higher level by a fixed value which is determined by the spring 54.

The hydraulic drive system of this embodiment further comprises a differential pressure detector 59 supplied with the discharge pressure P s of the main pump 22 and the maximum load pressure P amax among the actuators 23–28 for detecting the the differential pressure ΔP LS therebetween and outputting a corresponding electric signal X1, a temperature detector 60 for detecting a temperature Th of the hydraulic fluid discharged from the main pump 22 and outputting a corresponding electric signal X2, a controller 61 for receiving the electric signal X1, X2 from the differential pressure detector 60 and the temperature detector 61, calculating the aforesaid control forces Fc1–Fc6 based on both the detected the differential pressure ΔP LS and fluid temperature Th, and then outputting respective corresponding electric signals a, b, c, d, e and f, and a control pressure generator circuit 65 which includes solenoid proportional pressure reducing valves 62*a*, 62*b*, 62*c*, 62*d*, 62*e* and 62*f* for receiving the electric signals a, b, c, d, e and f from the controller 61, respectively, a pilot pump 63 for supplying a pilot pressure to the solenoid proportional pressure reducing valves 62*a*–62*f*, and a relief valve 64 for regulating the magnitude of the pilot pressure discharged from the pilot pump 63. The solenoid proportional pressure reducing valves 62*a*–62*f* are operated by the electric signals a–f to produce the control pressures P c1–P c6 corresponding to values of the control forces Fc1–Fc6 that are output to the drive parts 35*c*–40*c* of the distribution compensating valves 35–40 through the pilot lines 51*a*–51*f*, respectively.

Preferably, as indicated by two-dot chain lines 66, the solenoid proportional pressure reducing valves 62*a*–62*f* and the relief valve 64 are constructed into one block of assembly.

Figure 2:
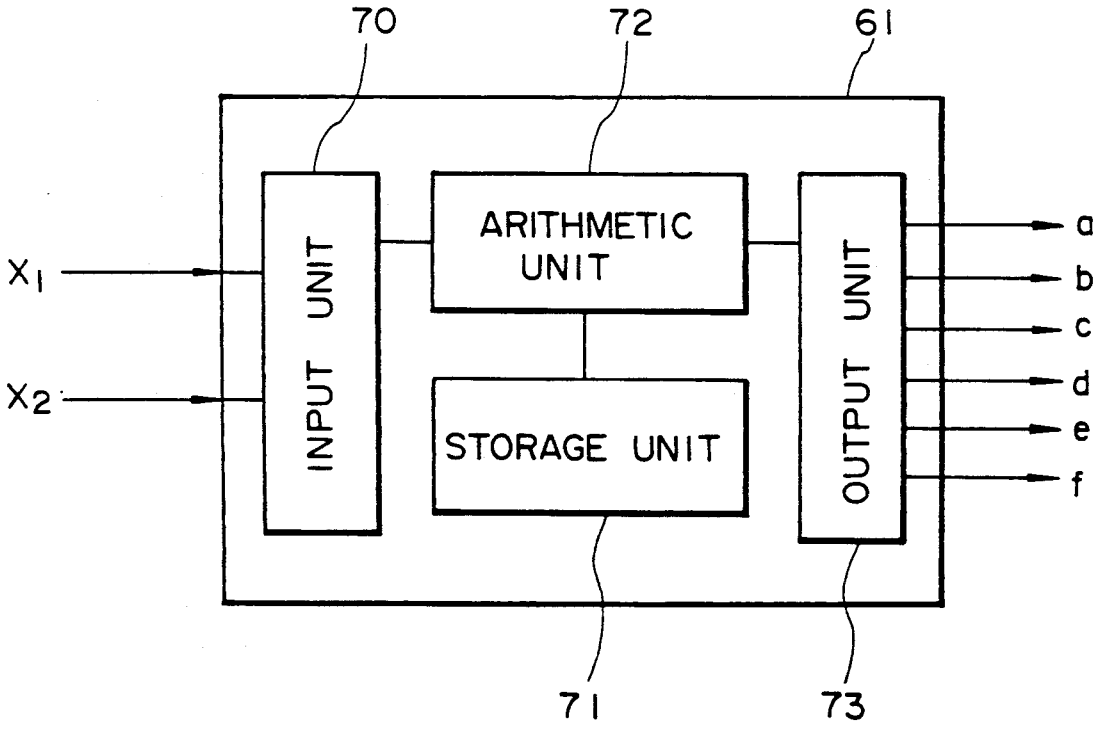
FIG. 2 is a schematic view showing the configuration of a controller.

The controller 61 comprises, as shown in FIG. 2, an input unit 70 for receiving the electric signals X1, X2, a storage unit 71, an arithmetic unit 72 for performing operations to calculate the values of the control forces Fc1–Fc6 following a control program stored in the storage unit 71, and an output unit 73 for outputting the values of the respective control forces calculated by the arithmetic unit 72 as the electric signals a–f.

Figure 3:
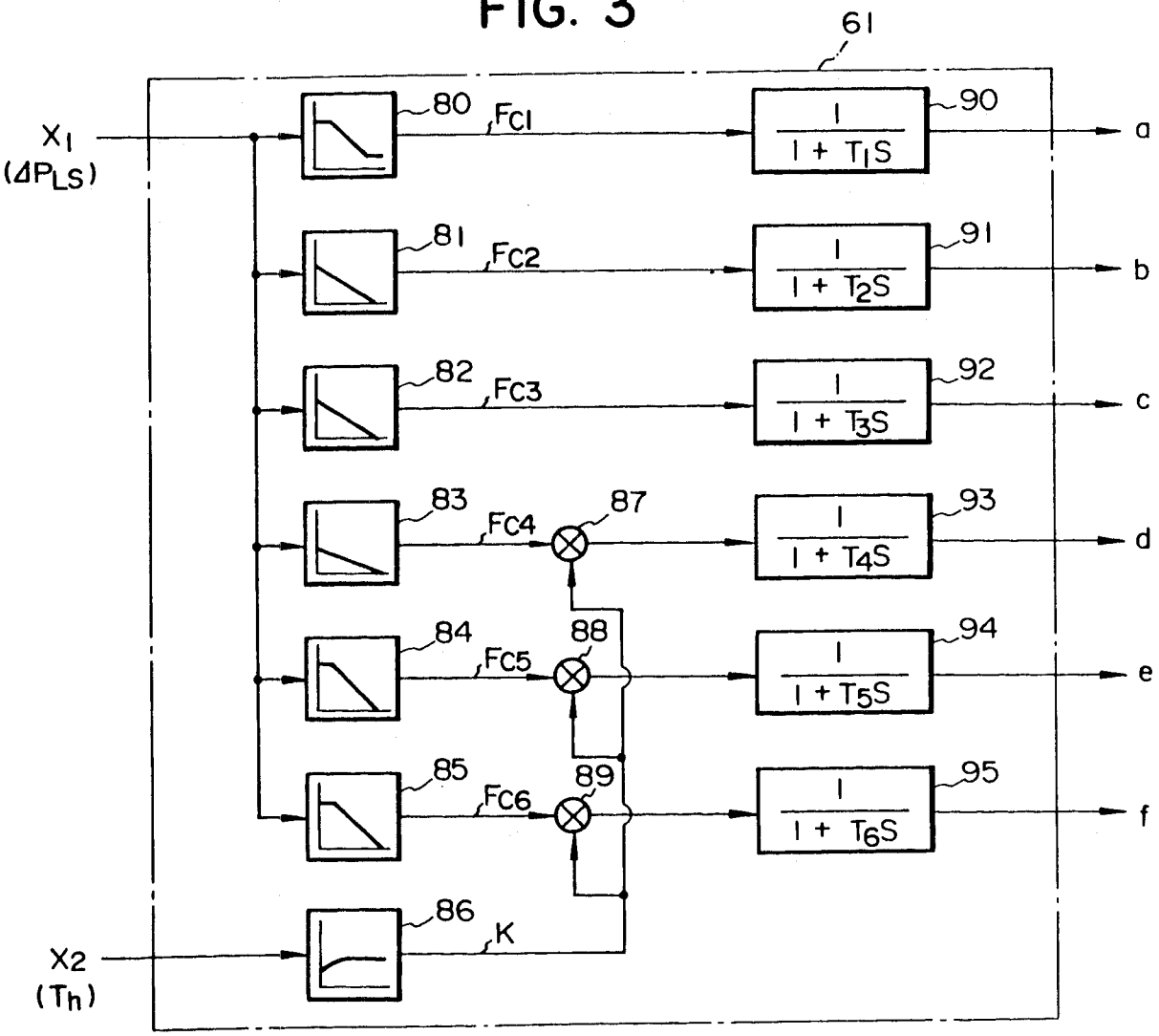
FIG. 3 is a functional block diagram showing the content of operation process performed by the controller.

The content of operation process performed by the arithmetic unit 72 of the controller 61 is shown in a functional block diagram of FIG. 3. In the figure, blocks 80–85 denote function blocks which are provided in association with the distribution compensating valves 35–40, respectively, and which previously store therein function data including the functional relationships between the differential pressure ΔP LS and the control forces Fc1–Fc6. From these function blocks, the values of the control forces Fc1–Fc6 corresponding to the differential pressure ΔP LS are determined in accordance with the electric signal X1. A block 86 denotes a function block which previously stores therein function data including the functional relationship between the fluid temperature Th and the modification factor K for temperature-dependent modification. From this function block, the modification factor K corresponding to the fluid temperature Th is determined in accordance with the electric signal X2. The modification factor K determined by the function block 86 is multiplied in multiplication blocks 87, 88, 89 by the values of the control forces Fc4–Fc6 determined by the functions blocks 83, 84, 85, respectively, for modifying the values of those control forces. The values of the control forces Fc1, Fc2, Fc3 determined by the function blocks 80, 81, 82 and the values of the control forces Fc4, Fc5, Fc6 having been modified dependent on temperatures by the multiplication blocks 87, 88, 89 are filtered through delay blocks 90–95 each comprising a primary delay element and then output as the electric signals a–f, respectively.

The functional relationships between the differential pressure ΔP LS and the control forces Fc1–Fc6, stored in the function blocks 80–85, are shown in FIGS. 4A–4D and FIG. 5.

Figure 4A:
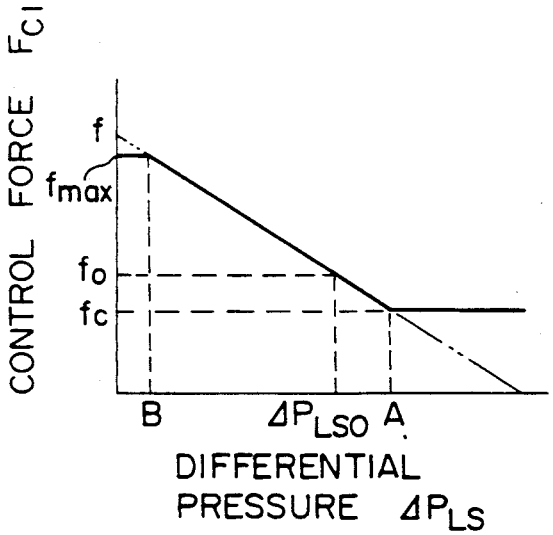
FIG. 4A is a graph showing the functional relationship between values of a differential pressure ΔP LS and a control force F cl applied to a distribution compensating valve associated with a swing motor.

FIG. 4A shows the functional relationship between values of the differential pressure ΔP LS and the control force F c1 applied to the distribution compensating valve 35 associated with the swing motor 23. In the figure, ΔP LSO indicates the differential pressure between the discharge pressure of the main pump 22 and the maximum load pressure which is held by the discharge control device 41 under load-sensing control, i.e., load-sensing compensated differential pressure set by the spring 54 of the control valve 53, and fo indicates a value of the control force Fc1 corresponding to the load-sensing compensated differential pressure ΔP LSO. The character A indicates the minimum differential pressure that determines a maximum speed of the swing motor 23, i.e., maximum flow compensating differential pressure for the swing motor 23, and fc indicates a maximum flow compensating control force corresponding to the maximum flow compensating differential pressure A. The character f indicates a force of the spring 45. Further, f - fo corresponds to the second control force applied to the distribution compensating valve 35 under a condition that the load-sensing compensated differential pressure ΔP LSO is effected. The value of the second control force is selected such that the target value of the differential pressure ΔP v1 across the swing directional control valve 23, which is set by the second control force, substantially coincides with the load-sensing compensated differential pressure ΔP LSO.

Also, a two-dot chain line in FIG. 4A represents a characteristic of the basic function that gives the control force equal to the force f of the spring 45 when the differential pressure ΔP LS is zero, and gradually reduces the control force with an increase in the differential pressure ΔP LS. Thus, the functional relationship between the differential pressure ΔP LS and the control force Fc1 is set such that the value of the control force Fc1 is gradually reduced with an increase in the differential pressure ΔP LS when the differential pressure ΔP LS is smaller than the maximum flow compensating differential pressure A, and the constant control force fc is output in spite of an increase in the differential pressure ΔP LS when the differential pressure ΔP LS exceeds above the maximum flow compensating differential pressure A. In addition, when the differential pressure ΔP LS exceeds below the minimum flow compensating differential pressure B, the control force is limited to a maximum value fmax less than the force f of the spring 45 in spite of a decrease in the differential pressure ΔP LS.

Figure 4B:
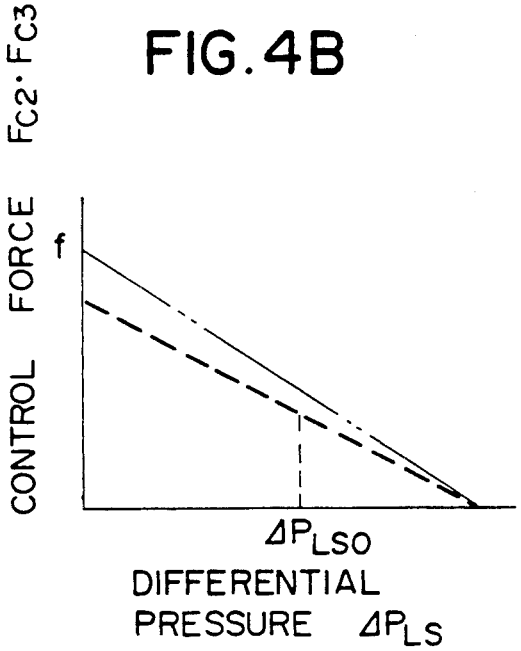
FIG. 4B is a graph showing the functional relationship between values of the differential pressure ΔP LS and control forces F c2, F c3 applied to distribution compensating valves associated with travel motors.

FIG. 4B shows the functional relationship between values of the differential pressure ΔP LS and the control forces F c2, F c3 applied to the distribution compensating valves 36, 37 associated with the travel motors 24, 25. In the figure, a two-dot chain line represents a characteristic of the basic function similarly to FIG. 4A. As seen, the functional relationship between values of the differential pressure ΔP LS and the control forces F c2, F c3 is set such that the values of the control forces Fc2, Fc3 are gradually reduced with an increase in the differential pressure ΔP LS at a smaller gradient than that of the basic function. Thus, there is obtained a compensated flow rate ΔQ in comparison with the case where the basic function is use for the control.

Figure 4C:
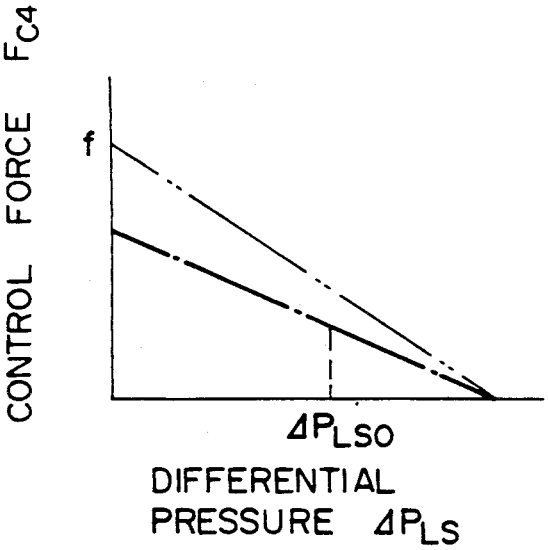
FIG. 4C is a graph showing the functional relationship between values of the differential pressure ΔP LS and a control force F c4 applied to a distribution compensating valve associated with a boom cylinder.

FIG. 4C shows the functional relationship between values of the differential pressure ΔP LS and the control force F c4 applied to the distribution compensating valve 38 associated with the boom cylinder 26. As seen, the functional relationship is set such that the value of the control force Fc4 is gradually reduced with an increase in the differential pressure ΔP LS at a smaller gradient than those of characteristic lines of the control forces Fc2, Fc3 as well as the basic function.

Figure 4D:
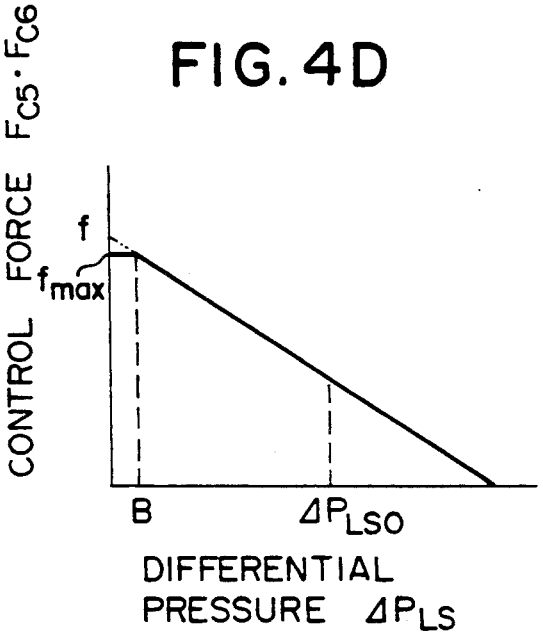
FIG. 4D is a graph showing the functional relationship between values of the differential pressure ΔP LS and control forces F c5, F c6 applied to distribution compensating valves associated with an arm cylinder and a bucket cylinder.

FIG. 4D shows the functional relationship between values of the differential pressure ΔP LS and the control forces F c5, F c6 applied to the distribution compensating valves 39, 40 associated with the arm cylinder 27 and the bucket cylinder 28. As seen, the functional relationship is set such that the values of the control forces Fc5, Fc6 are gradually reduced with an increase in the differential pressure ΔP LS in a large part of their range following the characteristics of the basic function, and when the differential pressure ΔP LS exceeds below the minimum flow compensating differential pressure B, the control forces are limited to a maximum value fmax less than the force f of the springs 49, 50 in spite of a decrease in the the differential pressure ΔP LS, similarly to the functional relationship shown in FIG. 4A.

Figure 5:
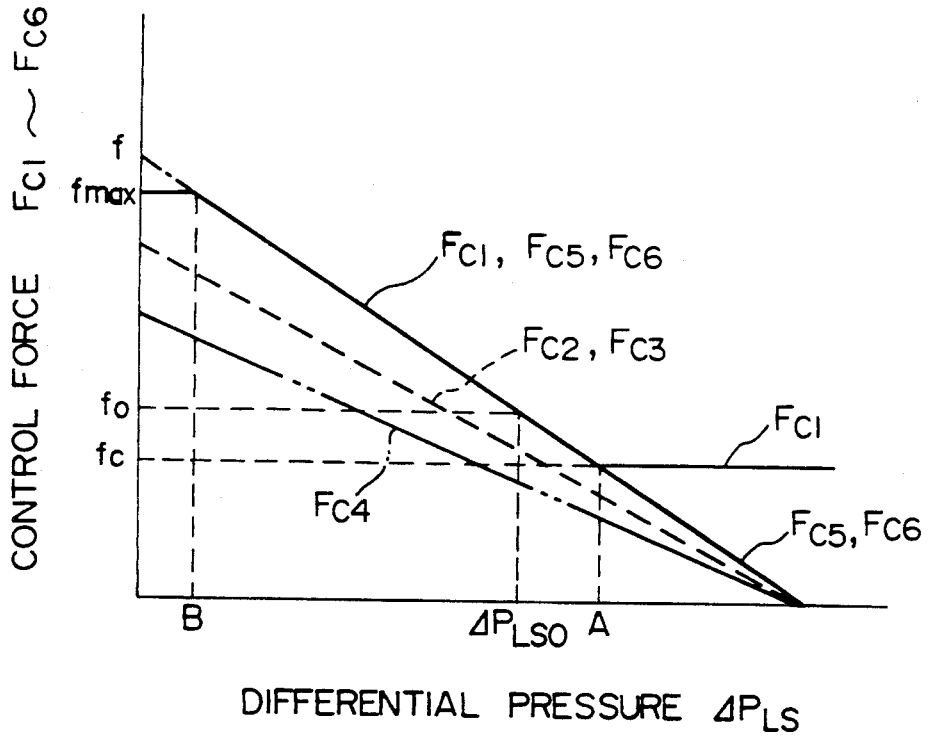
FIG. 5 is a graph showing the functional relationships plotted in FIGS. 4A–4D altogether.

FIG. 5 shows all the above functional relationships for easier understanding of mutual relation therebetween.

Figure 6:
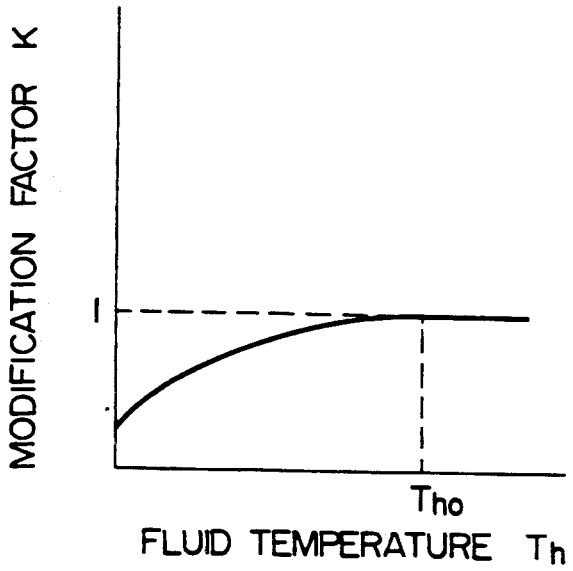
FIG. 6 is a graph showing the functional relationship between a fluid temperature Th and a compensation factor K.

FIG. 6 shows the functional relationship between the fluid temperature Th and the modification factor K, that is stored in the function block 86. This functional relationship is set such that the modification factor K is equal to 1 when the fluid temperature Th is higher than a predetermined temperature Tho, and it is gradually reduced less than 1 as the fluid temperature Th exceeds below the predetermined temperature Tho. Here, the predetermined temperature Tho represents a temperature at which the hydraulic fluid has such a degree of viscosity that will not significantly affect the flow rate discharged from the main pump 22.

The delay element blocks 90–95 set therein time constants T1–T6 for providing optimum time delays for operations of the actuators 23–28, respectively. Among those time constants, the time constants T2, T3 set by the blocks 91, 92 corresponding to the distribution compensating valves 36, 37 associated with the travel motors 24, 25 are extremely larger than the other time constants T1 and T4–T6, so that a larger time delay is given to change in the values of the control forces Fc2, Fc3 applied to the distribution compensating valves 36, 37.

Figure 7:
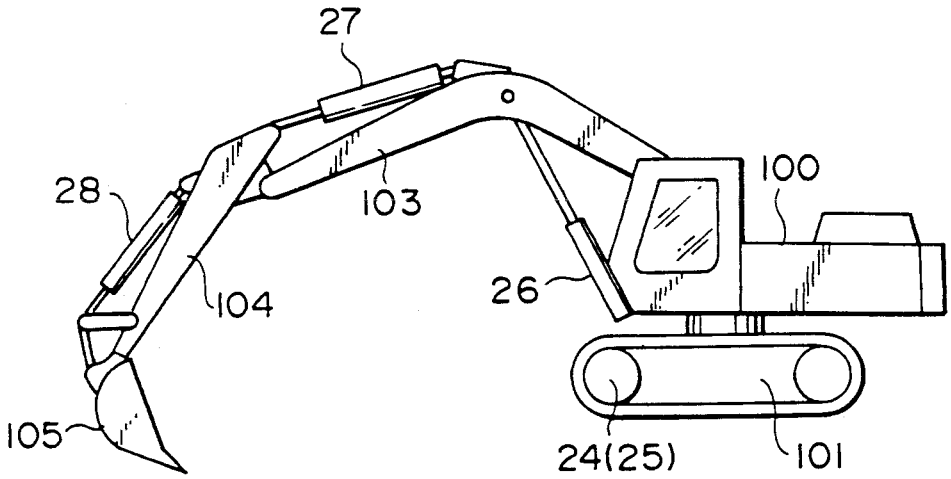
FIG. 7 is a side view of a hydraulic excavator to which the hydraulic drive system of this embodiment is applied.
Figure 8:
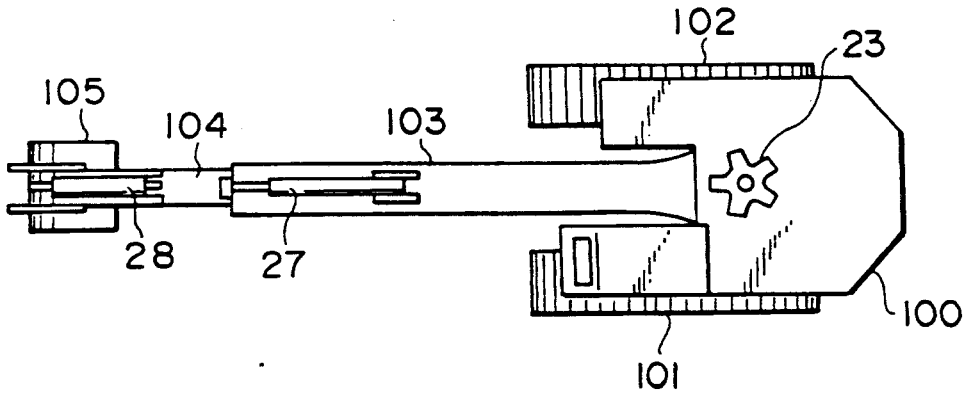
FIG. 8 is a plan view of the hydraulic excavator.

Working members of the hydraulic excavator driven by the hydraulic drive system of this embodiment are shown in FIGS. 7 and 8. The swing motor 23 drives a swing 100, and the left and right travel motors 25 drive crawler belts, i.e., travel means 101, 102. The boom cylinder 26, the arm cylinder 27 and the bucket cylinder 28 drive the boom 103, the arm 104 and the bucket 105, respectively.

Operation of this embodiment thus constructed will now be described.

When any one or plural ones of the flow control valves 29–34 are operated, the hydraulic fluid is supplied from the main pump 22 to the associated actuators through the distribution compensating valves and the flow control valves. At this time, the main pump 22 is under the load-sensing control by the discharge control device 41, and the differential pressure detector 59 detects the differential pressure ΔP LS between the discharge pressure of the main pump 22 and the maximum load pressure for applying the corresponding electric signal X1 to the controller 21. Simultaneously, the fluid temperature detector 60 detects a temperature of the hydraulic fluid for applying the corresponding electric signal X2 to the controller 62.

As mentioned above, the arithmetic unit 72 of the controller 61 calculates the values of the control forces Fc1–Fc6, and the electric signals a–f corresponding to the calculated control forces are input to the solenoid proportional pressure reducing valves 62*a*–62*f* so that the solenoid proportional pressure reducing valves 62*a*–62*f* are driven and the control pressures P c1–P c6 corresponding to the control forces Fc1–Fc6 are hence introduced to the drive parts 35*c*–40*c* of the distribution compensating valves 35–40. Accordingly, the drive parts 35*c*–40*c* apply the control forces Fc1–Fc6 in the valve-closing direction to the distribution compensating valves 35–40, with the result that the second control forces f-Fc1, f-Fc2, f-Fc3, f-Fc4, f-Fc5 and f-Fc6 in the valve-opening direction are applied to the distribution compensating valves 35–40, respectively. Thus, if at least one of the flow control valves 29–34 is operated, the control forces Fc1–Fc6 are applied to the distribution compensating valves 35–40 at all times since then. Incidentally, the distribution compensating valve(s) associated with the flow control valve(s) not being operated is held in a fully opened position, because the first control force in accordance with the differential pressure across the flow control valve(s) does not act on the distribution compensating valve(s).

Next, on assumption that the hydraulic fluid has a temperature not lower than Tho shown in FIG. 6, operation of the distribution compensating valves 35–40 and operation of the actuators 23–28 will be described in connection with sole operation of the swing 100, the travel means 101, 102, the boom 103, the arm 104 or the bucket 105, or combined operation thereof.

When one of the flow control valves 29–34 is operated to perform sole operation of the swing 100, the travel means 101, 102, the boom 103, the arm 104 or the bucket 105, applied to the distribution compensating valve associated with the operated flow control valve is the first control force in the valve closing direction in accordance with the differential pressure across the flow control valve. The differential pressure across the flow control valve cannot exceed above the differential pressure ΔP LS between the discharge pressure of the main pump 22 under the load-sensing control and the maximum load pressure. In the case of sole operation, the differential pressure ΔP LS is generally held at the load-sensing compensated differential pressure ΔP LSO or thereabout.

On this occasion, when the operated flow control valve is associated with one of the swing motor 23, the arm 27 and the bucket 28, the control force Fc1, Fc5 or Fc6 applied to the drive part 35*c*, 39*c* or 40*c* of the distribution compensating valve 35, 39 or 40 are determined from the functional relationship shown in FIG. 4A or 4D. Here, the control force corresponding to the load-sensing compensated differential pressure ΔP LSO is given by fo. Therefore, f-fo is applied as the second control force to the distribution compensating valve 35, for example. As described above, f-fo represents a value effective to control the differential pressure ΔP v1 across the swing directional control valve 23 such that it becomes substantially coincident with the load-sensing compensated differential pressure ΔP LSO. Accordingly, the second control force f-fo is always almost equal to or larger than the first control force. As a result, the distribution compensating valve 35 remains at a fully opened position.

When the operated flow control valve is associated with one of the travel motors 24, 25 and the boom cylinder 26, the control force Fc2, Fc3 or Fc4 applied to the drive part 36*c*, 37*c* or 38*c* of the distribution compensating valve 36, 37 or 38 are determined from the functional relationship shown in FIG. 4B or 4C. Here, the control force corresponding to the load-sensing compensated differential pressure ΔP LSO is a value smaller than fo. Therefore, a force larger than f-fo is applied as the second control force to the distribution compensating valve 38, for example. Accordingly, in this case as well, the second control force becomes larger than the first control force, and the distribution compensating valve 38 remains at a fully opened position.

In this way, during sole operation to operate any one of the flow control valves 29–34, the associated distribution compensating valve is not basically operated, and the differential pressure across the flow control valve is mainly regulated by the main pump 22 under the load-sensing control. Thus, the hydraulic fluid is supplied to the actuator at the flow rate corresponding to an opening degree of the flow control valve.

There will now be described the case of combined operation of some actuators for the swing 100, the travel means 101, 102, the boom 103, the arm 104 and the bucket 105 by operating any two or more of the flow control valves 29–34.

When the flow control valves 29, 32 are driven simultaneously to perform combined operation of the swing 100 and the boom 103, e.g., combined operation of swing and boom-up, the hydraulic fluid is supplied from the main pump 22 to the swing motor 23 and the boom cylinder 26 through the distribution compensating valves 35, 38 and the flow control valves 29, 32, respectively. At this time, the differential pressure ΔP LS is normally less than the maximum flow compensating differential pressure A for the swing motor 23, and the control force Fc1 applied to the drive part 35*c* of the distribution compensating valve 35 is given by a value calculated from the functional relationship of FIG. 4A based on the characteristic of the basic function. The control force Fc4 applied to the drive part 38*c* of the distribution compensating valve 38 is given by a value calculated from the functional relationship of FIG. 4C, the value being smaller than that of the control force Fc1. Therefore, the second control forces f-Fc1, f-Fc4 applied to the distribution compensating valves 35, 38 in the valve-opening direction have the relationship of f-Fc1 < f-Fc4. In other words, the control forces f-Fc4 applied to the distribution compensating valve 38 in the valve-opening direction is larger than the control forces f-Fc1 applied to the distribution compensating valve 35 in the valve-opening direction. As a result, at the beginning of combined operation of swing and boom-up, the distribution compensating valve 38 associated with the boom cylinder 3 on the lower load pressure side is less restricted with the control force f-Fc4, so that the distribution compensating valve 38 is opened to a larger degree than would be given with the same control force f-Fc1 for the distribution compensating valve 35. Therefore, the differential pressure across the flow control valve 32 is controlled to become larger than the differential pressure across the flow control valve 29. The boom cylinder 26 is thus supplied with the hydraulic fluid at a larger flow rate than would be that resulted from distributing the total discharge rate of the main pump 22 dependent on the ratio of opening degrees of the flow control valves 29, 32. On the other hand, the swing motor 23 is supplied with the hydraulic fluid at a smaller flow rate than would be the latter case. Consequently, it is possible to reliably perform the combined operation of swing and boom-up in which the boom can be raised up at a higher speed while effecting relatively moderate swing operation.

Then, when returning the flow control valve 32 to its neutral position for stopping the boom cylinder from the above condition where the swing motor 23 and the boom cylinder 26 are driven simultaneously, the hydraulic fluid discharged from the main pump 22 is restricted by the flow control valve 23, whereupon the pump pressure temporarily increases and the differential pressure ΔP LS exceeds above the maximum flow compensating differential pressure A as a limit differential pressure for the normal combined operation. Therefore, the arithmetic unit 72 of the controller 72 calculates a constant value of the control force Fc1, i.e., maximum flow compensating control force fc, in spite of an increase in the differential pressure ΔP LS as shown in FIG. 4A. Accordingly, the second control force applied in the valve-opening direction to the distribution compensating valve 35 associated with the swing motor 23 becomes constant, i.e., f-fc. Thus, the distribution compensating valve 35 is going to open proportionally with an increase in the differential pressure ΔP LS, but restrained from being opened overly.

As a result of such control, even when the flow control valve 32 is operated toward its neutral position for stopping the boom cylinder 26 during the combined operation of swing and boom-up, the swing motor 23 is continuously supplied with the hydraulic fluid at the flow rate only slightly deviated from the flow rate that has been so far supplied to the swing motor 23, because the distribution compensating valve 35 is subjected to the maximum flow compensating control force fc corresponding to the maximum flow compensating differential pressure A and restrained from being opened overly, as stated above. This hence permits to prevent abrupt speed-up of the swing motor 23 not intended by an operator, and to provide operability and safety.

When the hydraulic excavator is traveled straightforward by operating the flow control valves 30, 31 at the same strokes, the hydraulic fluid is supplied from the main pump 22 to the left and right travel motors 24, 25 through the distribution compensating valves 36, 37 and the flow control valves 30, 31, respectively. At this time, the control forces Fc2, Fc3 applied to the drive parts 36c, 37c of the distribution compensating valves 36, 37 are both given by a value calculated from the functional relationship of FIG. 4B smaller than that calculated from the characteristic of the basic function. Therefore, the second control forces f-Fc2, f-Fc3 applied to the distribution compensating valves 36, 37 in the valve-opening direction have the relationship of f-Fc2>f-Fcr, f-Fc3>f-Fcr, assuming that the control force obtained from the basic function is Fcr. Here, the second control force f-Fcr based on the basic function represents a value to set a target value of the differential pressure across the flow control valve such that the target value becomes substantially equal to the differential pressure ΔP LS. Accordingly, the distribution compensating valves 36, 37 are urged with the larger second control force in the valve-opening direction than would be the case where the differential pressures across the flow control valves 30, 31 are controlled to become substantially equal to the differential pressure ΔP LS. The distribution compensating valves 36, 37 will not be thereby restricted until the differential pressures across the flow control valves 30, 31 are further increased by a predetermined value ΔP o corresponding to Fc2-Fcr or Fc3-Fcr. Thus, if there occurs a difference between the load pressures of the travel motors 24 and 25, neither distribution compensating valves are restricted so long as the the differential pressure is smaller than the predetermined value ΔP o, and hence the travel motors 24, 25 remain in a condition that they are connected to each other in parallel. Even if the differential pressure exceeds above the predetermined value ΔP o, it can be thought of that the travel motors 24, 25 are partially connected to each other in parallel, since the distribution compensating valve on the lower load pressure side is opened to a larger degree than would be the normal case.

As a result of such function of the distribution compensating valves, even when there occurs a difference between the load pressures of the travel motors 24 and 25 upon the left and right crawler belts undergoing different amounts of resistance during straightforward traveling, the travel motors 24, 25 remain in a condition that they are partially connected to each other in parallel. Thus, the ability of the crawler belts themselves to maintain straightforward travel serves to forcibly equalize the flow rates of the hydraulic fluid supplied to the left and right travel motors 24, 25, permitting the hydraulic excavator to continue the straightforward travel, in a like manner to a general hydraulic circuit in which the travel motors 24, 25 are connected to each other in parallel. As a result, it becomes possible to make an operator more free from manual adjusting work and also allow the operator to feel less fatigued.

Further, since the hydraulic excavator is forcibly traveled straightforward relying on the ability of the crawler belts themselves to maintain straightforward travel, while partially disabling the specific function of the distribution compensating valves, the excavator can be traveled straightforward intentionally regardless of possible variations in the capability of hydraulic equipments, such as the flow control valves 30, 31 and the distribution compensating valves 36, 37, due to manufacture errors, and the continued straightforward travel is ensured in spite of slight shifts in a control lever position. This also contributes to make an operator more free from manual adjusting work and also allow the operator to feel less fatigued.

Next, the case is considered where the flow control valve 32 is operated under a condition that the hydraulic excavator is traveled by operating the flow control valves 30, 31 to drive the travel motors 24, 25, for transition to combined operation of travel and boom-up.

When the flow control valve 32 is operated under a traveling condition, the hydraulic fluid from the main pump 22, that has been so far supplied to only the left and right travel motors, is now also supplied to the boom cylinder 26 through the distribution compensating valve 38 and the flow control valve 32.

In the case of combined operation of travel and boom-up, the boom cylinder 26 is usually on the higher load pressure side. At the moment of transition from a condition of sole travel operation to combined operation of travel and boom-up, the differential pressure ΔP LS is lowered to an extreme, whereupon the values of the control forces Fc2, Fc3 calculated from the functional relationship shown in FIG. 4B in the arithmetic unit 72 of the controller 61 are momentarily increased to a large extent. If the control forces Fc2, Fc3 are delivered from the output unit 73 in the form of electric signals b, c as they are, the second control forces f-Fc2, f-Fc3 in the valve-opening direction are abruptly reduced correspondingly. In other words, there occurs a phenomenon that the distribution compensating valves 36, 37 are momentarily closed to an extreme at the initial stage of transition from a condition of sole travel operation to combined operation of travel and boom-up, and then they start opening again. This produces a large fluctuation in the flow rate of the hydraulic fluid supplied to the travel motors 24, 25, resulting in that the traveling speed is extremely changed, the body of the hydraulic excavator suffers from a large shock, and the operability is lowered.

On the contrary, with this embodiment, there are provided delay element blocks 90–95 shown in FIG. 3, as mentioned above. Among those blocks, the blocks 91, 92 associated with the travel motors 24, 25 have their time constants T2, T3 much larger than the other time constants T1 and T4–T6, providing a longer time delay for change in the values of the control forces Fc2, Fc3. Therefore, even if the values of the control forces Fc2, Fc3 are changed abruptly, such change is dampened by the blocks 91, 92 and the values of the control forces Fc2, Fc3 applied to the drive parts 36*c*, 37*c* are changed moderately. Accordingly, the distribution compensating valves 36, 37 are prevented from being closed abruptly, and this enables to reduce the aforesaid fluctuation of the traveling speed and to keep the body of hydraulic excavator from suffering from a large shock, while ensuring good operability.

Further, considering the event that the differential pressure ΔP LS becomes zero momentarily for some reason, such as the case of driving another actuator which produces the higher load in a condition that at least one of the flow control valves 29, 33, 34 is operated to drive associated one of the swing motor 23, the arm cylinder 27 and the bucket cylinder 28, since the functional relationship between the differential pressure and the control forces for the swing motor 23, the arm cylinder 27 or the bucket cylinder 28 has the same gradient as the basic function as shown in FIGS. 4A and 4D, there occurs a phenomenon that the value of the control force Fc1, Fc5 or Fc6 become equal to the force f of the springs 45, 49 or 50 and the distribution compensating valve 35, 39 or 40 is closed completely, if the functional relationship is set perfectly coincident with the basic function. When the distribution compensating valve is closed completely, the flow rate of the hydraulic fluid supplied to the actuator 23, 27 or 28 becomes zero to cause a large shock on the swing 100, the arm 104 or the bucket 105. This is not only degrades operability significantly, but also leads to a fear of damaging hydraulic equipments.

With this embodiment, if the differential pressure ΔP LS exceeds below the minimum flow compensating differential pressure B upon the aforesaid decrease in the differential pressure ΔP LS, the control forces Fc1, Fc5, Fc6 are limited to the maximum value fmax lower than the force f of the spring 45 in spite of such decrease in the differential pressure ΔP LS. The distribution compensating valves 35, 39, 40 are thus prevented from being closed completly, making it possible to dampen a shock, improve operability, and protect the hydraulic equipments from damage.

Next, operation of the distribution compensating valves 35–40 and concomitant operation of the actuators 23–28 will be described in connection with the case that the temperature of the hydraulic fluid is changed down below Tho shown in FIG. 6.

In the arithmetic unit 72 of the controller 61, as mentioned above referring to FIG. 3, the modification factor K determined by the function block 86 is multiplied in multiplication blocks 87, 88, 89 by the values of the control forces Fc4–Fc6 determined by the function blocks 83, 84, 85, respectively, for modifying the control forces Fc4–Fc6 dependent on temperatures. As shown in FIG. 6, the modification factor K is equal to 1 when the fluid temperature Th is higher than the predetermined temperature Tho, and it is gradually reduced less than 1 as the fluid temperature Th exceeds below the predetermined temperature Tho. Under the normal working environment in the daytime where the fluid temperature Th is higher than the predetermined temperature Tho, the values of the control forces Fc4–Fc6 determined by the function blocks 83–85 are directly converted to the electric signals b, e, f for driving the distribution compensating valves 38–40 in accordance with the control forces Fc4–Fc6, respectively, because of $K=1$. When operating the flow control valve 38, 39 to simultaneously drive the boom 103 and the arm 104, for example, the hydraulic fluid can be supplied from the main pump 22 to the boom cylinder 26 and the arm cylinder 27 through the distribution compensating valves 38, 39 and the flow control valves 32, 33 without any troubles, i.e., without causing large flow resistance, for the relatively high fluid temperature Th provides small viscosity of the hydraulic fluid. It is thus possible to perform the combined operation of the arm and the bucket without lowering operation speeds of the actuators.

During the work in cold areas or under such working environment as in the early morning or at night in winter where the fluid temperature Th becomes lower than the predetermined temperature Tho, the values of the control forces Fc4–Fc6 multiplied by the modification factor K in the multiplication blocks 87–89 are smaller than the values calculated by the function blocks 83–85 because of $K<1$, and a difference in the values between the two cases is enlarged as the fluid temperature Th is lowered. Accordingly, dependent on a decrease in the fluid temperature, the smaller control forces Fc4–Fc6 than would be the normal case are applied from the drive parts 38*c*–40*c* of the distribution compensating valves 38–40, whereby the second control forces f-Fc4, f-Fc5, f-Fc6 applied to the distribution compensating valves 38–40 in the valve-opening direction becomes larger than would be the normal case with a decrease in the fluid temperature Th. More specifically, when the flow control valves 38, 39 are operated to simultaneously drive the boom 103 and the arm 104, for example, the hydraulic fluid is supplied to the boom cylinder 26 and the arm cylinder 27 through the distribution compensating valves 38, 39 and the flow control valves 32, 33 at the flow rates substantially equal to those in the case of the higher fluid temperature Th. Although the reduced fluid temperature Th increases viscosity of the hydraulic fluid and hence fluid resistance, it is thus possible to supply the hydraulic fluid to the boom cylinder 26 and the arm cylinder 27 at the desired flow rates required by the flow control valves 32, 33, and hence to perform the combined operation without lowering operation speeds of the actuators.

Combined operations with other combinations of the boom 103, the arm 104 and the bucket 105, or any sole operation thereof can be effected in a like manner.

In this way, by modifying the values of the control forces Fc4–Fc6 to adjust pressure compensating characteristics dependent on changes in the fluid temperature Th for the distribution compensating valves 38–40 associated with the boom cylinder 26, the arm cylinder 27 and the bucket cylinder 28, operation speeds of those actuators can be always kept constant regardless of changes in the fluid temperature, and stable sole operation or combined operation can be performed.

Meanwhile, the control forces Fc1–Fc3 determined by the function blocks 80–82 associated with the swing motor 23 and the travel motors 24, 25 are not modified dependent on fluid temperatures and output directly as the electric signals a–c through the delay element blocks 90–92. Therefore, when the fluid temperature is lower than the predetermined temperature Tho, viscosity of the hydraulic fluid and hence flow resistance are both increased to reduce the flow rates of the hydraulic fluid supplied to the boom cylinder 26 and the arm cylinder 27. Besides, unlike the boom cylinder 26, the arm cylinder 27 and the bucket cylinder 28 as actuators in a cylinder system, the swing motor 23 and the travel motors 24, 25 as actuators in a motor system are driven by the hydraulic fluid passing therethrough, and their internal parts may be damaged if the hydraulic fluid with higher viscosity is supplied to the same flow rate as that in the case of the normal one with lower viscosity. But, such damage can be avoided due to the aforesaid decrease in the flow rate.

With this embodiment, as described above, since the arithmetic unit 72 of the controller 61 separately calculates the values of the control forces Fc1–Fc6 applied through the drive parts **35*c*–40*c* of the the distribution compensating valves 35–40 based on the differential pressure ΔP LS in the function blocks 80–85 associated with the actuators 23–28, and the solenoid proportional pressure reducing valves 62*a*–62*f* associated with the distribution compensating valves 35–40 separately produce the control pressures P c1–P c6 corresponding to the respective control forces, the control pressures P c1–P c6 being introduced to the associated drive parts 35*c*–40*c*, it becomes possible to give the distribution compensating valves 35–40 with individual pressure compensating characteristics suitable for the separate associated actuators 23–28, to obtain the optimum distribution ratio dependent on types of the driven members 100–105** during combined operation of two or more of the driven member, and to improve both operability and working efficiency.

Furthermore, since the values of the control forces Fc1–Fc6 are separately calculated for the associated actuators 23–28 and the solenoid proportional pressure reducing valves **62*a*–62*f* separately produce the corresponding control pressures P c1–P c6, the control forces Fc1–Fc6 can be modified separately. This enables to introduce additional differences between operating characteristics of the distribution compensating valves in view of various conditions, such as providing the delay element blocks 90–95 to separately give the optimum time constants T1–T6 for the respective actuators, and/or providing the function block 86 for temperature-dependent modification to modify only the control forces Fc4–Fc6 by the modification factor K. As a result, operability and working efficiency can further be improved during combined operation of the actuators 23–28**.

It should be noted that the relationships between the the differential pressure ΔP LS and the control forces Fc1–Fc6, stored in the function blocks 80–85, in the above embodiment may be varied diversely.

Figure 9:
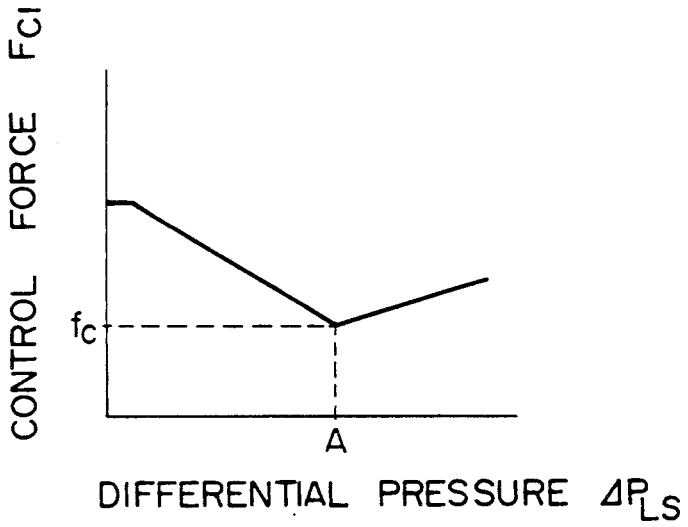
FIGS. 9–12 are graphs respectively showing four modified functional relationships between values of the differential pressure ΔP LS and the control force F c1 applied to the distribution compensating valve associated with the swing motor.
Figure 10:
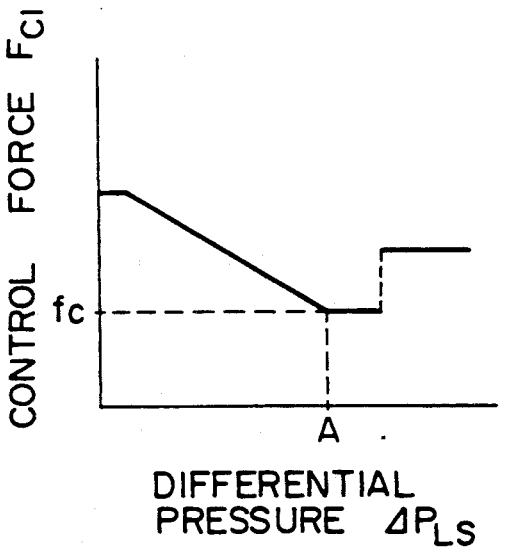
Figure 11:
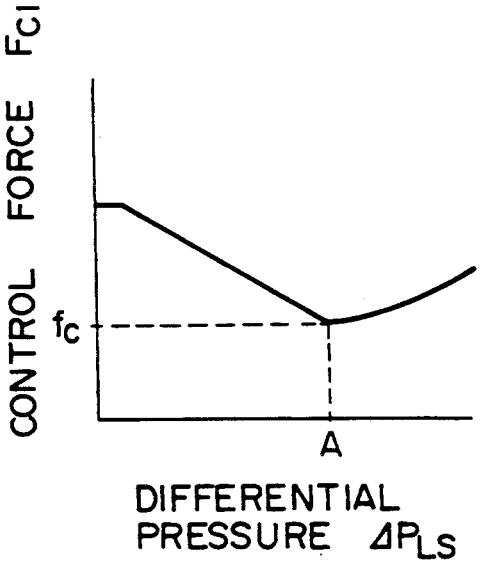
Figure 12:
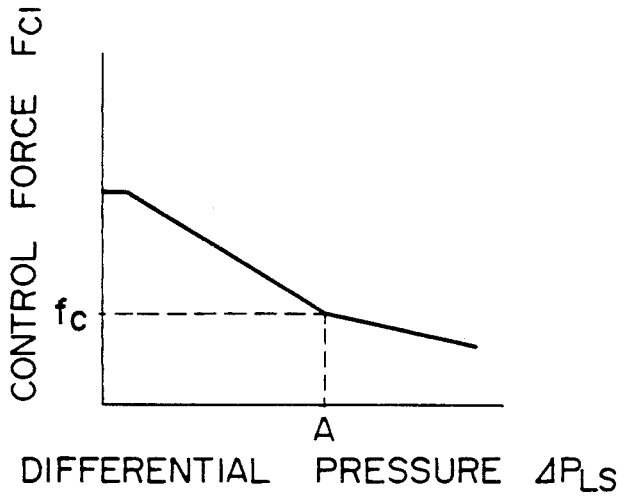

For example, as shown in FIG. 4A, the function block 80 associated with the swing motor 23 has the functional relationship set therein such that when the differential pressure ΔP LS is temporarily increased exceeding above the maximum flow compensating differential pressure A, the constant control force, i.e., maximum flow compensating control force fc, is obtained. But, such the functional relationship may be changed as follows by way of examples. FIG. 9 shows one modified functional relationship in which as the differential pressure ΔP LS increases above the maximum flow compensating differential pressure A, the output control force is proportionally increased from the maximum flow compensating control force fc, taking into account such parameters as flow characteristic of the hydraulic fluid and temperature of the hydraulic fluid. FIG. 10 shows another modified functional relationship in which as the differential pressure ΔP LS increases above the maximum flow compensating differential pressure A, the output control force is increased stepwisely. FIG. 11 shows still another modified functional relationship in which as the differential pressure ΔP LS increases above the maximum flow compensating differential pressure A, the output control force is increased following a curved line. FIG. 12 shows still another modified functional relationship in which as the differential pressure ΔP LS increases above the maximum flow compensating differential pressure A, the output control force is proportionally decreased at a relatively small gradient.

Further, although the above embodiment has set the functional relationship for only the distribution compensating valve 35 associated with the swing motor 23 such that when the differential pressure ΔP LS increases above the maximum flow compensating differential pressure A, the constant control force fc is obtained, the similar functional relationship between the differential pressure ΔP LS and the control force can optionally be set for the distribution compensating valves associated with other actuators as well.

Figure 13:
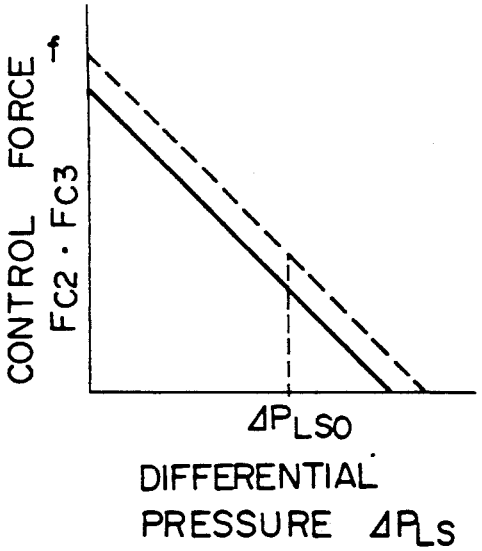
FIGS. 13 and 14 are graphs respectively showing two modified functional relationships between values of the differential pressure ΔP LS and the control forces F c2, F c3 applied to the distribution compensating valves associated with the travel motors.
Figure 14:
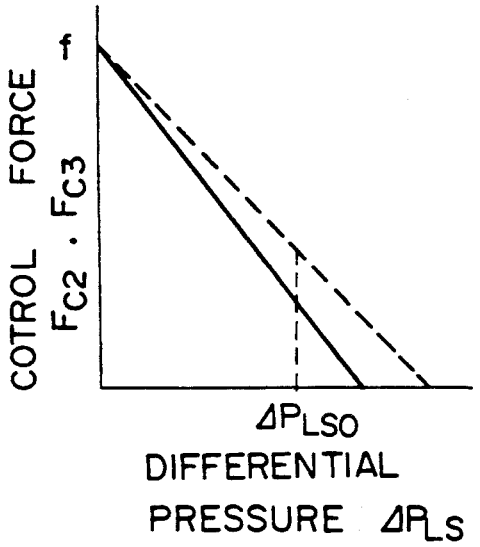

In addition, as shown in FIG. 4B, the function blocks 81, 82 associated with the travel motors 24, 25 have the functional relationship set therein such that as the differential pressure ΔP LS increases, the difference in the control force as compared with the case based on the characteristic of the basic function becomes smaller. However, the similar advantageous effect can also be resulted by setting the functional relationship in which the difference in the control force as compared with the case based on the characteristic of the basic function is kept constant regardless of changes in the differential pressure ΔP LS, as shown in FIG. 13, or another functional relationship in which as the differential pressure ΔP LS increases, the difference in the control force as compared with the case based on the characteristic of the basic function is enlarged gradually.

SECOND EMBODIMENT

A second embodiment of the present invention will be described below with reference to FIGS. 15 and 16. In the figures, the identical components to those shown in FIGS. 1-12 are denoted by the same characters.

Figure 15:
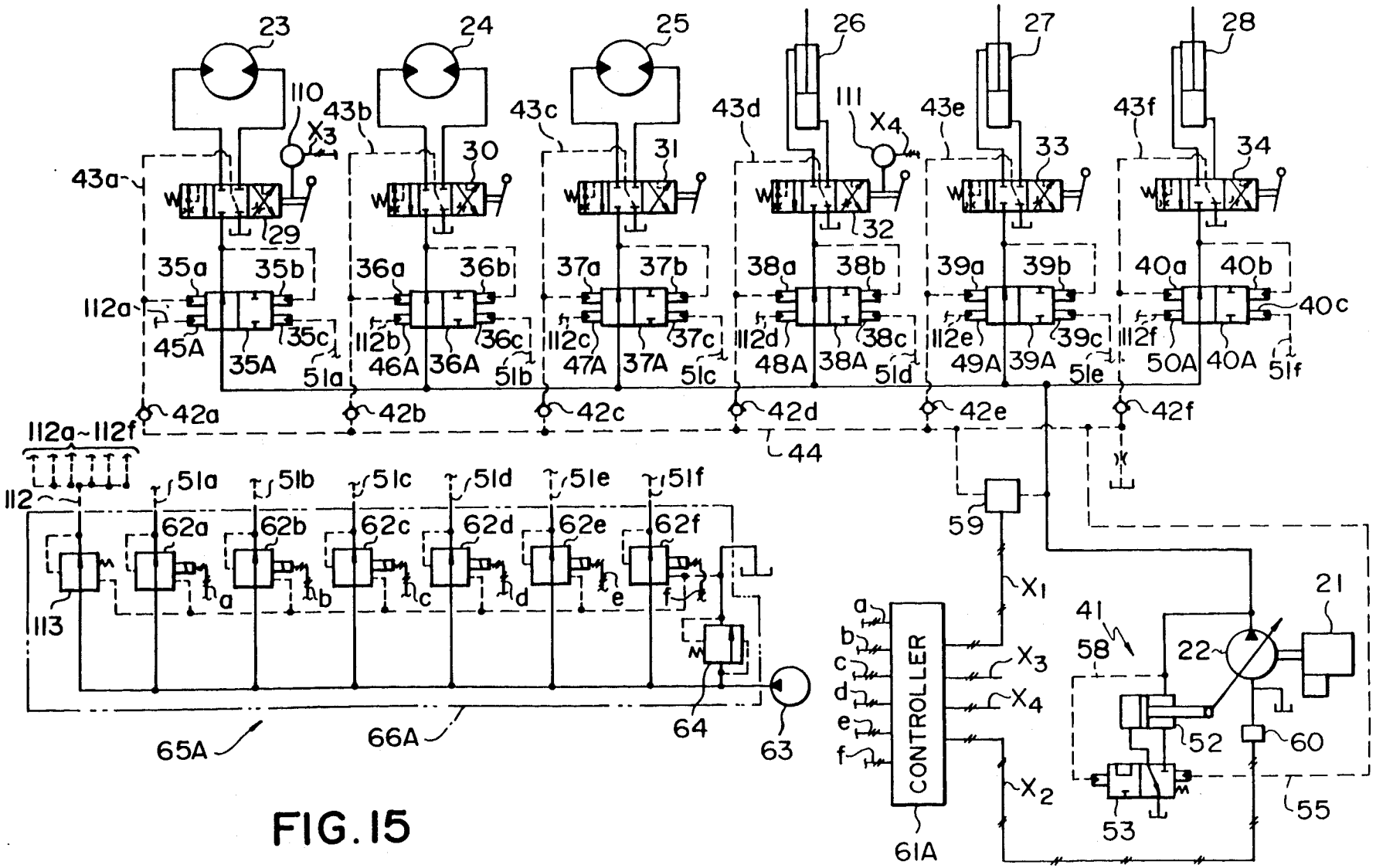
FIG. 15 is a circuit diagram showing an overall hydraulic drive system according to a second embodiment of the present invention.

Referring to FIG. 15, the swing directional control valve 29 and the boom directional control valve 32 are provided with operation detectors 110, 111 for detecting operations of the associated valves and outputting electric signals X3, X4, respectively. Further, distribution compensating valves 35A-40A are equipped with drive parts 45A-50A supplied with the same reference pilot pressure Pr through pilot lines 112*a*-112*f*, respectively, instead of providing the springs 45-50 in the first embodiment, for urging the valve bodies of the distribution compensating valves 35A-40A in the valve-opening direction with the same force as f of the springs 45-50.

The electric signals X3, X4 output from the operation detectors 110, 111 are applied, together with the electric signals X1, X2 output from the differential pressure detector 59 and the temperature detector 60, to a controller 61A which calculates values of the control forces Fc1- Fc6 applied by the drive parts 35*c*-40*c* of the distribution compensating valves using the electric signals X1, X2, X3 and X4, and then outputs corresponding electric signals a, b, c, d, e, f, respectively.

A control pressure generator circuit 65A serves also as a pilot pressure generator circuit. For this purpose, the circuit 65A additionally includes a pressure reducing valve 113 which produces the stable, constant reference pilot pressure Pr based on a pilot pressure delivered from the pilot pump 63, after absorbing fluctuations in the pilot pressure, the reference pilot pressure Pr being supplied to the pilot lines 112*a*-112*f* through a pilot line 112.

Preferably, as indicated by two-dot chain lines 66A, the solenoid proportional pressure reducing valves 62*a*-62*f*, the relief valve 64 and the pressure reducing valve 113 are constructed into one block of assembly.

As with the first embodiment, the controller 61A comprises an input unit, a storage unit, an arithmetic unit, and an output unit.

Figure 16:
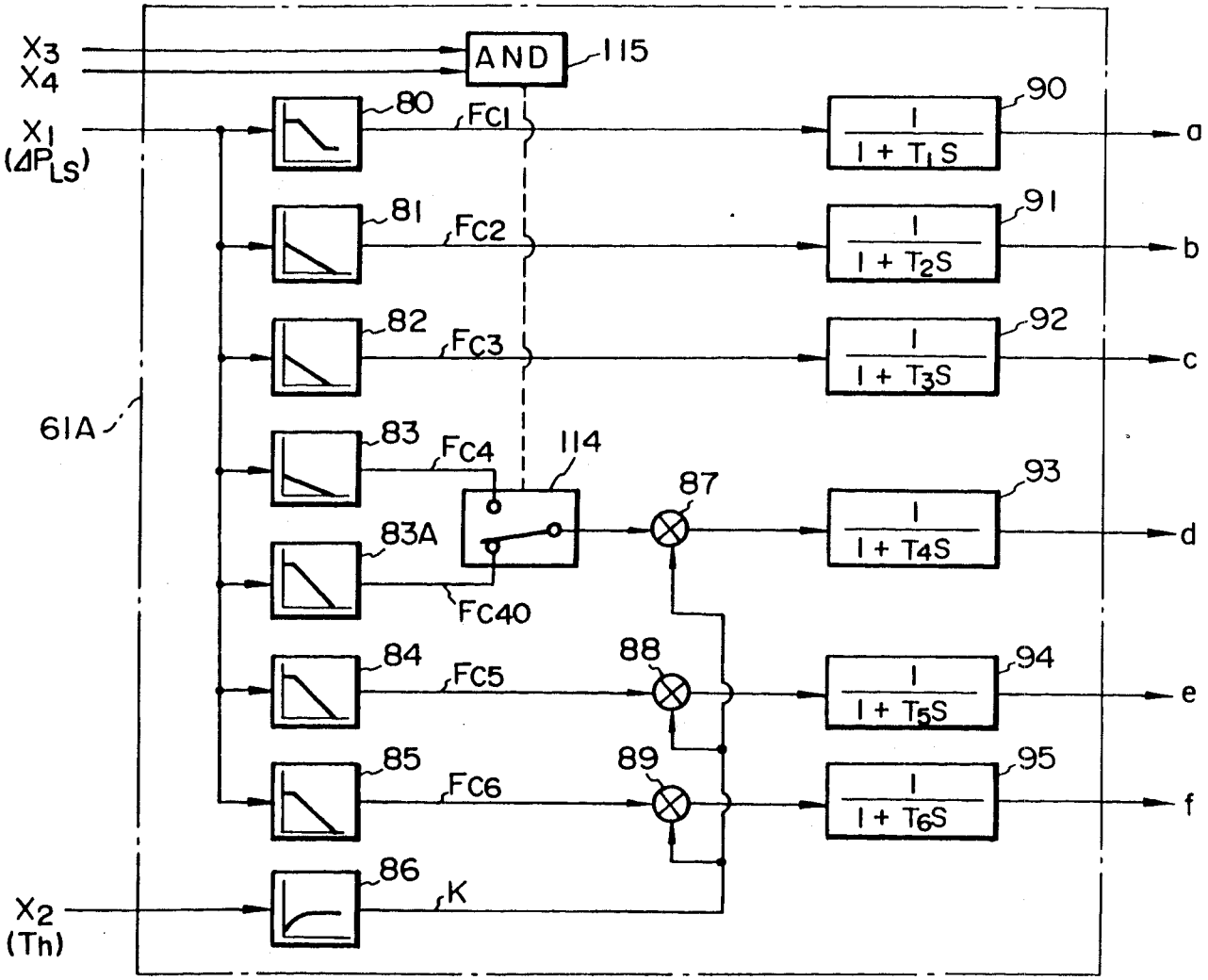
FIG. 16 is a functional block diagram showing the content of operation process performed by a controller.

The content of operation process performed by the arithmetic unit of the controller 61A is shown in a functional block diagram of FIG. 16. In this embodiment, the function block associated with the distribution compensating valves 38 includes a second function block 83A in addition to the function block 83. From these function blocks 83, 83A, the values of the control forces Fc4, Fc4o corresponding to the differential pressure ΔP LS are determined in accordance with the electric signal X1 at that time, and either one of which values is selected by a switch function of a selector block 114. Also, the electric signals X3, X4 from the operation detectors 110, 111 are input to an AND block 115 which outputs an ON signal to the selector block 114 when both the electric signals X3, X4 are ON. The selector block 114 selects the control force Fc4o in the absence of the ON signal from the AND block 115, and the control force Fc4 in the presence of the ON signal.

The functional relationship between the differential pressure ΔP LS and the control force Fc4, stored in the function block 83, is as described in connection with the first embodiment. The functional relationship between the differential pressure ΔP LS and the control force Fc4o, stored in the function block 83A, is the same as that stored in the function blocks 84, 85 corresponding to the distribution compensating valves associated with the arm cylinder 27 and the bucket cylinder 28, which has been described by referring to FIG. 4D in the first embodiment. More specifically, the value of the control force Fc4o is gradually reduced with an increase in the differential pressure ΔP LS in a large part of its range following the characteristic of the basic function, and when the differential pressure ΔP LS exceeds below the minimum flow compensating differential pressure B, the control force is limited to the maximum value fmax less than the urging force f of the drive part 48A in spite of a decrease in the the differential pressure ΔP LS.

With the second embodiment thus constructed, during combined operation of the boom 103 and another driven member excepting the swing 100, the swing directional control valve 29 is not operated and hence the electric signal X3 is not output from the operation detector 110, so that the AND block 115 outputs no ON signal in the controller 61A and the selector block 114 selects, as the control force, the control force Fc4o determined by the function block 83A. Therefore, the control force Fc4o in accordance with the characteristic of the basic function is applied from the drive parts 38*c* of the distribution compensating valves 38A, and the second control force f-Fc4o in the valve-opening direction provides such a value that a target value of the differential pressure ΔP v4 across the flow control valve 32 becomes substantially coincident with the differential pressure ΔP LS. In other words, the second control force f-Fc4o has a normal value smaller than that of the second control force f-Fc4 in accordance with the control force Fc4 obtained from the function block 83. This prevents the the distribution compensating valve 38A from being restricted insufficiently when the boom cylinder 26 is on the lower load pressure side, so that the differential pressure across the flow control valve 32 can be controlled to become coincident with the differential pressure ΔP LS for supplying the hydraulic fluid to the boom cylinder 26 at the flow rate corresponding to an operated amount of the flow control valve 32.

During combined operation of the swing 100 and the boom 103, the flow control valves 29, 32 are both operated and hence the electric signals X3, X4 are output from both the operation detectors 110, 111, so that the AND block 115 outputs the ON signal in the controller 61A and the selector block 114 selects, as the control force, the control force Fc4 determined by the function block 83. Therefore, as with the case of combined operation of swing and boom-up described above in the first embodiment, the second control forces f-Fc1, f-Fc4 applied to the distribution compensating valves 35, 38 have the relationship of f-Fc1<f-Fc4, with the result that the boom cylinder 26 is supplied with the hydraulic fluid at a larger flow rate than would be that resulted from distributing the total discharge rate of the main pump 22 dependent on the ratio of opening degrees of the flow control valves 29, 32, thereby enabling to practice the combined operation of swing and boom-up in which the boom can be raised up at a higher speed while effecting relatively moderate swing operation.

Further, with this embodiment, ones of drive means producing the second control forces for the distribution compensating valves 35A–40A comprise the drive parts 45A–50A, in place of the springs, supplied with the same reference pilot pressure Pr through the pilot lines 112 and **112*a*–112*f*. Accordingly, there arises no problem of manufacturing error of springs or variations incidental to changes over time, which can make very small driving errors caused between the distribution compensating valves 35A–40A. As a result, the separate second control forces f-Fc1, f-Fc2, f-Fc3, f-Fc4, f-Fc5 and f-Fc6 applied to the distribution compensating valves 35A–40A**, respectively, can be established more precisely than would be the case of using springs, and this enables to perform accurately the intended combined operation.

In addition, with this embodiment, the reference pilot pressure Pr introduced to the drive parts 45A–50A is delivered from the pressure reducing valve 113, and the pressure reducing valve 113 employs, for that purpose, the pilot pressure set by the relief valve 64 as with the solenoid proportional pressure reducing valves **62*a*–62*f***.

With the relief valve 64 as illustrated, however, if the tank pressure is varied due to some reasons such as return of the hydraulic fluid from the actuators, the pilot pressure delivered from the relief valve 64 is also changed correspondingly. Changes in the pilot pressure varies the outputs of the solenoid proportional pressure reducing valves **62*a*–62*f*, i.e., control pressures P c1–P c6, even with the electric signals a–f held at a constant level. Therefore, supposing that the force f applied from the drive parts 45A–50A** is fixed, the second control forces in the valve-opening direction are fluctuated notwithstanding the constant electric signals a–f.

On the contrary, in this embodiment, the output of the pressure reducing valve 113, i.e., the reference pilot pressure Pr, is also changed with fluctuations in the pilot pressure. Stated differently, as the control pressures P c1–P c6 changes, the reference pilot pressure Pr is also changed correspondingly. Therefore, both the changes are canceled to each other, as a result of which the second control forces in the valve-opening direction are kept constant. Accordingly, with this embodiment, any changes in the the tank pressure due to return of the hydraulic fluid from the actuators will not affect driving of the distribution compensating valves 35A–40A. It is thus possible to more accurately establish the separate second control forces f-Fc1, f-Fc2, f-Fc3, f-Fc4, f-Fc5 and f-Fc6 applied to the distribution compensating valves 35A–40A, respectively, in spite of changes in the tank pressure, resulting in good control accuracy.

THIRD EMBODIMENT

A third embodiment of the present invention will be described below with reference to FIGS. 17–24. In the figures, the identical components to those shown in FIGS. 1–12 are denoted by the same characters.

Figure 17:
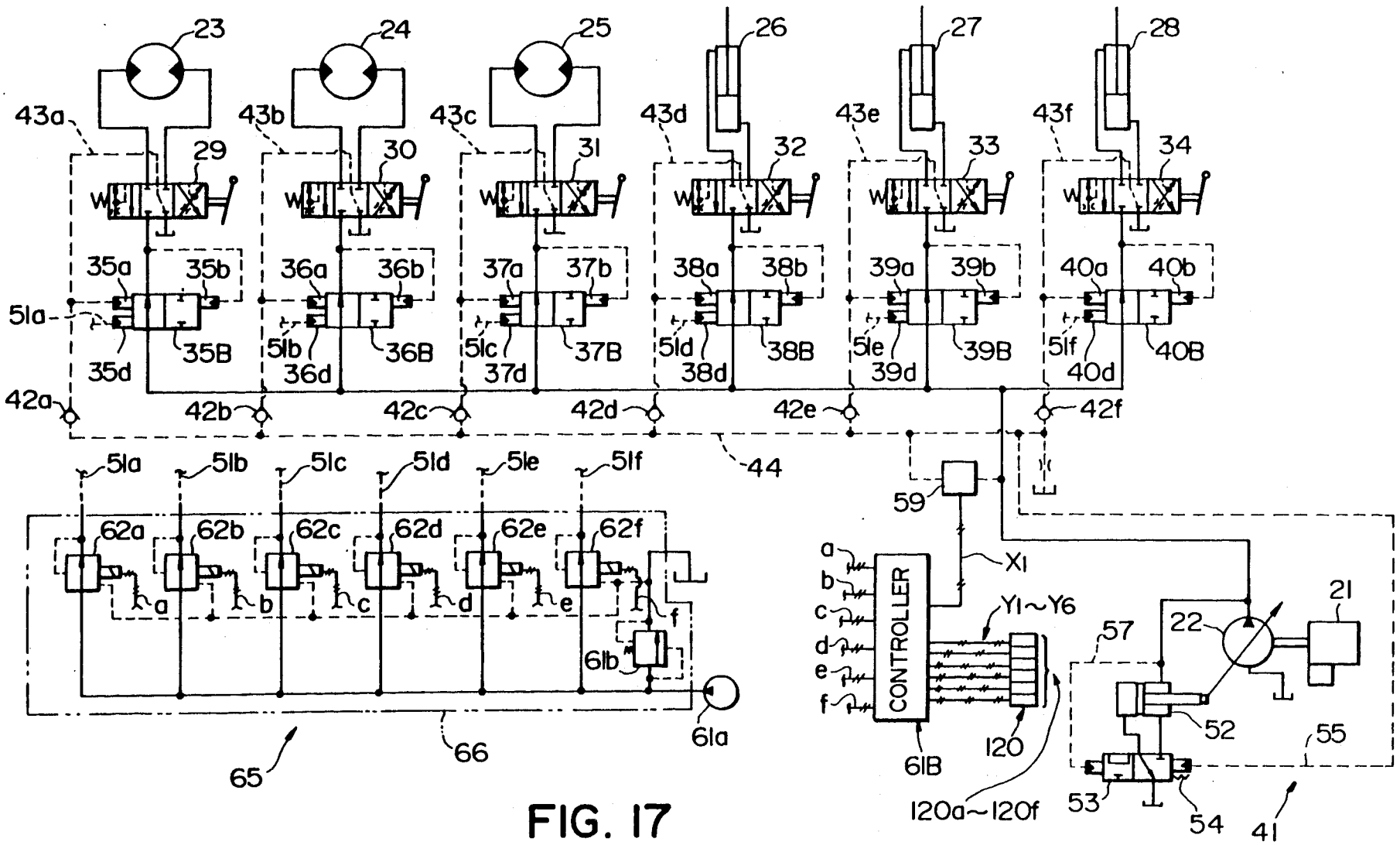
FIG. 17 is a circuit diagram showing an overall hydraulic drive system according to a third embodiment of the present invention.

Referring to FIG. 17, distribution compensating valves 35B–40B are provided with single drive elements, i.e., drive parts **35*d*–40*d*, as drive means for applying the second control forces to urge the valve bodies of the distribution compensating valves 35B–40B in the valve-opening direction, respectively, in place of two drive elements, i.e., the springs 45–50 and the drive parts 45*c*–50*c*. The drive parts 35*d*–40*d* are supplied with the control pressures P c1–P c6 through pilot lines 51*a*–51*f*** for directly applying the second control forces f-Fc1, f-Fc2, f-Fc3, f-Fc4, f-Fc5 and f-Fc6 thereto. Hereinafter, these second control forces will be designated as Hc1–Hc6, respectively.

This embodiment also has a selector device 120 including six selector switch elements **120*a*–120*f* provided in association with the actuators 23–28 and operable selectively by an operator into any desired one of plural positions. The selector switch elements 120*a*–120*f*** output select command signals, as electric signals Y1–Y6, which have their respective contents dependent on the selected positions.

As with the first embodiment, a controller 61B comprises an input unit, a storage unit, an arithmetic unit, and an output unit. The input unit of the controller 61B receives the electric signal X 1 output from the differential pressure detector 59 and the electric signals Y1–Y6 output from the selector device 120. The arithmetic unit of the controller 61B calculates values of the control forces Hc1–Hc6 based on the control program and the function data stored in the storage unit in accordance with the electric signals X1 and Y1–Y6. The output unit outputs the values of those control forces as electric signals a–f.

Figure 18:
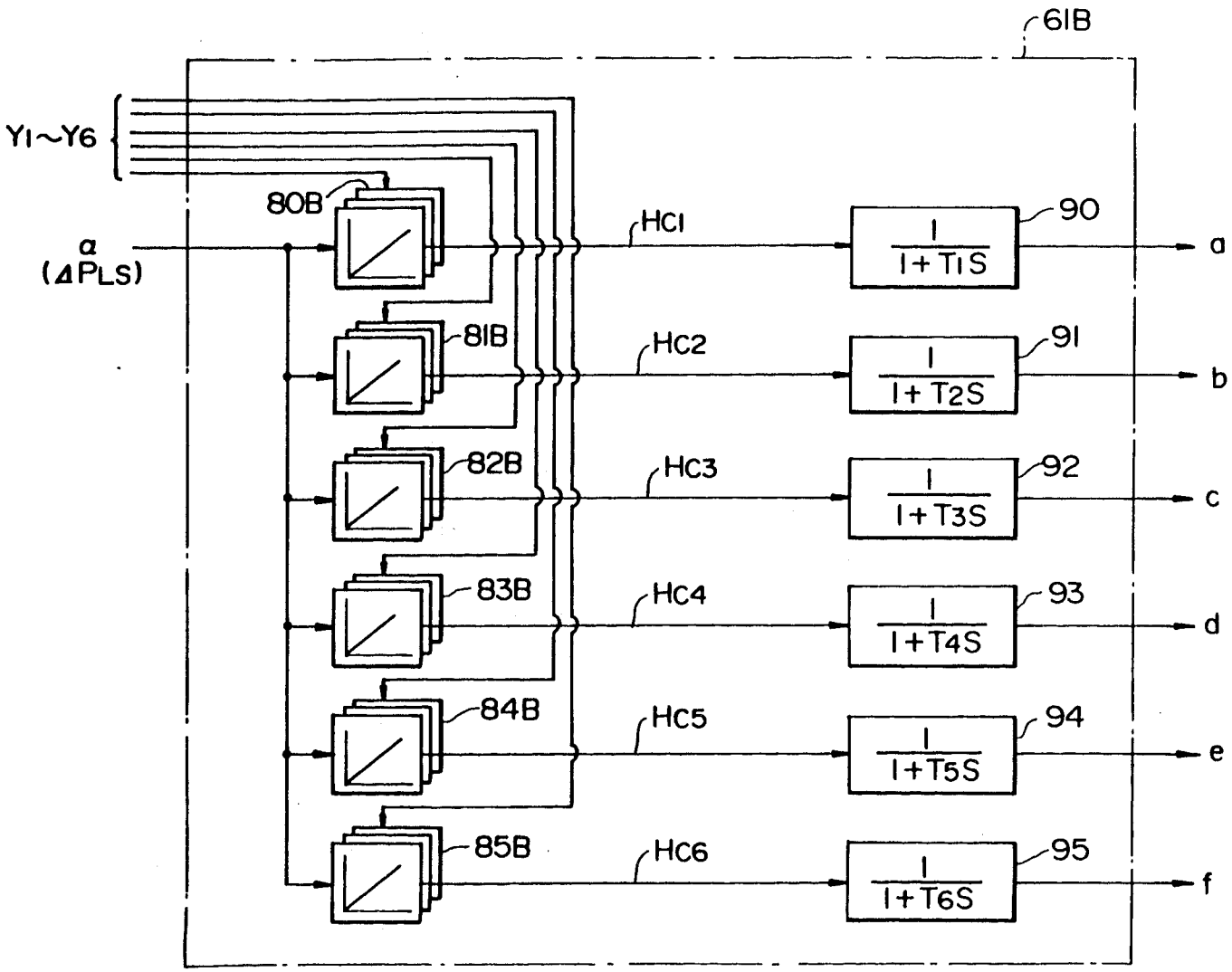
FIG. 18 is a functional block diagram showing the content of operation process performed by a controller.

The content of operation process performed by the arithmetic unit of the controller 61B is shown in a functional block diagram of FIG. 18. In the figure, blocks 80B–85B are provided in association with the distribution compensating valves 35B–40B, and are function blocks which previously store therein function data including a plurality of relationships between the differential pressure ΔP LS and each of the control forces Hc1–Hc6. In each of the function blocks 80B–85B, one functional relationship corresponding to the content of the select command signal is selected in accordance with each of the electric signals Y1–Y6. Based on the functional relationships thus selected, the values of the control forces Hc1–Hc6 corresponding to the differential pressure ΔP LS are calculated in accordance with the electric signal X1 at that time. The values of the control forces Hc1–Hc6 determined by the function blocks 80B–85B are filtered through the delay blocks 90–95 comprising primary delay elements, and then output as the electric signals a–f, respectively.

Figure 19:
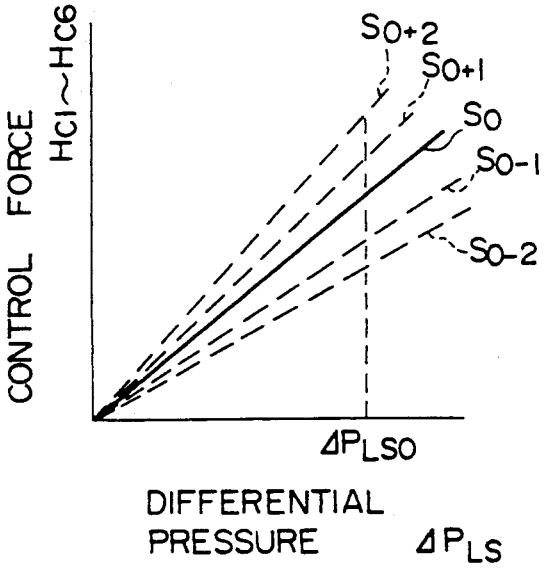
FIG. 19 is a graph showing the multiple functional relationships between the differential pressure ΔP LS and the control forces F c1–F c6.

The plural relationships between the differential pressure ΔP LS and the control force Hc1 stored in the function blocks 80B are shown in FIG. 19. In the figure, a solid line So corresponds the characteristic of the basic function described above in connection with the first embodiment, and hence represents the functional relationship in which the control force Hc1 is gradually increased with an increase in the differential pressure ΔP LS between the discharge pressure of the main pump 22 and the maximum load pressure among the actuators 23–28. This functional relationship So is employed in normal driving of the swing motor 23 including sole operation of the swing 100 in which there is no need to modify the second control force in the valve-opening direction of the distribution compensating valve 35B.

Broken lines So+1, So+2 represent the functional relationships in which the control force Hc1 is gradually increased at a larger gradient than that of the function So with an increase in the differential pressure ΔP LS. Broken lines So−1, So−2 represent the functional relationships in which the control force Hc1 is gradually increased at a smaller gradient than that of the function So with an increase in the differential pressure ΔP LS.

More specifically, the broken lines So+1, So+2 represent the functional relationships in which their gradient is larger than that of the characteristic line So of the basic function, and with which the second control force Hc1 in the valve-opening direction of the distribution compensating valve 35B is made greater than would be the case of the basic function, thereby increasing the differential pressure across the flow control valve 29 above the differential pressure ΔP LS between the discharge pressure of the main pump 22 and the maximum load pressure among the actuators 23-28. These functional relationships are employed in an attempt of supplying the hydraulic fluid to the swing motor 23 at the flow rate larger than would be the normal case, during the combined operation where the swing motor 23 is on the lower load pressure side.

The broken lines So−1, So−2 represent the functional relationships with which the second control force Hc1 in the valve-opening direction of the distribution compensating valve 35B is made smaller than would be the case of the basic function, thereby decreasing the differential pressure across the flow control valve 29 below the differential pressure ΔP LS. These functional relationships are employed in an attempt of supplying the hydraulic fluid to the swing motor 23 at the flow rate smaller than would be the normal case, during the combined operation where the swing motor 23 is on the lower load pressure side.

Incidentally, as with the first embodiment, ΔP LSO indicates the differential pressure between the discharge pressure of the main pump 22 and the maximum load pressure which is held by the discharge control device 41 under load-sensing control, i.e., load-sensing compensated differential pressure set by the spring 54 of the control valve 53.

Each of the other function blocks 81B-85B also stores therein a plurality of functional relationships in substantially like manner to the function block 80B. The number and types of the plural functional relationships stored in each of the function blocks 80B-85B are so selected as to provide optimum operating characteristics to the associated one of the actuators 23-28 dependent on the types and contents of work performed during combined operation.

Similarly to the first embodiment, the electric signals a-f output from the controller 61B are applied to the plurality of solenoid proportional pressure reducing valves **62*a*-62*f*. The solenoid proportional pressure reducing valves 62*a*-62*f* are driven by the electric signals a-f to deliver the corresponding control pressures P c1-P c6, respectively. The control pressures P c1-P c6 are introduced to the drive parts 35*d*-40*d* of the distribution compensating valves 35B-40B for applying the control forces Hc1-Hc6 calculated by the controller 61B to the distribution compensating valves 35B-40B, whereupon the distribution compensating valves 35B-40B controls the differential pressure ΔP v1-ΔP v6 across the flow control valves 29-34**, respectively.

Operation of this embodiment thus constructed will be described below.

When performing combined operation of swing and boom-up aiming at work of loading earth, for example, an operator actuates the relevant selector switch elements **120*a*, 120*d* of the selector device 120 to select the functional relationships suitable for the content of work to be performed, whereby the corresponding select command signals, i.e., electric signals Y1, Y4, are output. In response to the electric signals Y1, Y4, the functional relationship corresponding to the broken line So−2 in FIG. 19 among the plural functional relationships stored in the function block 80B, for example, is selected for the distribution compensating valve 35B associated with the swing motor 23, and the functional relationship corresponding to the broken line So+2 in FIG. 19 among the plural functional relationships stored in the function block 83B, for example, is selected for the distribution compensating valve 38B associated with the boom cylinder 26**, respectively.

Figure 20:
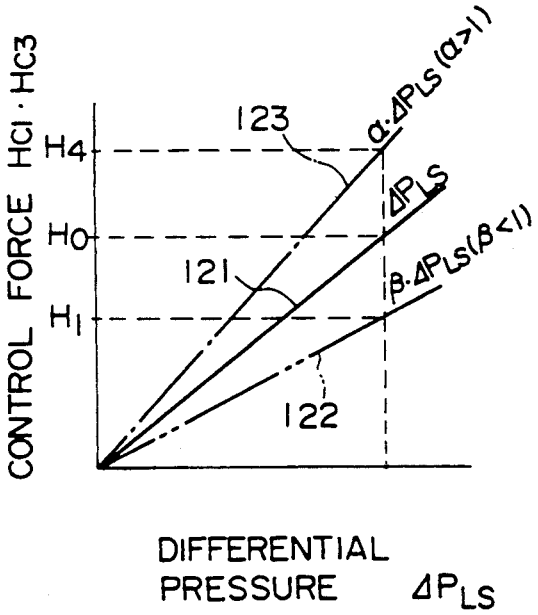
FIG. 20 is a graph showing the functional relationships selected to perform the combined operation of swing and boom-up altogether.

FIG. 20 shows the functional relationships selected by the function blocks 80B, 83B altogether. In the figure, 121 designates a characteristic line corresponding to the basic function So, 122 designates a characteristic line corresponding to the functional relationship of the broken line So−2 selected by the function block 80B associated with the swing motor 23, and 123 designates a characteristic line corresponding to the functional relationship of the broken line So+2 selected by the function block 83B associated with the boom cylinder 26.

Further, the control forces H1, H4 in accordance with the differential pressure ΔP LS are determined in the function blocks 80B, 83B from the selected functional relationships 122, 123, and the corresponding electric signals a, d are then output to the solenoid proportional pressure reducing valves **62*a*, 62*d***, respectively.

Thus, the solenoid proportional pressure reducing valve **62*d* delivers the control pressure P c4 larger than that corresponding to the control force Ho in accordance with the differential pressure ΔP LS, while the solenoid proportional pressure reducing valve 62*a* delivers the control pressure P c1 smaller than that corresponding to the control force Ho. These control pressures P c1, P c4 are introduced to the drive parts 35*d*, 38*d* of the distribution compensating valves 35B, 38B, respectively. At this time, the drive part 38*d* of the distribution compensating valve 38B applies the control force H4 larger than the normal control force Ho, so that the distribution compensating valve 38B is controlled to be forcibly less restricted and the flow control valve 32 is hence supplied with the hydraulic fluid at the flow rate larger than would be the normal case. Also, the drive part 35*d* of the distribution compensating valve 35B applies the control force H1 smaller than the normal control force Ho, so that the distribution compensating valve 35B is controlled to be forcibly still further restricted and the flow control valve 29** is hence supplied with the hydraulic fluid at the flow rate smaller than would be the normal case.

Figure 21:
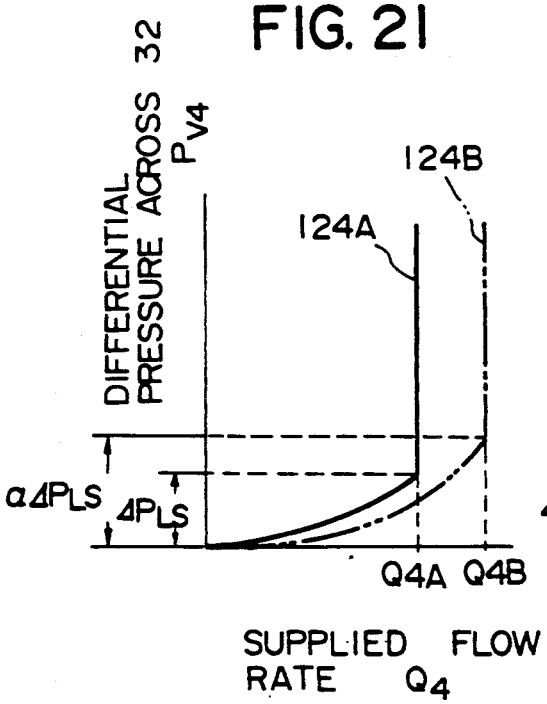
FIG. 21 is a graph showing the functional relationship between the supplied flow rate and the differential pressure across the boom flow control valve during the above combined operation.
Figure 22:
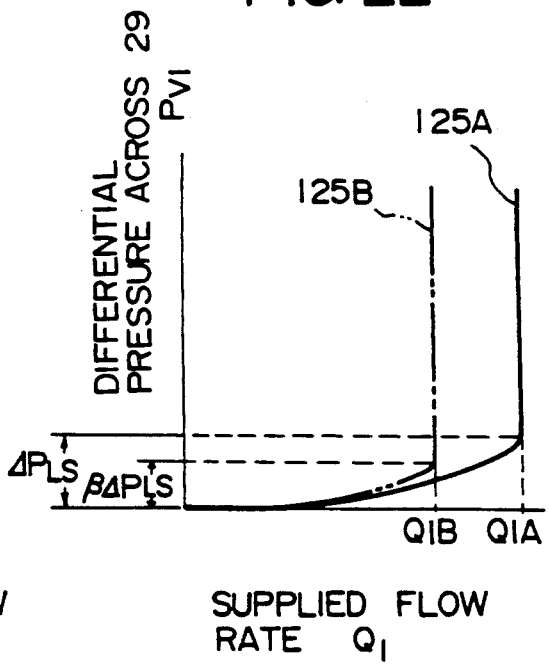
FIG. 22 is a graph showing the functional relationship between the supplied flow rate and the differential pressure across the arm flow control valve during the above combined operation.

FIGS. 21 and 22 show characteristics of the flow rates in the above cases. FIG. 21 shows the relationship between the differential pressure ΔP v4 across the boom flow control valve 32 and the supplied flow rate Q4, and FIG. 22 shows the relationship between the differential pressure ΔP v1 across the swing flow control valve 29 and the supplied flow rate Q1. Here, assuming that the gradient ratio of the characteristic line 123 to the characteristic line 121 of the basic function is given by α, while the boom flow control valve 32 was supplied with the hydraulic fluid at the relatively small flow rate Q4A as indicated by a characteristic line 124A in FIG. 21 in the case of normal control based on the differential pressure ΔP LS, the valve 32 can now be supplied with the hydraulic fluid at the flow rate Q4B larger than the flow rate Q4A, as indicated by a characteristic line 124B in FIG. 21, in accordance with the compensated differential pressure $\alpha \cdot \Delta P$ LS in the case of earth loading work. Also, assuming that the gradient ratio of the characteristic line 122 to the characteristic line 121 of the basic function is given by $\beta$, while the swing flow control valve 29 was supplied with the hydraulic fluid at the relatively large flow rate Q1A as indicated by a characteristic line 125A in FIG. 22 in the case of normal control based on the differential pressure $\Delta P$ LS, the valve 29 can now be supplied with the hydraulic fluid at the flow rate Q1B smaller than the flow rate Q1A, as indicated by a characteristic line 125B in FIG. 22, in accordance with the compensated differential pressure $\beta \cdot \Delta P$ LS in the case of earth loading work.

Stated differently, during the earth loading work, it is possible to supply the hydraulic fluid to the boom cylinder 26 at the relatively larger flow rate than would be the case of normal control, and to the swing motor 23 at the relatively smaller flow rate. Therefore, the hydraulic fluid can be distributed to the boom cylinder 26 and the swing motor 23 at the respective flow rates optimum for the earth loading work. This permits to reduce the flow rate of the hydraulic fluid released from the side of the swing motor 23, and to restrict the distribution compensating valve 38B associated with the boom cylinder 26 to a less extent, so that energy of the hydraulic fluid passing through the distribution compensating valve 38B can be restrained from being converted to heat, thereby collectively reducing the degree of energy loss. Moreover, since the hydraulic fluid can be supplied to the boom side at the relatively larger flow rate, it is also possible to ensure a sufficient lift amount of the boom and provide good operability.

Next, when performing combined operation of the arm and the bucket aiming at digging work to improve working efficiency as compared with the normal digging work, i.e., aiming at specical digging work, an operator actuates the relevant selector switch elements **120*e*, 120*f* of the selector device 120 to select the functional relationships suitable for the content of work to be performed, whereby the corresponding select command signals, i.e., electric signals Y5, Y6, are output. In response to the electric signals Y5, Y6, the functional relationship corresponding to the broken line So−1 in FIG. 19 among the plural functional relationships stored in the function block 84B, for example, is selected for the distribution compensating valve 39B associated with the arm cylinder 27, and the functional relationship corresponding to the broken line So+1 in FIG. 19 among the plural functional relationships stored in the function block 85B, for example, is selected for the distribution compensating valve 40B associated with the bucket cylinder 28**, respectively.

Figure 23:
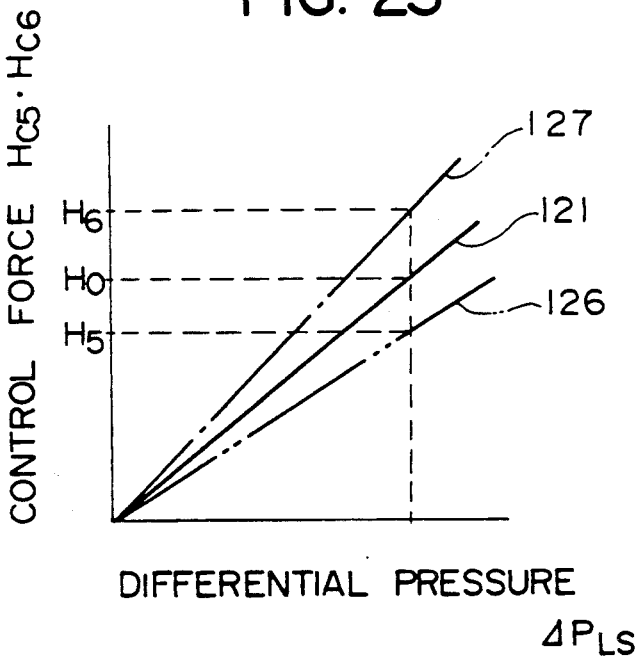
FIG. 23 is a graph showing the functional relationships selected to perform the combined operation of arm and bucket aiming at special digging work altogether.

FIG. 23 shows the functional relationships selected by the function blocks 84B, 85B altogether. In the figure, 121 designates a characteristic line corresponding to the basic function So, 126 designates a characteristic line corresponding to the functional relationship of the broken line So−1 selected by the functional block 84B associated with the arm cylinder 27, and 127 designates a characteristic line corresponding to the functional relationship of the broken line So+1 selected by the function block 85B associated with the bucket cylinder 26.

Further, the control forces H5, H6 in accordance with the differential pressure $\Delta P$ LS are determined in the function blocks 84B, 85B from the selected functional relationships 126, 127, and the corresponding electric signals e, f are then output to the solenoid proportional pressure reducing valves **62*e*, 62*f***, respectively.

Thus, the solenoid proportional pressure reducing valve **62*e* delivers the control pressure P c5 smaller than that corresponding to the control force Ho in accordance with the differential pressure $\Delta P$ LS, while the solenoid proportional pressure reducing valve 62*f* delivers the control pressure P c6 larger than that corresponding to the control force Ho. These control pressures P c5, P c6 are introduced to the drive parts 39*d*, 40*d* of the distribution compensating valves 39B, 40B, respectively. At this time, the drive part 39*d* of the distribution compensating valve 39B applies the control force H5 smaller than the normal control force Ho, so that the distribution compensating valve 39B is controlled to be forcibly still further restricted and the flow control valve 33 is hence supplied with the hydraulic fluid at the flow rate smaller than would be the normal case. Also, the drive part 40*d* of the distribution compensating valve 40B applies the control force H6 larger than the normal control force Ho, so that the distribution compensating valve 40B is controlled to be forcibly less restricted and the flow control valve 34** is hence supplied with the hydraulic fluid at the flow rate larger than would be the normal case.

As a result, during the combined operation of the arm and the bucket, the arm cylinder 27 is operated at a relatively lower drive speed and the bucket cylinder 28 is operated at a relatively higher drive speed, to thereby achieve the special digging work superior to the normal digging work in the point of working efficiency.

Next, when performing combined operation of the arm and the bucket aiming at shaping work to the ground or so, for example, as one type of combined operations of the arm and the bucket, an operator actuates the relevant selector switch elements **120*e*, 120*f* of the selector device 120 to select the functional relationships suitable for the content of work to be performed, whereby the corresponding select command signals, i.e., electric signals Y5, Y6, are output. In response to the electric signals Y5, Y6, the functional relationship corresponding to the broken line So+1 in FIG. 19 among the plural functional relationships stored in the function block 84B, for example, is selected for the distribution compensating valve 39B associated with the arm cylinder 27, and the functional relationship corresponding to the broken line So−1 in FIG. 19 among the plural functional relationships stored in the function block 85B, for example, is selected for the distribution compensating valve 40B associated with the bucket cylinder 28**, respectively.

Figure 24:
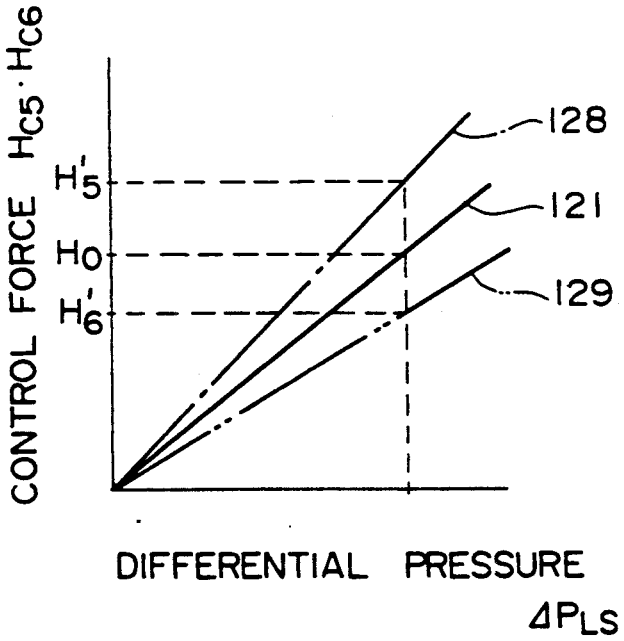
FIG. 24 is a graph showing the functional relationships selected to perform the combined operation of arm and bucket aiming at shaping work to level the ground or the like altogether.

FIG. 24 shows the functional relationships selected by the function blocks 84B, 85B altogether. In the figure, 121 designates a characteristic line corresponding to the basic function So, 128 designates a characteristic line corresponding to the functional relationship of the broken line So+1 selected by the function block 84B associated with the arm cylinder 27, and 129 designates a characteristic line corresponding to the functional relationship of the broken line So+1 selected by the function block 85B associated with the bucket cylinder 26.

Further, the control forces H'5, H'6 in accordance with the differential pressure $\Delta P$ LS are determined in the function blocks 84B, 85B from the selected functional relationships 128, 129, and the corresponding electric signals e, f are then output to the solenoid proportional pressure reducing valves 62*e*, 62*f*, respectively.

Thus, the solenoid proportional pressure reducing valve 62*e* delivers the control pressure P c5 larger than that corresponding to the control force Ho in accordance with the differential pressure ΔP LS, while the solenoid proportional pressure reducing valve 62*f* delivers the control pressure P c6 smaller than that corresponding to the control force Ho. These control pressures P c5, P c6 are introduced to the drive parts 39*d*, 40*d* of the distribution compensating valves 39B, 40B, respectively. At this time, the drive part 38*d* of the distribution compensating valve 39B applies the control force H'5 larger than the normal control force Ho, so that the distribution compensating valve 39B is controlled to be forcibly less restricted and the flow control valve 33 is hence supplied with the hydraulic fluid at the flow rate larger than would be the normal case. Also, the drive part 40*d* of the distribution compensating valve 40B applies the control force H'6 smaller than the normal control force Ho, so that the distribution compensating valve 40B is controlled to be forcibly still further restricted and the flow control valve 34 is hence supplied with the hydraulic fluid at the flow rate smaller than would be the normal case.

As a result, during the combined operation of the arm and the bucket, the arm cylinder 27 is operated at a relatively higher drive speed and the bucket cylinder 28 is operated at a relatively lower drive speed, to thereby achieve the work of leveling the ground, i.e., shaping work, with good working efficiency.

MODIFICATION OF THIRD EMBODIMENT

Figure 25:
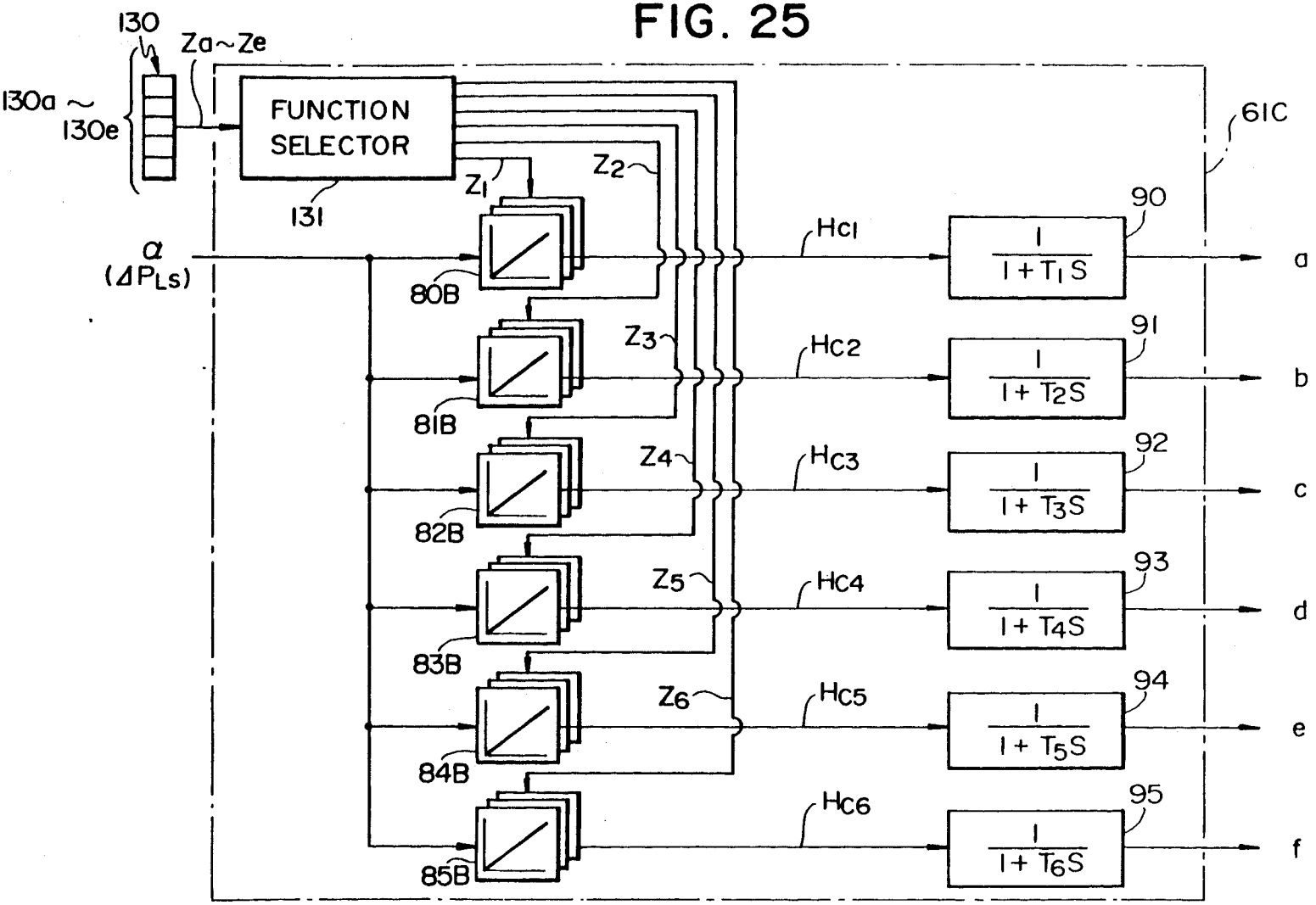
FIG. 25 is a functional block diagram showing the content of operation process performed by the controller in a modification of the third embodiment.
Figure 26:
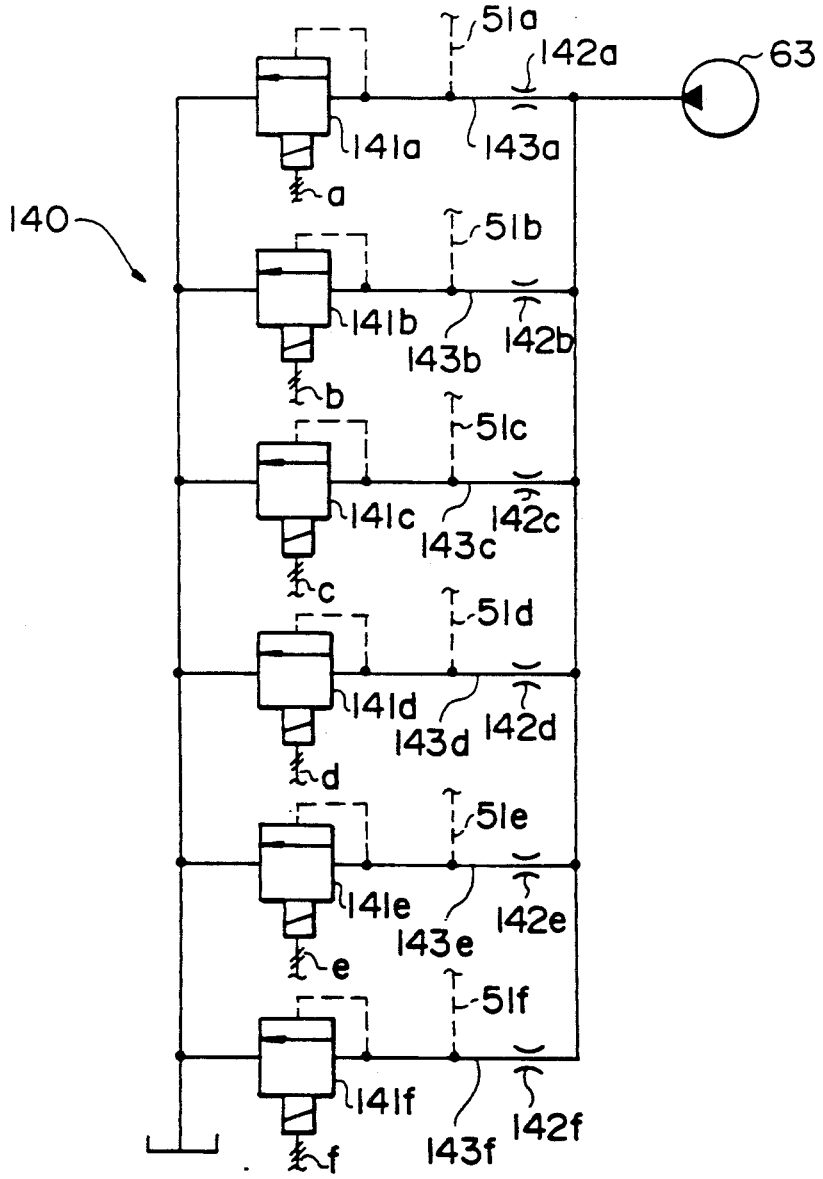
FIG. 26 is a circuit diagram showing another embodiment of a control force generator circuit.

A modification of the above-mentioned third embodiment will be described below with reference to FIG. 25. In the figure, the identical components to those shown in FIG. 18 are denoted by the same characters.

This embodiment has, in place of the aforesaid selector device 120, a selector device 130 including five selector switch elements 130*a*–130*e*, for example, which are provided corresponding to working modes and operable selectively by an operator. When actuated, the selector switch elements 130*a*–130*e* output select command signals different dependent on the corresponding working modes as electric signals Za–Ze. Note that only any one of the selector switch elements can be actuated at a time, and the selector device 130 outputs one of the electric signals Za–Ze dependent on the selector switch element actuated.

As with the first embodiment, a controller 61C comprises an input unit, a storage unit, an arithmetic unit, and an output unit. The input unit of the controller 61C receives the electric signal X1 output from the differential pressure detector 59 and the electric signals Za–Ze output from the selector device 130. The arithmetic unit of the controller 61C selects, in a function select command block 131, both one or more of function blocks 80B–85B and one of plural functional relationships stored in each selected function block in accordance with the electric signal input, and then outputs the corresponding select command signals Z1–Z6. The function blocks 80B–85B calculate values of the control forces Hc1–Hc6 based on the control program and the function data stored in the storage unit in accordance with the electric signals X1 and Z1–Z6. The output unit outputs the values of those control forces as electric signals a–f.

With this embodiment thus constructed, when one of the selector switch elements 130*a*–130*e* of the selector device 130, e.g., the selector switch element 130*a*, is actuated aiming at work of loading earth with combined operation of swing and boom-up, for example, the electric signal Za is output from the selector device 130. In response to the electric signal Za, the function select command block 131 in the controller 61C performs calculations to select the two function blocks 80B, 83B, and then to select the functional relationship of the aforesaid broken line So−2 shown in FIG. 19 among the plural functional relationships for the function block 80B, and the functional relationship of the aforesaid broken line So+2 shown in FIG. 19 among the plural functional relationships for the function block 83B, followed by outputting the corresponding select command signals Z1, Z4. Note that the function select command block 131 selects the basic function So in FIG. 19 for the other function blocks 81B, 82B, 84B and 85B and then outputs the corresponding select command signals Z2, Z3, Z5 and Z6, respectively.

The function blocks 80B, 83B select the functional relationships commanded by the select command signals Z1, Z4. Thus, as with the above embodiment, it is possible to supply the hydraulic fluid to the boom cylinder 26 at the relatively larger flow rate than would be the case of normal control, and to the swing motor 23 at the relatively smaller flow rate. Therefore, the hydraulic fluid can be distributed to the boom cylinder 26 and the swing motor 23 at the respective flow rates optimum for the earth loading work, with the result of improved operability.

Further, when one of the selector switch elements 130*a*–130*e* of the selector device 130, e.g., selector switch element 130*b*, is actuated aiming at special digging work by combined operation of the arm and the bucket to improve working effciency as compared with the normal digging work, for example, the electric signal Zb is output from the selector device 130. In response to the electric signal Zb, the function select command block 131 in the controller 61C performs calculations to select the two function blocks 84B, 85B, and then to select the functional relationship of the aforesaid broken line So−1 shown in FIG. 19 among the plural functional relationships for the function block 84B, and the functional relationship of the aforesaid broken line So+1 shown in FIG. 19 among the plural functional relationships for the function block 85B, followed by outputting the corresponding select command signals Z5, Z6.

The function blocks 84B, 85B select the functional relationships commanded by the select command signals Z5, Z6. Thus, as with the above embodiment, it is possible to operate the arm cylinder 27 at a relatively lower drive speed and the bucket cylinder 28 at the relatively higher drive speed during the combined operation of the arm and the bucket, thereby achieving the special digging work superior to the normal digging work in the point of working efficiency.

Moreover, when one of the selector switch elements 130*a*–130*e* of the selector device 130, e.g., selector switch element 130*c*, is actuated aiming at shaping work by combined operation of the arm and the bucket to level the ground, for example, the electric signal Zc is output from the selector device 130. In response to the electric signal Zc, the function select command block 131 in the controller 61C performs calculations to select the two function blocks 84B, 85B, and then to select the functional relationship of the aforesaid broken line So+1 shown in FIG. 19 among the plural functional relationships for the function block 84B, and the functional relationship of the aforesaid broken line So−1 shown in FIG. 19 among the plural functional relationships for the function block 85B, followed by outputting the corresponding select command signals Z5, Z6.

The function blocks 84B, 85B select the functional relationships commanded by the select command signals Z5, Z6. Thus, as with the above embodiment, it is possible to operate the arm cylinder 27 at a relatively higher drive speed and the bucket cylinder 28 at the relatively lower drive speed, thereby achieving the shaping work with good working efficiency.

The embodiment as mentioned above is arranged such that any one of the select command signals Za–Ze is output upon actuation of each selector switch element 130*a*–130*e* of the selector device 130. However, it can also be modified such that each selector switch element is made operable in multiple steps to command one of working modes with different speed ratios of the plural actuators 23– 28 within one type of the same working mode, and the function select command block 131 selects, in response to the select command signal issued, one of the different functional relationships for the relevant function block to change the setting of the associated distribution compensating valve. This permits to change the setting necessary for matching in combined operation dependent on the working situation, and to further improve operability and working efficiency.

ANOTHER EMBODIMENT OF CONTROL PRESSURE GENERATOR CIRCUIT

While the above embodiment employs the solenoid proportional pressure reducing valves 62*a*–62*f* as control pressure generator means for delivering the control pressure P c1–P c6 in the control pressure generator circuit in response to the electric signals a–f from the controller, the control pressure generator means can be implemented in an alternative manner. This embodiment suggests one possibility of such modification.

More specifically, in this embodiment, a control pressure generator circuit 140 comprises solenoid variable relief valves 141*a*–141*f* interposed between the pilot pump 63 and a tank and connected to one another in parallel, and restrictor valves 142*a*–142*f* interposed between the solenoid variable relief valves 141*a*–141*f* and the pilot pump 63, respectively. The solenoid variable relief valves 141*a*–141*f* are supplied with the electric signals a–f from the controller 61 as shown in FIG. 1, for example. When the solenoid variable relief valves 141*a*–141*f* are operated in accordance with the electric signals applied, pilot lines 143*a*–143*f* laid between the restrictor valves 142*a*–142*f* and the solenoid variable relief valves 141*a*–141*f* are communicated through pilot lines 51*a*–51*f* with the drive parts 35*c*–40*c* of the distribution compensating valves 35–40 as shown in FIG. 1, for example, respectively.

With the control pressure generator circuit 140 as well, the solenoid variable relief valves 141*a*–141*f* are individually operated in accordance with the electric signals a–f output from the controller to determine their degrees of restriction for properly changing the magnitude of pilot pressure delivered from the pilot pump 63, so that the control pressures P c1–P c6 with respective levels corresponding to the electric signals a–f are supplied through the pilot lines 143*a*–143*f* to the drive parts 35*c*–40*c* of the distribution compensating valves 35–40 as shown in FIG. 1, for example, respectively. Thus, there can be effected an equivalent function to that obtainable with the case of using the solenoid proportional pressure reducing valves as stated above.

FOURTH EMBODIMENT

A fourth embodiment of the present invention will be described below with reference to FIGS. 27–32.

Figure 27:
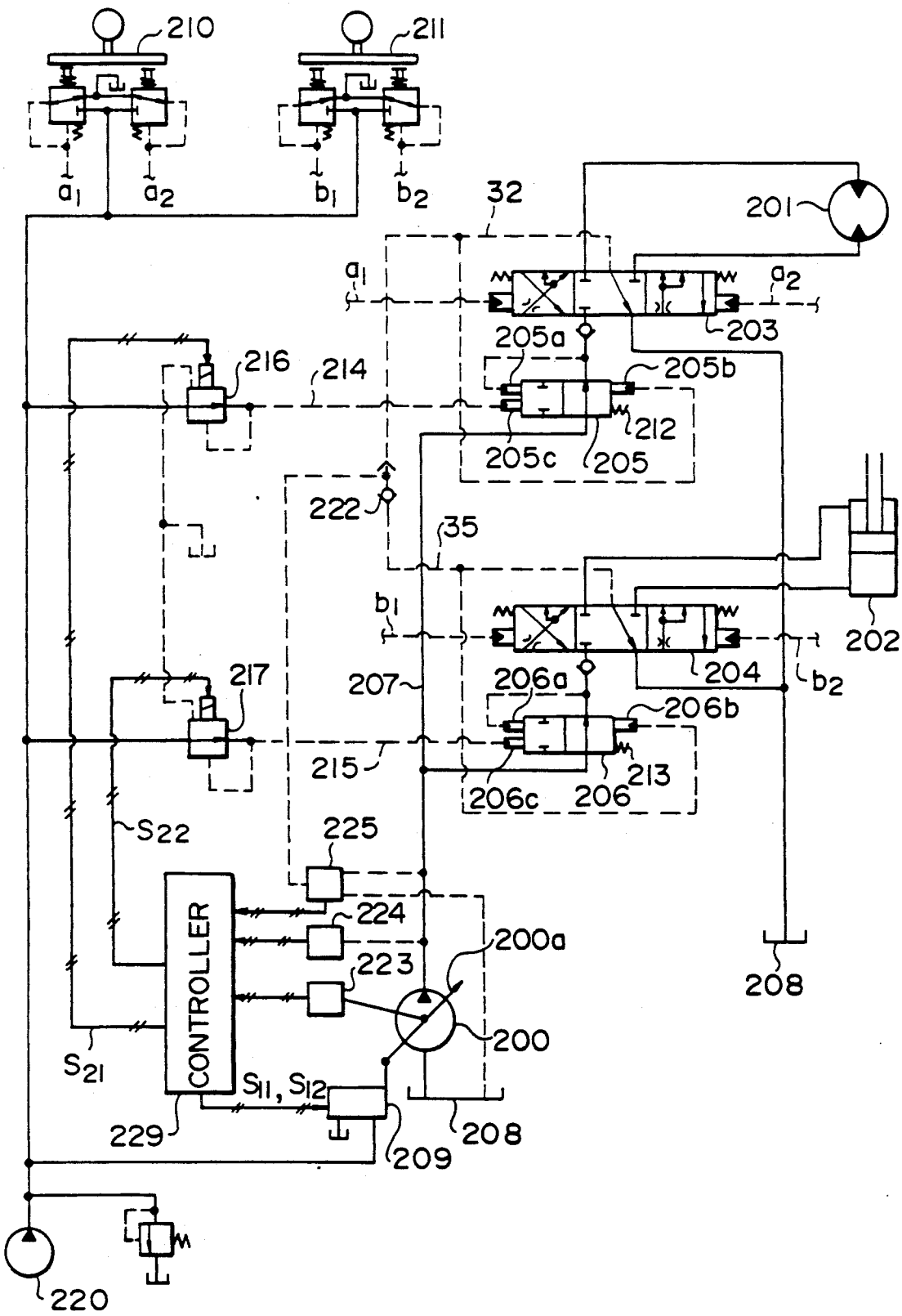
FIG. 27 is a circuit diagram showing a hydraulic drive system according to a fourth embodiment of the present invention.

Referring to FIG. 27, a hydraulic drive system of this embodiment, applied to a hydraulic excavator, comprises one hydraulic pump of variable displacement type driven by a prime mover (not shown), i.e., main pump 200, a plurality of actuators driven by a hydraulic fluid discharged from the main pump 200, i.e., a swing motor 201 and a boom cylinder 202, flow control valves for respectively controlling flows of the hydraulic fluid supplied to the plurality of actuators, i.e., a swing directional control valve 203 and a boom directional control valve 204, and pressure compensating valves, i.e., distribution compensating valves 205, 206, disposed upstream of the associated flow control valves for respectively controlling the differential pressures produced between inlets and outlets of the flow control valves, namely, differential pressures across the flow control valves.

A relief valve and an unload valve (both not shown) are connected to a discharge line 207 of the main pump 200. The relief valve serves to discharge the hydraulic fluid to a tank 208 when the hydraulic fluid from the main pump 200 reaches a setting pressure of the relief valve, to thereby prevent the pump discharge pressure from exceeding above that setting pressure. The unload valve serves to discharge the hydraulic fluid to the tank 208 when the hydraulic fluid from the main pump 200 reaches a sum pressure of a load pressure on the higher pressure side between the swing motor 201 and the boom cylinder 202 (hereinafter referred to as maximum load pressure P amax) and a setting pressure of the unload valve, to thereby prevent the pump discharge pressure from exceeding above that sum pressure.

The discharge rate of the main pump 200 is controlled by a discharge control device 209 such that the discharge pressure P s is held higher a fixed value ΔP LSO than the maximum load pressure P amax, for load-sensing control.

The flow control valves 203, 204 are valves of the pilot operated type operated by pilot valves 210, 211, respectively. Upon manual operation of control levers, the pilot valves 210, 211 produce a pilot pressure a1 or a2 and a pilot pressure b1 or b2 that are applied to the flow control valves 203, 204 so that the flow control valves 203, 204 are opened to the corresponding degrees of restriction, respectively.

The distribution compensating valves 205, 206 are valves of the same type as the distribution compensating valves in the first embodiment shown in FIG. 1. More specifically, the distribution compensating valves 205, 206 respectively have drive parts 205*a*, 205*b* and 206*a*, 206*b* supplied with outlet pressures and inlet pressures of the flow control valves 203, 204 for applying first control forces in the valve-closing direction in accordance with the differential pressures across the flow control valves 203, 204, springs 212, 213, and drive parts 205*c*, 206*c* supplied with control pressures delivered from solenoid proportional pressure reducing valves 216, 217 through pilot lines 214, 215. The springs 212, 213 and the drive parts 205*c*, 206*c* jointly create second control forces in the valve-opening direction that serve as respective target values of the differential pressures across the flow control valves 203, 204.

A pilot pressure from a common pilot pump 220 is supplied to the discharge control device 209, the pilot valves 210, 211 and the solenoid proportional pressure reducing valves 216, 217.

Connected to the flow control valves 203, 204 is a shuttle valve 222 for leading out the maximum load pressure, i.e., higher one between load pressures of the swing motor 201 and the boom cylinder 202.

The hydraulic drive system of this embodiment further comprises a displacement detector 223 for detecting a displacement corresponding to the displacement volume of the main pump 200, to thereby determine the discharge rate Q $\theta$ of the main pump 223, a discharge pressure detector 224 for detecting the discharge pressure P s of the main pump 200, a differential pressure detector 225 for receiving both the discharge pressure P s of the main pump 200 and the maximum load pressure P amax out of the swing motor 201 and the boom cylinder 202 to detect the differential pressure ΔP LS therebetween, and a controller 229 for receiving respective detected signals from the displacement detector 223, the discharge pressure detector 224 and the differential pressure detector 225 to output operation command signals S11, S12 and S21, S22 to the discharge control device 209 and the solenoid proportional pressure reducing valves 216, 217.

Figure 28:
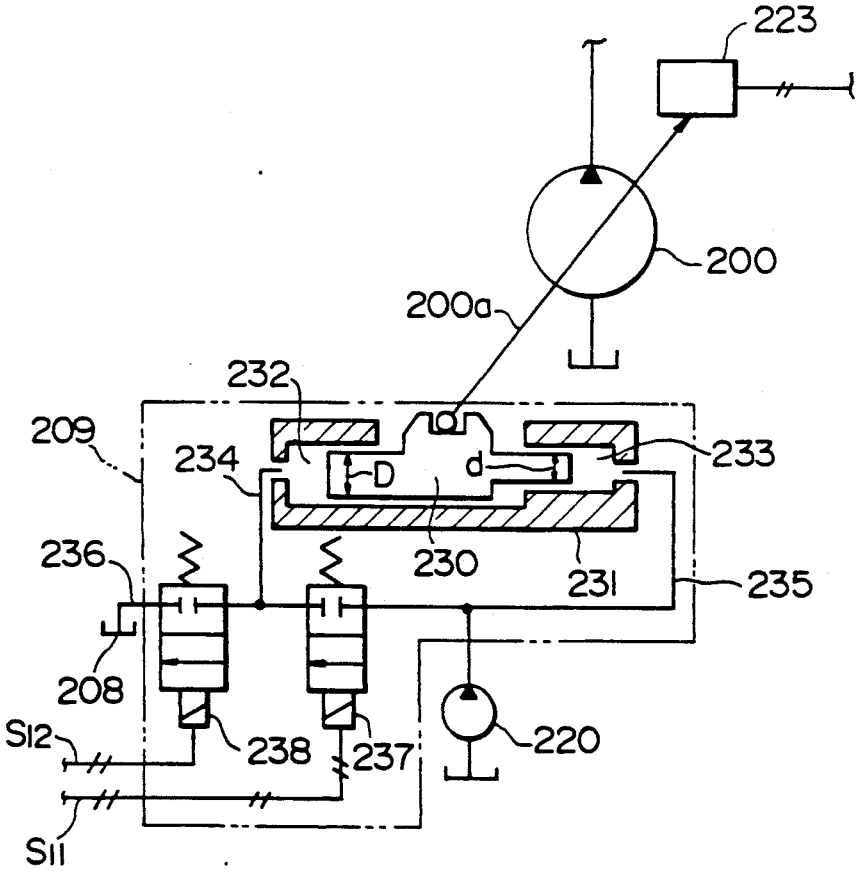
FIG. 28 is a schematic view showing the configuration of a discharge control device.

The discharge control device 209 has the construction as shown in FIG. 28. This embodiment shows an example in which the discharge control device 209 is constructed as a hydraulic drive system of the electro-hydraulic servo system.

More specifically, the discharge control device 209 has a servo piston 230 which drives a displacement volume varying mechanism 200*a* of the main pump 200, the servo piston 230 being accommodated in a servo cylinder 231. A cylinder chamber of the servo cylinder 231 is divided by a servo piston 230 into a left-hand chamber 232 and a right-hand chamber 233, and the left-hand chamber 232 is formed to have the cross-sectional area D larger than the cross-sectional area d of the right-hand chamber 233.

The left-hand chamber 232 of the servo cylinder 231 is communicated with the pilot pump 220 through lines 234, 235, and the right-hand chamber 233 of the servo cylinder 231 is communicated with the pilot pump 220 through the line 235, these lines 234, 235 being communicated with the tank 208 through a return line 236. A solenoid valve 237 is disposed in the line 235, and another solenoid valve 238 is disposed in the return line 236. These solenoid valves 237, 238 are normally-closed solenoid valves (which have a function to automatically return to a closed state when de-energized) and switched to their open positions when energized by the operation command signals S11, S12 applied thereto from the controller 229.

When the operation command signal S11 is input to the solenoid valve 237 for switching to its open position, the left-hand chamber 232 of the servo cylinder 231 is communicated with the pilot pump 220, so that the servo piston 230 is moved rightward as viewed in FIG. 28 due to the difference in area between the left-hand chamber 232 and the right-hand chamber 233. This makes larger an inclination angle, i.e., displacement volume, of the displacement volume varying mechanism 200*a* of the main pump 200, thereby increasing the discharge rate. When the operation command signal S11 is eliminated, the solenoid valve 237 is returned to its original closed position to cut off communication between the the left-hand chamber 232 and the right-hand chamber 233, so that the servo piston 230 is kept at that shifted position in a standstill state. As a result, the displacement volume of the main pump 200 is held constant and hence the discharge rate becomes also constant. On the other hand, when the operation command signal S12 is input to the solenoid valve 238 for switching to its open position, the left-hand chamber 232 is communicated with the tank 208 to reduce the pressure in the left-hand chamber 232, so that the servo piston 230 is moved leftward on the figure due to the pressure held in the right-hand chamber 233. As a result, the displacement volume of the main pump 200 is reduced, so does the discharge rate.

By on-off controlling the solenoid valves 237, 238 by the operation command signals S11, S12 to regulate the displacement volume of the main pump 200 in this fashion, the discharge rate of the main pump 200 is controlled such that it becomes equal to the target discharge rate Q o calculated by the controller 229.

As with the first embodiment, the controller 229 comprises an input unit, a storage unit, an arithmetic unit, and an output unit.

Figure 29:
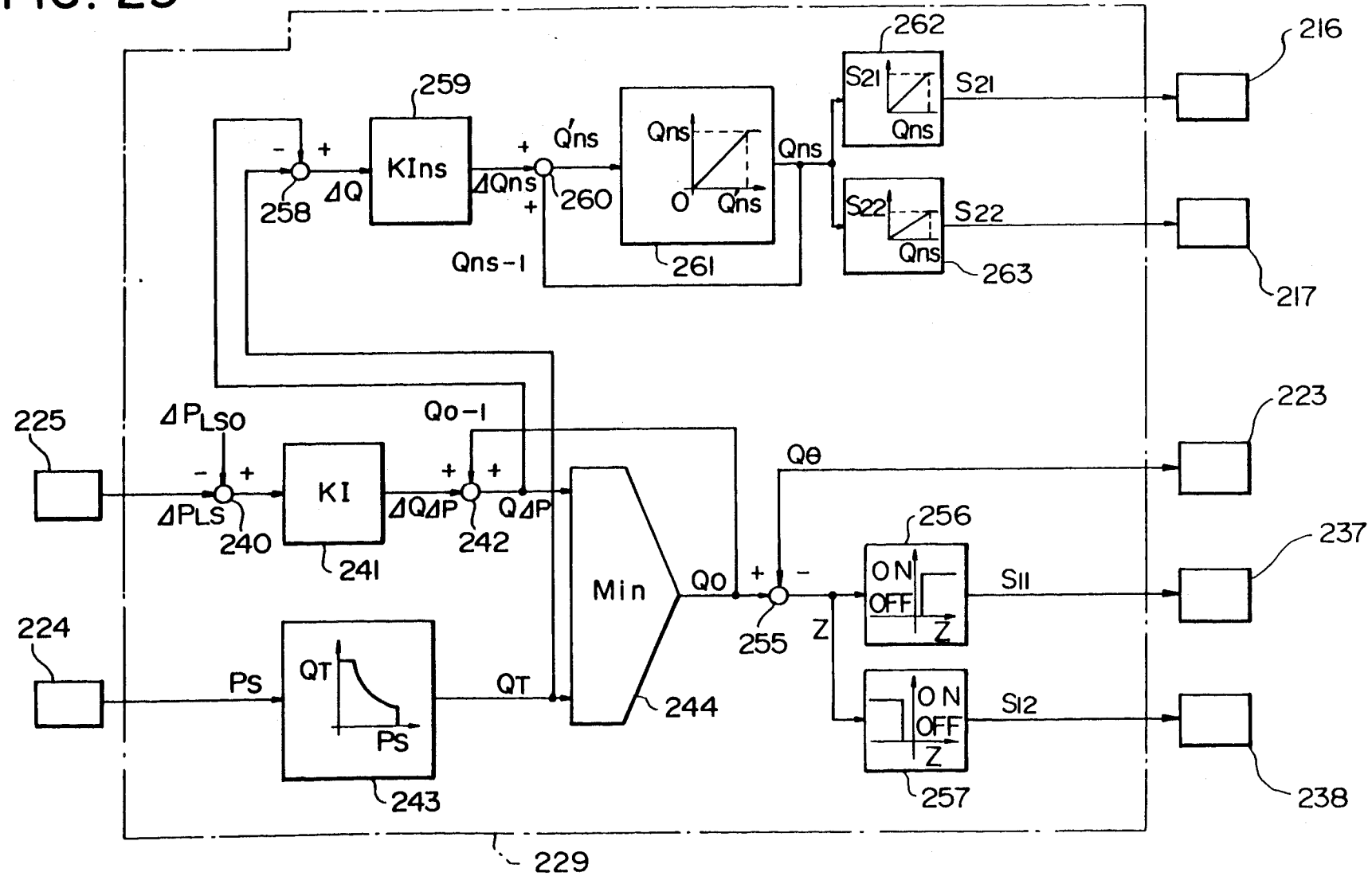
FIG. 29 is a functional block diagram showing the content of operation process performed by a controller.

The content of operation process performed by the arithmetic unit of the controller 229 is shown in a functional block view of FIG. 29.

In FIG. 29, blocks 240, 241 and 242 cooperatively function to derive a value of the differential pressure target discharge rate Q Δp from the differential pressure ΔP LS detected by the differential pressure detector 225, which value can hold that differential pressure equal to the load-sensing compensated differential pressure, i.e., target differential pressure ΔP LSO. In this embodiment, the differential pressure target discharge rate Q Δp is determined based on the following equation:

$$\begin{aligned} Q\Delta p &= g(\Delta P LS) = \Sigma KI(\Delta P LSO - \Delta P LS) \\ &= KI(\Delta P LSO - \Delta P LS) + Qo - 1 \\ &= \Delta Q \Delta p + Qo - 1 \end{aligned} \quad (1)$$

where

KI: integral gain

ΔP o: target differential pressure

Q o−1: discharge rate target value output in the preceding control cycle

ΔQ Δp: increment of the differential target discharge rate per one unit of control cycle time More specifically, this example is to determine the differential pressure target discharge rate Q Δp using the integral control technique applied to a deviation between the target differential value ΔP LSO and the actual difference pressure. The blocks 240 and 241 cooperatively calculate the term of KI (ΔP LSO-ΔP LS) from the differential pressure ΔP LS for determining an increment ΔQ Δp of the differential pressure target discharge rate per one unit of control cycle time. The block 242 derives the result of the above equation (1) by adding the ΔQ Δp and the discharge rate target value Q o−1 output in the preceding control cycle.

Although Q Δp has been determined using the integral control technique in the foregoing embodiment, it may be determined using the proportional control technique, for example, expressed by;

$$Q\,\Delta p = Kp(\Delta P\,LSO - \Delta P\,LS) \quad (2)$$

where Kp: proportional gain. Alternatively, the proportional plus integral control technique using the sum of the equations (1) and (2) may instead be employed.

Figure 30:
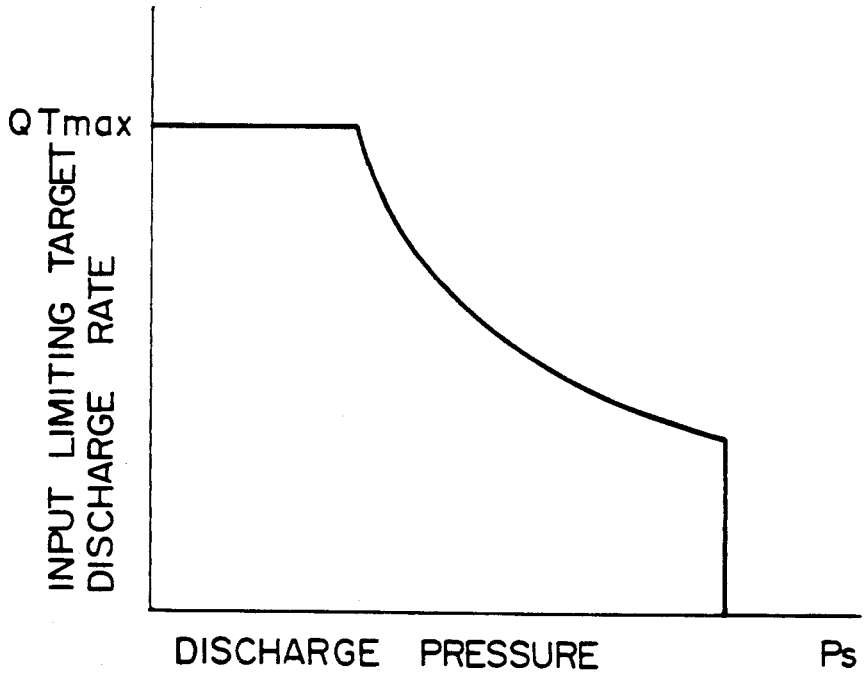
FIG. 30 is a graph showing the relationship between the discharge pressure and the input limiting target discharge rate.

A block 243 is a function block to determine a value of the input limiting target discharge Q T based on both the discharge pressure P s of the main pump 200 detected by the pressure detector 224 and an input torque limiting function f(P s) previously stored. FIG. 30 shows the input torque limiting function f(P s). Input torque of the main pump 200 is in proportion to the product of the displacement volume of the main pump 200, i.e., inclination amount of a swash plate, and the discharge pressure P s. Accordingly, the input torque limiting function f(P s) is given by a hyperbolic curve or an approximate hyperbolic curve. Thus, f(P s) is a function that can be expressed by the following equation:

$$Q\,T = \kappa(TP/P\,s) \quad (3)$$

where

T P: input limiting torque

κ: proportional constant

Based on both the above input torque limiting function f(P s) and the discharge pressure P s, the input limiting target discharge rate Q T can be determined.

Then, a minimum value select block 244 determines which one of the differential pressure target discharge rate Q Δp and the input limiting target discharge rate Q T is larger or smaller. The minimum value select block 244 selects, as the discharge rate target value Q o, Q Δp in the case of Q Δp≦Qt, and Q t in the case of Q Δp>Q t. In other words, the smaller one of the differential pressure target discharge rate Q Δp and the input limiting target discharge rate Q T is selected as the discharge rate target value Q o to prevent the discharge rate target value Q o from exceeding above the input limiting target discharge rate Q T determined by the input torque limiting function f(P s).

In blocks 255, 256 and 257, the operation command signal S11, S12 applied to the solenoid valves 237, 238 of the discharge control device 209 are created based on both the discharge rate target value Q o obtained by the block 244 and the discharge rate Q θ detected by the displacement detector 223.

Practically, the block 255 first calculates therein subtraction of Z=Q o−Q θ to determine a deviation Z between the discharge rate target value Q o and the discharge rate Q θ detected. Then, when the deviation Z exceeds a preset dead zone Δ, the blocks 256, 257 delivers the operation command signal S11 or S12 dependent on whether the deviation Z is positive or negative. More specifically, when the deviation Z is positive and exceeds above the dead zone Δ, the block 256 delivers the operation command signal S11 to turn ON the solenoid valve 237 of the discharge control device 209. This increases the inclination angle of the main pump 200, so that the discharge rate Q θ is controlled to be coincident with the discharge rate target value Q o, as stated above. When the deviation Z is negative and exceeds below the dead zone Δ, the block 257 delivers the operation command signal S12 to turn OFF the solenoid valve 237 and turn ON the solenoid valve 238. This decreases the inclination angle of the main pump 200, so that the detected discharge rate Q θ is controlled to be coincident with the discharge rate target value Q o.

By so controlling the inclination angle of the main pump 200, the discharge rate of the main pump 200 is controlled to become the differential pressure target discharge rate Q Δp when the differential pressure target discharge rate Q Δp is smaller than the input limiting target discharge rate Q T, whereby the differential pressure Q ΔLS between the discharge pressure of the main pump 200 and the maximum load pressure is held at the target differential pressure ΔP LSO. In short, the load-sensing control is effected to keep the target differential pressure ΔP LSO constant. On the other hand, when the differential pressure target discharge rate Q Δp becomes larger than the input limiting target discharge rate Q T, the input limiting target discharge rate Q T is selected as the discharge rate target value Q o, whereby the discharge rate is controlled not to exceed above the input limiting target discharge rate Q T. In short, the main pump 200 is subjected to the input limiting control.

Meanwhile, the deviation between the differential pressure target discharge rate Q Δp and the input limiting target discharge rate Q T is calculated to obtain a target discharge rate deviation ΔQ.

Then, blocks 259, 260 and 261 cooperatively calculate a basic value for total consumable flow modification control of the distribution compensating valves 205, 206 (see FIG. 27), i.e., basic modification value Q ns, from the target discharge rate deviation ΔQ obtained in the block 258. The total consumable flow modification control will be described later. In this embodiment, the basic modification value Q ns is calculated using the integral control technique based on the following equation:

$$\begin{aligned} Q\,ns &= h(\Delta\,Q) = \Sigma\,KIns \cdot \Delta\,Q \\ &= KIns \cdot \Delta\,Q + Q\,ns - 1 \\ &= \Delta\,Q\,ns + Q\,ns - 1 \end{aligned} \quad (4)$$

where

KIns: integral gain

Q ns−1: basic modification value output in the preceding control cycle

ΔQ ns: increment of basic modification value per one unit of control cycle time

Figure 31:
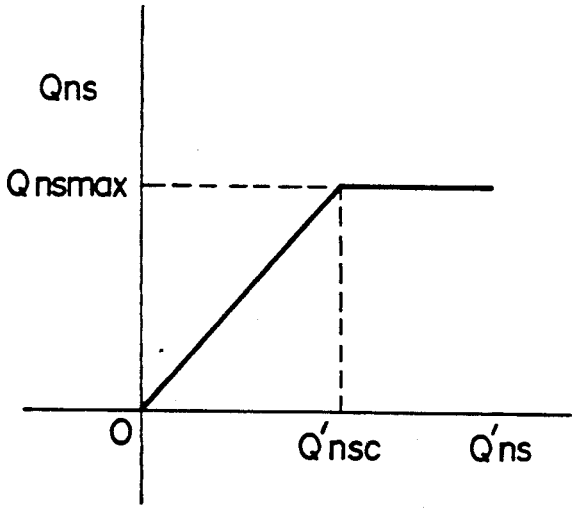
FIG. 31 is a graph showing a limiter function to determine a basic modification value Qns from an intermediate value Q'ns.

More specifically, in the block 259, the increment ΔQ ns of the basic modification value per one unit of control cycle time, i.e., KIns·ΔQ, is obtained from the target delivery amount deviation ΔQ derived in the block 258. This increment value is then added in an addition block 260 to the basic modification value Q ns−1 output in the preceding control cycle, to thereby determine an intermediate value Q 'ns. The block 261 having limiter function as shown in FIG. 31 decides the basic modification value Q ns as follows. The block 261 outputs Q ns= 0 if Q 'ns<0. If Q 'ns≧0, it outputs the basic modification value Qns which is increased in proportion to an increase of Q 'ns in the case of Q 'ns<Q 'nsc, and Q ns=Q nsmax in the case of Q 'ns≧Q 'nsc. Herein, Q nsmax and Q 'nsc are values determined by the maximum inclination angle of swash plate of the main pump 200, i.e., the maximum discharge rate thereof.

The basic modification value Q ns obtained in the block 261 is further altered by function blocks 262, 263 associated with the actuators 201, 202 to provide the operation command signals S21, S22 different from each other, respectively.

Figure 32:
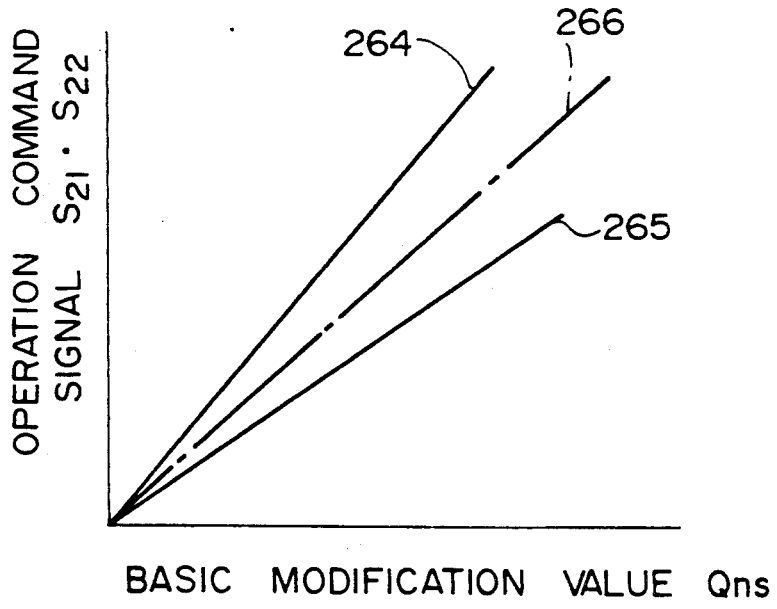
FIG. 32 is a graph showing the relationships between the basic modification value Qns and operation command signals S21, S22.

FIG. 32 shows the relationships between the basic modification value Q ns and the operation command signals S21, S22 that are stored stored in the function blocks 262, 263. In the figure, 264 designates a characteristic for the operation command signal S21, and 265 designates a characteristic for the operation command signal S22. Also, 266 designates a characteristic where the basic modification value Q ns is not changed. In other words, the operation command signal S21 is altered to be larger than the basic modification value Q ns, while the operation command signal S22 is altered to be smaller than the basic modification value Q ns.

The operation command signals S21, S22 obtained in the blocks 262, 263 are output to the solenoid proportional pressure reducing valves 216, 217 shown in FIG. 27, respectively. The solenoid proportional pressure reducing valves 216, 217 are driven in response to the signals S21, S22, so that the control pressures at corresponding levels are produced and then delivered to the drive parts 205c, 206c of the distribution compensating valves 205, 206. As a result, the above-mentioned second control forces applied to the distribution compensating valves 205, 206 in the valve-opening direction are modified to become smaller for the distribution compensating valve 205 than would be the case of outputting the basic modification value Q ns as a command signal, and to become larger for the distribution compensating valve 206. Thus, the distribution ratio between the distribution compensating valves 205, 206 is modified correspondingly.

Operation of this embodiment thus constructed will now be described.

For example, when the boom pilot valve 211 is finely operated to drive the flow control valve 204 for sole operation of the boom, the value of the differential pressure target discharge rate Q Δp calculated by the controller 229 is smaller than the value of the input limiting target discharge rate Q T because of the small demanded flow rate, whereby the differential pressure target discharge rate Q Δp is selected as the discharge rate target value Q o. Therefore, the differential pressure ΔP LS between the discharge pressure of the main pump 200 and the maximum load pressure is held at the target differential pressure ΔP LSO for the load-sensing control. On the other hand, the basic modification value Q ns is calculated as zero, and the second control forces produced by only the force of the springs 212, 213 are applied to the distribution compensating valves 205, 206, so that the boom cylinder 202 is supplied with the hydraulic fluid at the flow rate corresponding to an opening degree of the flow control valve 204.

When the pilot valves 210, 211 are simultaneously driven to perform combined operation of swing and boom-up, for example, the value of the differential pressure target discharge rate Q Δp calculated by the controller 229 is larger than the value of the input limiting target discharge rate Q T because of the large demanded flow rate and the higher load pressure of the swing motor 201, whereby the input limiting target discharge rate Q T is selected as the discharge rate target value Q o. As a result, the discharge rate of the main pump 200 is controlled not to exceed above the input limiting target discharge rate Q T. In short, the main pump 200 is subjected to the input limiting control. At the same time, the basic modification value Q ns is calculated. If this basic modification value Q ns is directly output as the operation command signal to the solenoid proportional pressure reducing valves 216, 217, the second control forces applied to the distribution compensating valves 205, 206 in the valve-opening direction are reduced at the same proportion, so do the target values of differential pressure across the flow control valves 203, 204. This reduces the flow rates supplied to the flow control valves 203, 204 at the same proportion, so that the total flow rate of the hydraulic fluid consumed by the actuators 201, 202 are reduced without changing the distribution ratio therebetween. Thus, it is possible to maintain the speed ratio of the actuators 201, 202 constant. In this specification, that control is referred to as total consumable flow modification control.

With this embodiment, when the total consumable flow modification control is effected, the basic modification value Q ns is further altered to provide the operation command signals S21, S22 which are then output to the solenoid proportional pressure reducing valves 216, 217. Therefore, the second control forces applied to the distribution compensating valves 205, 206 in the valve-opening direction becomes smaller for the distribution compensating valve 205 than would be the case of outputting the basic modification value Q ns as a command signal, and become larger for the distribution compensating valve 206. Correspondingly, the hydraulic fluid is distributed to the swing motor 201 at the smaller flow rate and to the boom cylinder 202 at the larger flow rate under the total consumable flow modification control. As a result, as with the first embodiment, it is possible to reliably perform the combined operation of swing and boom-up, and to achieve the combined operation at a higher boom-up speed while ensuring the relatively moderate swing operation. This enables an improvement in efficiency of the combined operation and more effective use of energy.

As described above, this embodiment can also offer the substantially same advantageous effect as that of the first embodiment during the combined operation of the swing and the boom.

FIFTH EMBODIMENT

A fifth embodiment of the present invention will be described below with reference to FIGS. 33–38. In these figures, the identical components to those shown in FIG. 27 are denoted by the same characters.

Figure 33:
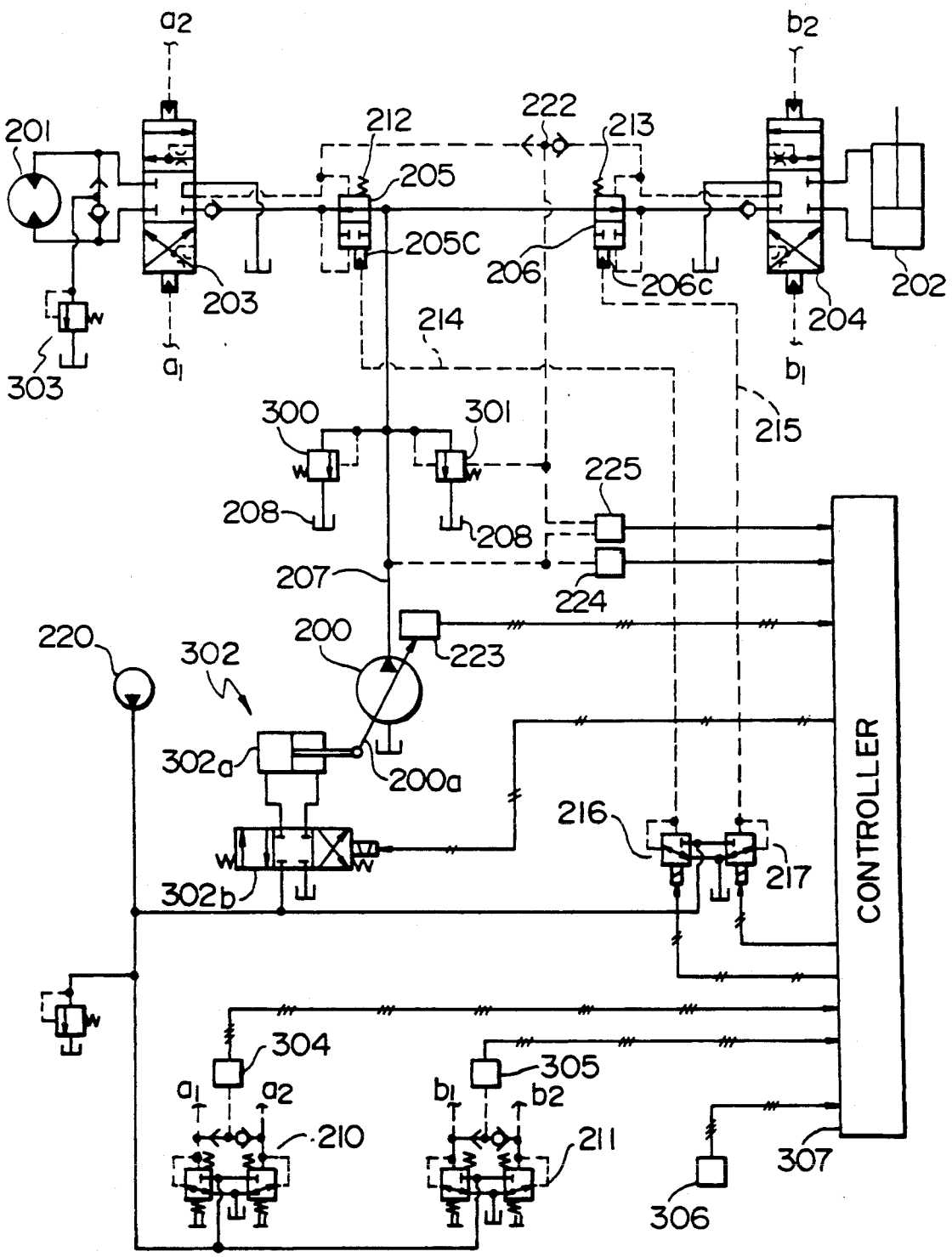
FIG. 33 is a circuit diagram of a hydraulic drive system according to a fifth embodiment of the present invention.

Referring to FIG. 33, a hydraulic drive system of this embodiment basically has the same construction as that of the fourth embodiment shown in FIG. 27. So, the part constructed in the same manner will not be described here. In a discharge line 207 of the main pump 200, there are connected a relief valve 300 which serves to discharge the hydraulic fluid to the tank when the hydraulic fluid from the main pump 200 reaches a setting pressure of the relief valve, to thereby prevent the pump discharge pressure from exceeding above the relief setting pressure, and an unload valve 301 which serves to discharge the hydraulic fluid to the tank when the hydraulic fluid from the main pump 200 reaches a sum pressure of a higher load pressure between the swing motor 201 and the boom cylinder 202 (hereinafter referred to as maximum load pressure P amax) and a setting pressure of the unload valve, to thereby prevent the pump discharge pressure from exceeding above that sum pressure.

The discharge rate of the main pump 200 is controlled by a discharge control device 302 which comprises a drive cylinder 302*a* for driving a swash plate 200*a* of the main pump 200 to increase or decrease the displacement volume, and a solenoid control valve 302*b* for controlling supply or discharge of the hydraulic fluid to or from the drive cylinder 302*a* to regulate a shift position of the drive cylinder. Denoted by 303 is a relief valve for setting a swing relief pressure of the swing motor 202.

The pilot valves 210, 211 are provided with pilot pressure detectors 304, 305 for detecting issuance of a pilot pressure a1 or a2 and a pilot pressure b1 or b2 from the pilot valves 210, 211, respectively. There is also provided a selector device 306 operable by an operator for selecting and setting a target value of the discharge pressure of the main pump 200 from the outside.

Detected signals from the displacement detector 223, the discharge pressure detector 224, the differential pressure detector 225, the pilot pressure detectors 304, 305 and the selector device 306 are input to a controller 307 which performs predetermined calculations and then outputs operation command signals S1 and S21, S22 to the solenoid control valve 302*b* of the discharge control device 302 and the drive parts 216*c*, 217*c* of the solenoid proportional pressure reducing valves 216, 217.

Figure 34:
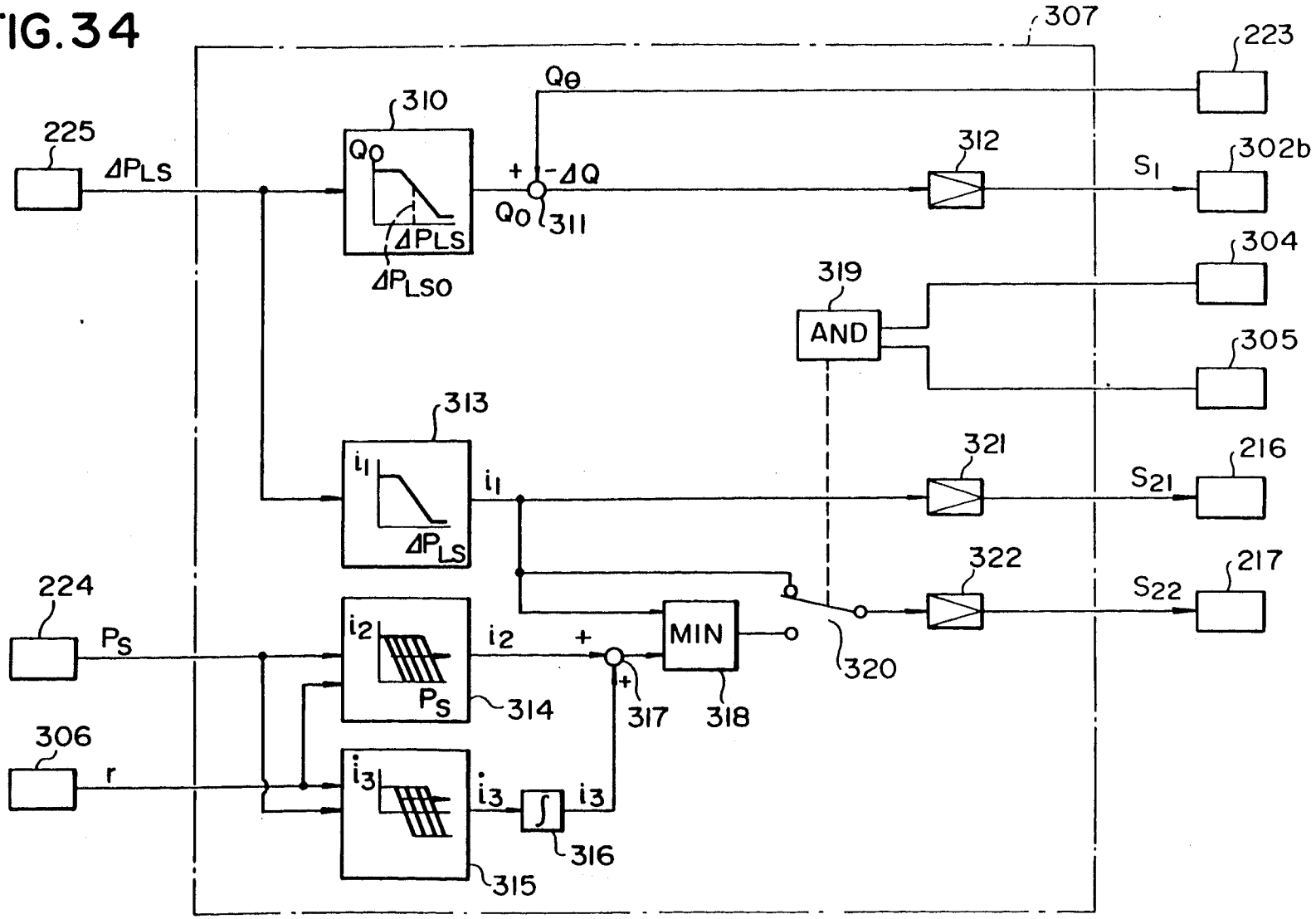
FIG. 34 is a functional block diagram showing the content of operation process performed by a controller.
Figure 35:
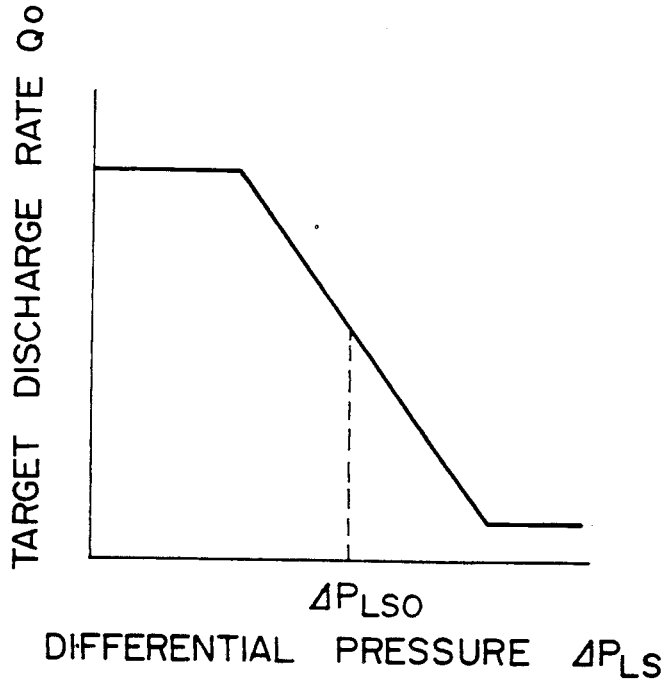
FIG. 35 is a graph showing the functional relationship between the differential pressure ΔP LS and the target discharge rate Qo.

The content of operation process performed by the controller 307 is shown in a functional block view of FIG. 34. In the figure, a block 310 is a function block to derive a value of the target discharge rate Q o of the main pump 200 from the differential pressure ΔP LS, which value can hold the differential pressure ΔP LS equal to the target differential pressure ΔP LSO. The functional relationship between the differential pressure ΔP LS and the target discharge rate Q o, stored in the function block 310, is shown in FIG. 35. With this functional relationship, as the differential pressure ΔP LS decreases, the target discharge rate Q o is increased. It is to be noted that the target discharge rate Q o may be calculated using the integral control technique in a like manner to the blocks 240–242 shown in FIG. 29 of the foregoing fourth embodiment.

The target discharge rate Q o is introduced to an addition block 311 to derive a deviation ΔQ from the discharge rate Q θ of the main pump 200 detected by the displacement detector 223. The deviation ΔQ is converted to the operation command signal S1 by an amplification and output block 312 and then output to the solenoid control valve 302*b*. The solenoid control valve 302*b* is thus driven to control the discharge rate of the main pump 200 such that the discharge pressure P s becomes higher than the fixed value ΔP LS than the maximum load pressure P amax out of the actuators 201, 202.

Figure 36:
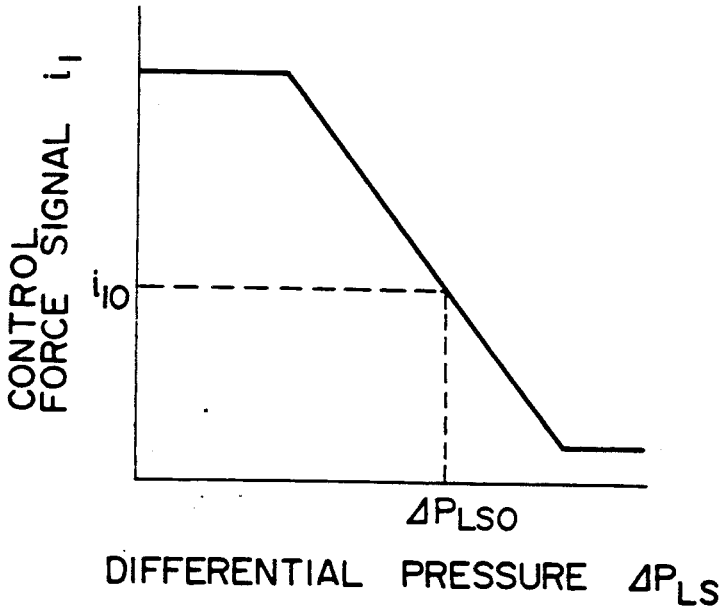
FIG. 36 is a graph showing the functional relationship between the differential pressure ΔP LS and a control force signal i1.

A block 313 is a function block to obtain a control force signal i1 from the differential pressure ΔP LS. The control force signal i1 serves to increase the control forces Nc1, Nc2 applied from the drive parts 205*c*, 206*c* of the distribution compensating valves 205, 206, when the differential pressure ΔP LS will not reach the target differential pressure ΔP LSO even in such a condition that the main pump 200 under load-sensing control by the discharge control device 302 is producing the maximum discharge rate. The increased control forces Nc1, Nc2 make smaller the second control forces f-Nc1, f-Nc2 in the valve-opening direction and hence target values of the differential pressures across the flow control valves 203, 204, respectively. Thus, although the flow rates of the hydraulic fluid supplied to the respective actuators 201, 202 are suppressed from increasing in their absolute levels, the total pump discharge rate can be allocated dependent on the ratio of opening degrees of the flow control valves 203, 204, i.e., ratio of demanded flow rates. The functional relationship between the differential pressure ΔP LS and the control force signal i1, stored in the function block 313, is shown in FIG. 36. This functional relationship is basically the same as that for swing shown in FIG. 4A of the first embodiment. It is to be noted that the control force signal i1 is used as a first command value of the control force Nc2 applied from the drive part 206*a* for the distribution compensating valve 206.

Figure 37:
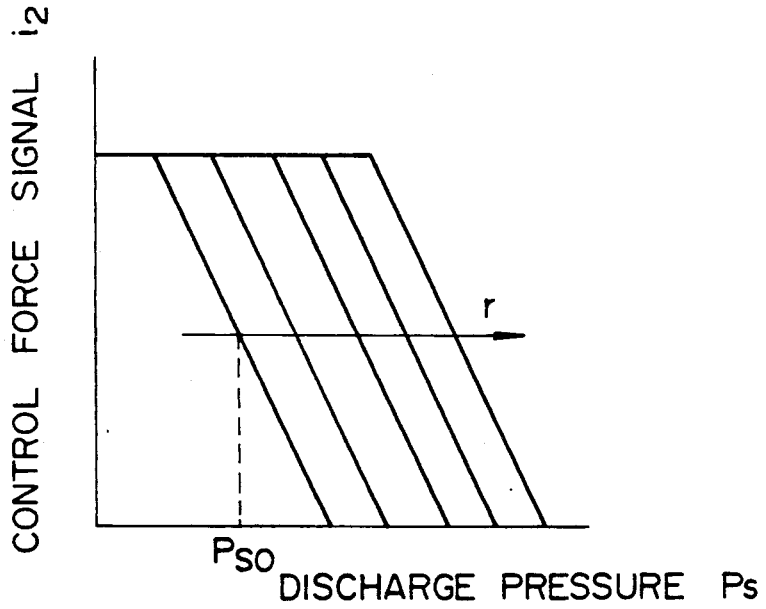
FIG. 37 is a graph showing the functional relationship between the discharge pressure P s, a control force signal i2 and a command signal r.

A block 314 is a function block to derive a value of a control force signal i2 using the proportional control technique from the discharge pressure P s of the main pump 200 detected by the discharge pressure detector 224, which value can hold the discharge pressure P s equal to the target discharge pressure P so. The control force signal i2 is used for providing a second command value of the control force Nc2. The function block 314 is arranged such that the target discharge pressure P so can be changed responsive to a command signal r from the selector device 306. The functional relationship between the discharge pressure P s, the control force signal i2 and the command signal r, stored in the function block 314, is shown in FIG. 37. Note that P so in FIG. 37 indicates the target discharge pressure based on the functional relationship to be set when the command signal r is at the minimum value.

Figure 38:
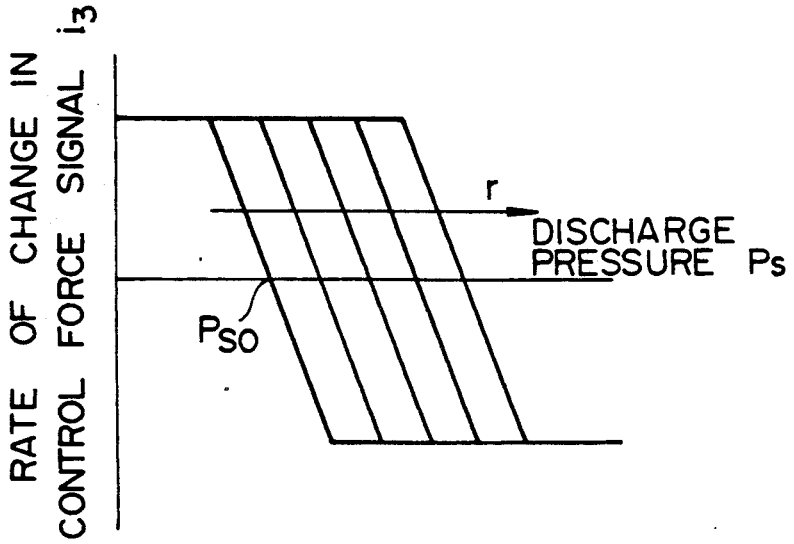
FIG. 38 is a graph showing the functional relationship between the discharge pressure P s, the rate of change i3 in the control force signal i3 and the command signal r.

Blocks 315, 316 function to cooperatively derive a value of a control force signal i3 using the integral control technique from the discharge pressure P s of the main pump 200 detected by the discharge pressure detector 224, which value can hold the discharge pressure P s equal to the target discharge pressure P so. The control force signal i3 is used for providing the second command value of the control force Nc2 in combination with the control force signal i2. The function block 315 derives the rate of change i3 in the control force signal i3 from the discharge pressure P s based on the functional relationship previously stored. The rate of change i3 is integrated by the block 316 to derive the control force signal i3. As with the block 314, the block 315 is arranged such that the target discharge pressure P so can be changed responsive to the command signal r from the selector device 306. The functional relationship between the discharge pressure P s, the rate of change i3 in the control force signal i3 and the command signal r, stored in the function block 315, is shown in FIG. 38. In FIG. 38, too, P so indicates the target discharge pressure based on the functional relationship to be set when the command signal r is at the minimum value.

The control force signal i2 obtained by the function block 314 and the control force signal i3 obtained by the integral block 316 are added to each other in an addition block 317 to provide the second command value of the control force Nc2 applied from the drive part 206*a* of the distribution compensating valve 206. The first command value i1 of the control force Nc2 obtained by the function block 313 and the second command value i3+i3 of the control force Nc2 obtained by the addition block 317 are introduced to a minimum value select block 318 to determine which one is larger or smaller. The smaller one is then selected by the block 318.

On the other hand, the detected signals from the pilot pressure detectors 304, 305 are input to an AND block 319, whereupon the AND block 319 outputs an ON signal to a switch block 320 in the presence of both the detected signals for the pilot pressure a1 or a2 and the pilot pressure b1 or b2, and an OFF signal to the switch block 320 in any other cases. The switch block 302 is held at an illustrated position when the AND block 319 outputs an OFF signal, for selecting the first command value i1 obtained by the function block 313. When the AND block 319 outputs an ON signal, the switch block 320 selects the minimum value selected by the block 318, i.e., the first command value i1 or the second command value i2+i3. Thus, when either one of the pilot valves 210, 211 is operated, i.e., during sole operation of the swing or the boom, the first command value i1 is selected. When both of the pilot valves 210, 211 are operated, i.e., during combined operation of the swing or the boom, the minimum value out of first command value i1 and the second command value i2+i3 is selected.

The control force signal i1 obtained by the function block 313 as a command value of the control force Nc1 for the distribution compensating valve 205 is converted to the operation command signal S21 through an amplification block 321 and then output to the solenoid proportional pressure reducing valve 216. The first command value i1 or the second command value i2+i3 selected by the switch block 320 is output, as the operation command signal S22, to the solenoid proportional pressure reducing valve 217 through an amplification block 322.

Operation of this embodiment thus constructed will now be described.

For example, when the boom pilot valve 211 is operated to drive the flow control valve 204 for sole operation of the boom, the differential pressure ΔP LS between the discharge pressure P s of the main pump 200 and the load pressure of the boom cylinder 202 is detected by the differential pressure detector 225, and the corresponding target discharge rate Q o is calculated by the function block 310 in the controller 307. Thus, as stated above, the operation command signal S1 is output to the solenoid control valve 302*b* of the discharge control device 302, for controlling the discharge rate such that the differential pressure ΔP LS becomes coincident with the target differential pressure ΔP LSO.

At the same time, in the block 313, the control force signal corresponding to the differential pressure ΔP LS is derived as the first command value of the control force Nc2 for the distribution compensating valve 206. Also, since only the pilot valve 211 is operated and the AND block 319 outputs an OFF signal, the first command signal i1 is selected in the switch block 320 and then output, as the operation control signal S22, to the solenoid proportional pressure reducing valve 217. Therefore, the control force Nc2 corresponding to the control force signal i1 acts on the distribution compensating valve 206 against the force f of the spring 213, so that the second control force f-i1 is applied to the distribution compensating valve 206 in the valve opening direction. Here, because the control force signal i1 produced upon the differential pressure ΔP LS being at the target differential pressure ΔP LSO, i.e., i1o, is set such that the corresponding control force Nc2 coincides with fo which has been explained by referring to FIG. 4A of the first embodiment, causing the distribution compensating valve 206 to hold the differential pressure across the flow control valve 204 at a certain prescribed value, the hydraulic fluid is supplied to the boom cylinder 202 at the flow rate corresponding to an opening degree of the flow control valve 204. In addition, at the same time, the operation command signal S21 corresponding to the control force signal i1 is output to the solenoid proportional pressure reducing valve 216, so that the distribution compensating valve 205 is operated to hold a certain prescribed differential pressure in a like manner.

Also, during sole operation of swing with the swing motor 201 driven, the distribution compensating valves 205, 206 are operated substantially in the same manner as the above case of sole operation of the boom.

When the pilot valves 210, 211 are simultaneously driven to perform combined operation of swing and boom-up, an operator first operates the selector device 306 to output the corresponding command signal r for adjusting characteristics of the function blocks 314, 315 in the controller 307. In other words, the target discharge pressure P so of the main pump 200 is set to a value suitable for the combined operation of swing and boom-up. Practically, since the swing driven by the swing motor 201 is an inertial load during that combined operation, the swing motor 201 is an actuator on the higher load pressure side, and the load pressure of the swing motor 201 usually increases up to the relief pressure set by the relief valve 303. For the reason, the target discharge pressure P so is set such that it becomes lower than a sum pressure of the relief pressure of the swing motor 201 and the load-sensing compensated differential pressure ΔP LSO, but higher than a sum pressure of the load pressure of the boom cylinder 202 and the target differential pressure ΔP LSO.

Then, the pilot valves 210, 211 are operated to open the flow control valves 203, 204 for starting the combined operation of swing and boom-up. At this time, the discharge pressure P s of the main pump 200 is increased under the load-sensing control by the discharge control device 302, and the discharge pressure P s is forced to going to increase above the target discharge pressure P so in the control course. In response, the function block 314 derives the relatively small control force signal i2 corresponding to the current discharge pressure P s. Simultaneously, the function block 315 and the integral block 316 also derive the relatively small control force signal i3 corresponding to the current discharge pressure, followed by deriving the relatively small sum value i2+i3 in the addition block 317.

On the other hand, since the main pump 200 is under the load-sensing control at the time, the differential pressure ΔP LSO is held in the vicinity of the target differential pressure ΔP LSO, and the function block 313 in the controller 307 derives the control force signal i1 corresponding to the target differential pressure ΔP LSO.

Here, the functional relationship of the block 313 and the functional relationships of the blocks 314, 315 are set in mutual relation such that the sum value i2+i3 as resulted when the discharge pressure P s remains in the vicinity of the target discharge pressure ΔP so, becomes nearly equal to the control force signal i1 as resulted when the differential pressure ΔP LS remains in the vicinity of the target differential pressure ΔP LSO. Therefore, the sum value i2+i3 as resulted when the discharge pressure P s is going to exceed above the target discharge pressure P so, becomes smaller than the control force signal i1 as resulted when the differential pressure ΔP LS remains in the vicinity of the target differential pressure ΔP LSO, i.e., i1>i2+i3. Thus, the minimum value select block 318 selects the sum value i2+i3, i.e., the second command value.

Because both of the pilot valves 210, 211 are now operated, the AND block 319 outputs an ON signal and the switch block 320 is shifted to such a position as to select an output of the minimum value block 318. Accordingly, the switch block 320 selects the second command i2+i3 which is output, as the operation command signal S22, to the solenoid proportional pressure reducing valve 216. Also, the operation command signal S21 corresponding to the control force signal i1 is output to the solenoid proportional pressure reducing valve 216.

As a result of issuance of such the operation command signals S21, S22, f-i1 is applied to the distribution compensating valve 205 as the second control force Nc1 in the valve-opening direction, and f-(i2+i3) is applied to the distribution compensating valve 206 as the second control force Nc2 in the valve-opening direction. Here, there exists the relationship of f-(i2+i3)>f-i1. Therefore, at the beginning of the combined operation of swing and boom-up, the distribution compensating valve 206 associated with the boom cylinder 202 on the lower load pressure side is less restricted, so that the boom cylinder 202 is supplied with the hydraulic fluid at the flow rate larger than would be the case of applying the normal control force Nc2=i1 thereto. This suppresses an increase in the discharge pressure of the main pump 200, and stabilizes the discharge pressure in the vicinity of the target discharge pressure P so. Further, since the flow rate of the hydraulic fluid supplied to the boom cylinder 202 is increased and the discharge pressure is retained from exceeding above P so, the swing motor 201 is supplied with the hydraulic fluid at the flow rate smaller than would be the case of the swing load pressure of increasing up to the relief pressure. Thus, the swing motor 201 is driven at a moderate speed without releasing the hydraulic fluid. This enables to perform the combined operation of swing and boom-up at a higher boom-up speed and a relatively moderate swing speed, and to reduce energy loss during acceleration of swing.

During the combined operation of swing and boom-up, as described above, when swing is accelerated and reaches a steady speed, the load pressure of the swing motor 201 is reduced, and the discharge pressure of the main pump 200 under the load-sensing control is reduced below the target discharge rate P so correspondingly. Upon the discharge rate exceeding below the target discharge rate P so, the values of both the control force signal i2 obtained by the function block 314 and the control signal i3 obtained by the blocks 315, 316 are increased, so does the second command value i2+i3 obtained by the addition block 318. This results in i1<i-2<i3 due to the mutual relation between the functional relationship of the block 313 and the functional relationships of the blocks 314, 315. Therefore, the minimum value select block 318 selects the first command value i1, and the operation command signal S22 corresponding to the first command value i1 is output to the solenoid proportional pressure reducing valve 217.

Accordingly, the distribution compensating valve 206 is given with f-i1 as usual, as the second control force in the valve-opening direction. Simultaneously, the distribution compensating valve 205 is given with the same second control force f-i1 in the valve-opening direction. Thus, the differential pressures across the flow control valves 203, 204 are controlled to become equal to each other, so that the swing motor 201 and the boom cylinder 202 are supplied with the flow rates as demanded by the pilot valves 210, 211. In other words, the flow rate of the hydraulic fluid supplied to the swing motor 201 is increased to provide a desired swing speed. This enables to achieve the combined operation in which a swing speed is relatively high as intended by the operator, after acceleration of swing.

With this embodiment, as mentioned above, since the flow rate of the hydraulic fluid supplied to the boom cylinder 202, as an actuator for driving a load of small inertia, is controlled to optionally regulate the discharge pressure of the main pump 200 for controlling the drive pressure of the swing motor 201, as an actuator for driving a load of large inertia, it is possible to perform the combined operation of swing and boom-up at a higher boom-up speed and a relatively moderate swing speed for improvement in operability, and to reduce a degree of energy loss during the combined operation for economical operation, as with the first embodiment.

Moreover, with this embodiment, since the target discharge pressure P so of the main pump 200 can be changed by properly varying characteristics of the function blocks 314, 315 upon operation of the selector device 306, it is also possible to set the setting necessary for matching between swing and boom-up as demanded.

It should be understood that although the above embodiment employs both the function block 314 based on the proportional control technique and the function blocks 315, 316 based on the integral control technique, as means for deriving the control force signals in the controller 307 to hold the discharge pressure P s at the target discharge pressure P so, with the aim of ensuring responsity and safety of the control concurrently, the control force signals may be obtained using either one technique.

SIXTH EMBODIMENT

A sixth embodiment of the present invention will be described below with reference to FIGS. 39–42. In these figures, the identical components to those employed in the fourth embodiment shown in FIG. 27 and the fifth embodiment shown in FIG. 33 are denoted by the same characters.

Figure 39:
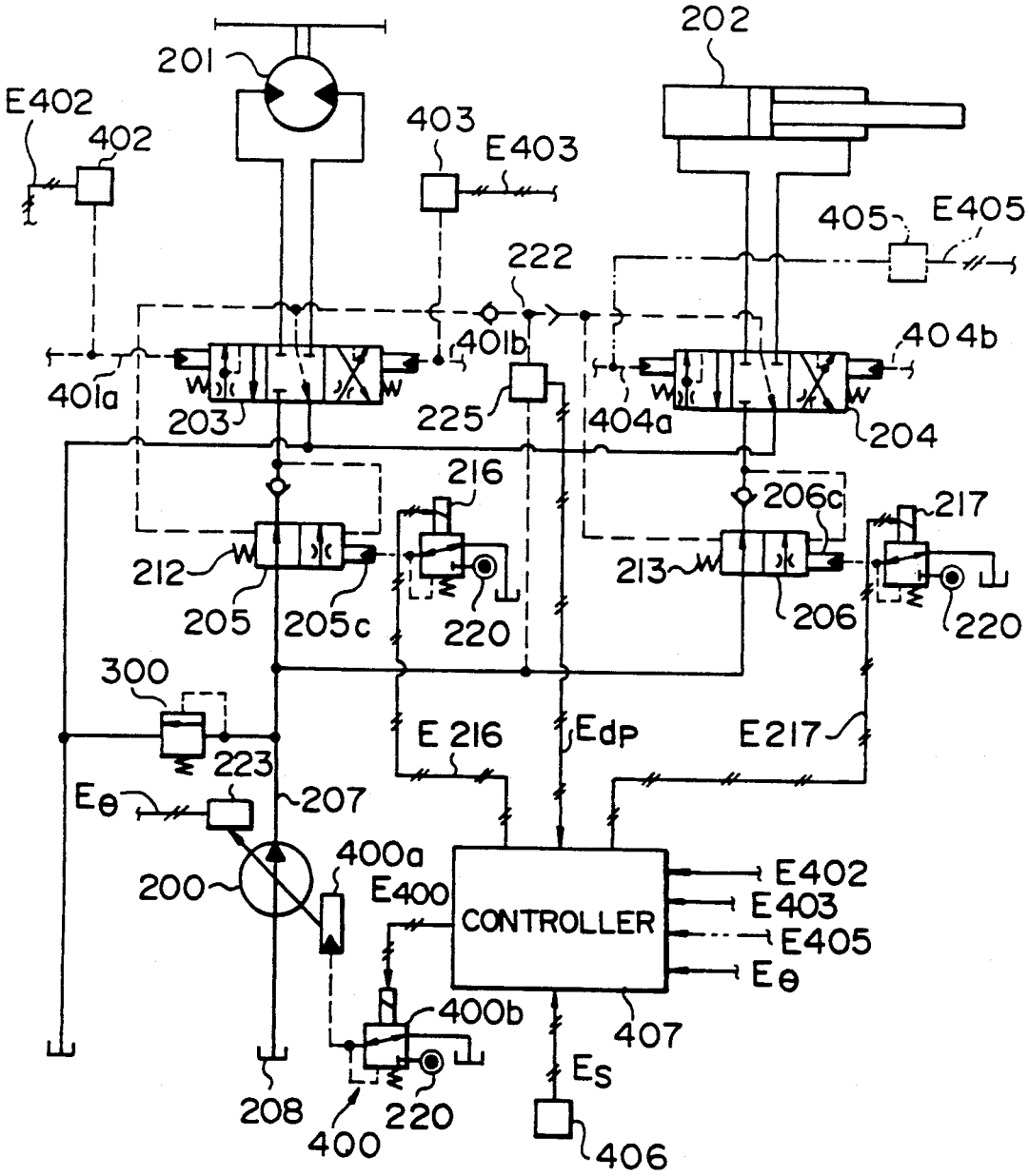
FIG. 39 is a circuit diagram of a hydraulic drive system according to a sixth embodiment of the present invention.

Referring to FIG. 39, a hydraulic drive system of this embodiment basically has the same construction as that of the fourth embodiment shown in FIG. 27. So, the same part will not be described here. However, an output signal from the differential pressure detector 225 for detecting the differential pressure ΔP LS between the discharge pressure P s of the main pump 200 and the maximum load pressure P amax is denoted by E dp. Also, as with the fifth embodiment shown in FIG. 33, a discharge line 207 of the main pump 200 includes a relief valve 300 which serves to discharge the hydraulic fluid to the tank when the hydraulic fluid from the main pump 200 reaches a setting pressure of the relief valve, to thereby prevent the pump discharge pressure from exceeding above the relief setting pressure, and an unload valve, not shown, which serves to discharge the hydraulic fluid to the tank when the hydraulic fluid from the main pump 200 reaches a sum pressure of a higher load pressure between the swing motor 201 and the boom cylinder 202 (hereinafter referred to as maximum load pressure P amax) and a setting pressure of the unload valve, to thereby prevent the pump discharge pressure from exceeding above that sum pressure.

Further, the main pump 200 is provided with the displacement detector 223 for detecting the displacement volume of the main pump, which detector 223 outputs a signal Eθ corresponding to the displacement volume detected. The discharge rate of the main pump 200 is controlled by a discharge control device 400 of the load-sensing control type which corresponds to the discharge control device 302 of the fifth embodiment. The discharge control device 400 of this embodiment comprises a inclination drive unit 400*a* for driving the swash plate 200*a* of the main pump 200 to increase or decrease the displacement volume, and a solenoid proportional pressure reducing valve 400*b* for outputting a control pressure to the inclination drive unit 400*a* to adjust its displacement.

In pilot lines 401*a*, 401*b* for introducing pilot pressures to the drive parts of the flow control valve 203 from swing pilot valves (not shown), there are disposed operation detectors 402, 403 for detecting the pilot pressures being applied and then outputting signals E 402, E 403, respectively. The system also includes a selector device 406 operable by an operator for selecting and setting a flow increasing speed of the hydraulic fluid supplied to the swing motor 201. The selector device 406 outputs a signal E s dependent on the current setting.

The signal E dp from the differential pressure detector 225, the signals E 402, E 403 from the operation detectors 402, 403, the signal E s from the selector device 406, and the signal Eθ from the displacement detector 223 are input to a controller 407 which performs predetermined calculations and then outputs operation command signals E 216, E 217 to the solenoid proportional pressure reducing valves 216, 217 and an operation command signal E 400 to the solenoid proportional pressure reducing valve 400*b* of the discharge control device 400.

Figure 40:
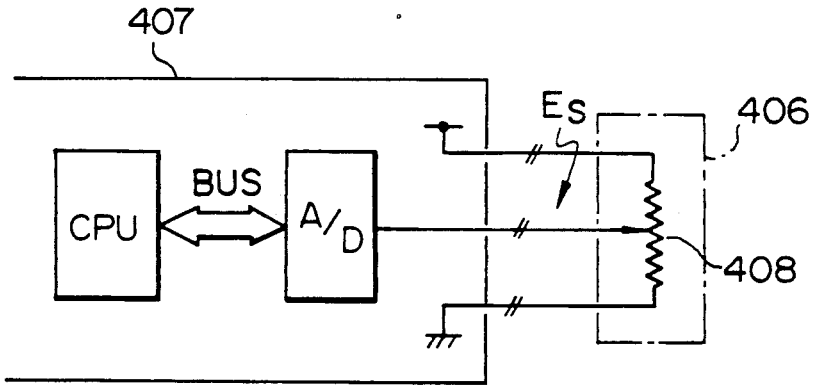
FIG. 40 is a view showing the configuration of a select command device.
Figure 41:
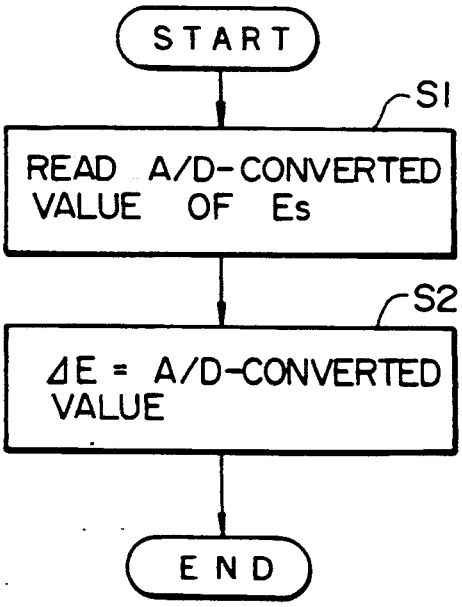
FIG. 41 is a flowchart showing the procedure for determining the amount of change ΔE dependent on operation of the select command device.

The selector device 406 of this embodiment comprises, as shown in FIG. 40, a voltage setting unit inclusive of a variable resistor 408 which has a movable contact operable by an operator in its position for setting a corresponding level of voltage. This voltage value is taken, as an signal E s, into the controller 407 where the signal E s is subjected to A/D conversion and then sent to a CPU. As shown in a flowchart of FIG. 41, the CPU reads an A/D-converted value of the signal E s in step S1, and makes a replacement of ΔE=A/D-converted value in step S2 for deriving the change amount ΔE per one cycle of the operation command signal E 216 sent to the solenoid proportional pressure reducing valve 216. The change amount ΔE is employed for deriving the operation command signal E 216 in the controller 407.

Figure 42:
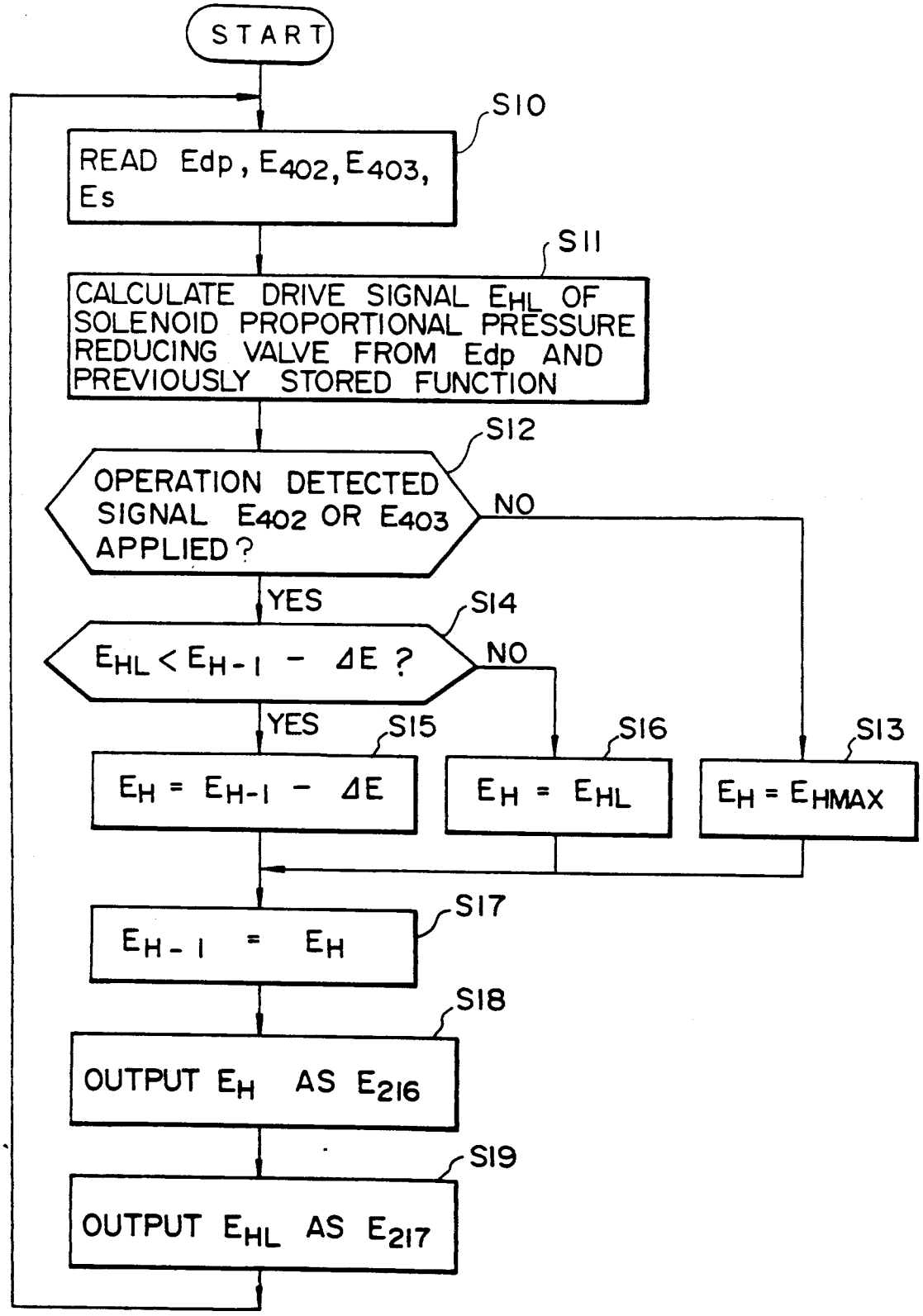
FIG. 42 is a flowchart showing the content of operation process performed by a controller.

The content of operation process performed by the controller 407 is shown in a flowchart of FIG. 42. The flowchart shows the operation sequence for deriving the operation command signals E 216, E 217 sent to the solenoid proportional pressure reducing valves 216, 217. The operation command signal E 400 sent to the solenoid proportional pressure reducing valve 400*b* of the discharge control device is obtained substantially in the same manner as the operation command signal S1 in the fifth embodiment shown in FIG. 34. So, the description thereof will be omitted here.

Figure 43:
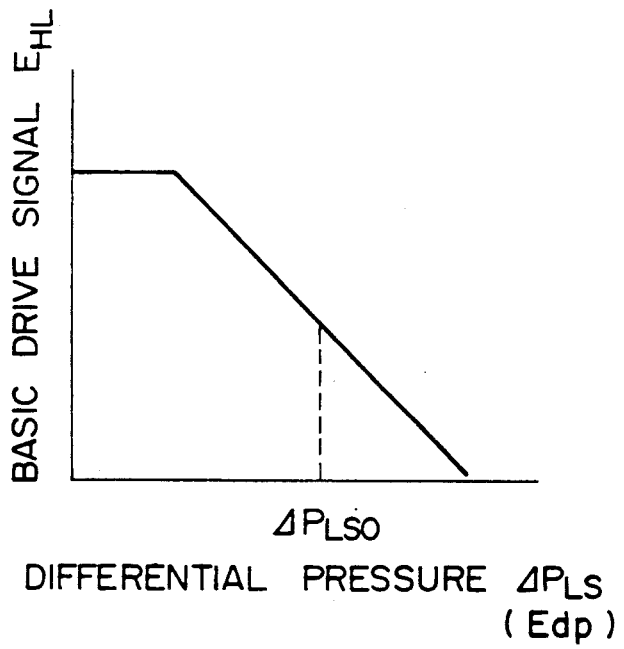
FIG. 43 is a graph showing the functional relationship between the differential pressure ΔPLS and a basic drive force E HL.

First, step S10 reads the signals E dp, E 402, E 403 and E s. Step S11 then calculates a basic drive signal E HL for the solenoid proportional pressure reducing valves 216, 217 based on both the differential pressure signal E dp and the functional relationship previously stored. The basic drive signal E HL serves to increase the control forces Nc1, Nc2 applied from the drive parts 205*c*, 206*c* of the distribution compensating valves 205, 206, when the differential pressure ΔP LS will not reach the target differential pressure ΔP LS0 even in such a condition that the main pump 200 under load-sensing control by the discharge control device 400 is producing the maximum discharge rate. The increased control forces Nc1, Nc2 make smaller the second control forces f-Nc1, f-Nc2 in the valve-opening direction and hence target values of the differential pressures across the flow control valves 203, 204, respectively. Thus, although the flow rates of the hydraulic fluid supplied to the respective actuators 201, 202 are suppressed from increasing in their absolute levels, the total pump discharge rate can be allocated dependent on the ratio of opening degrees of the flow control valves 203, 204, i.e., ratio of demanded flow rates. The functional relationship between the differential pressure ΔP LS for deriving the basic drive signal E HL and the basic drive signal E HL is shown in FIG. 43. This functional relationship is substantially the same as that between the differential pressure ΔP LS and the control force signal i1 shown in FIG. 36 above.

Next, step 12 determines whether or not the operation command signal E 402 or E 403 is applied. If not, the control goes to step S13 where the drive signal E H for the solenoid proportional pressure reducing valves 216 is replaced as E H=E HMAX. Here, E HMAX is a maximum value of the drive signal E H. At this time, the control force Nc1 of the drive part 205*c* is maximized to hold the distribution compensating valve 205 at its fully closed position against the force f of the spring 212. If the operation detected signal E 402 or E 403 is applied, the control goes to step S14 to determine whether E HL<E H−1−ΔE or not. In other words, it is determined whether the drive signal E HL is smaller or not than the value resulted by subtracting the change amount ΔE set by the selector device 406 from the drive signal E H−1 for the solenoid proportional pressure reducing valves 216 obtained in the preceding control cycle. Now, if E HL is determined to be smaller than E H−1−ΔE, the control goes to step S15 for replacement of E H=E H−1−ΔE. If E HL is determined to be not smaller than E H−1−ΔE, the control goes to step S16 for replacement of E H=E HL. In other words, the drive signal E H is set such that the maximum change speed of the drive signal E H coincides with ΔE.

Subsequently, step S17 makes a replacement of E H−1=E H step S18 outputs the drive signal E H as the operation command signal E 216, and step S19 outputs the basic drive signal E HL as the operation command signal E 217. Thus, the control force Nc1 applied from the drive part 205*c* of the distribution compensating valve 205 is controlled to become coincident with the basic drive signal E HL, and the change speed thereof is limited below ΔE. The control force Nc2 applied from the drive part 206*c* of the distribution compensating valve 206 is controlled to become coincident with the basic drive signal E HL as before.

Operation of this embodiment thus constructed will now be described.

To begin with, in a non-operative condition where neither flow control valves are operated for driving the actuators, the controller 407 makes a decision of NO in step S12 in the flowchart shown in FIG. 42 because of the absence of the operation detected signal E 402 or E 403. In step S13, the drive signal E H for the solenoid proportional pressure reducing valves 216 is set to the maximum value E HMAX. Thus, the distribution compensating valve 205 is held at its fully closed position. On the other hand, the basic drive signal E HL is set, as the operation command signal E 217, for the solenoid proportional pressure reducing valves 217. But, since the unload valve (not shown) secures the discharge pressure P s of the main pump 200 corresponding to the unload setting pressure (>ΔP LS0), the relatively small basic drive signal E HL is obtained in step S11 from the relationship shown in FIG. 43, so that the distribution compensating valve 206 is held at its fully open position with the force f of the spring 213.

When the boom pilot valve (not shown) is operated to drive the flow control valve 204 for sole operation of the boom, the differential pressure ΔP LS between the discharge pressure P s of the main pump 200 and the load pressure of the boom cylinder 202 is detected by a differential pressure detector 225. The controller 407 calculates a value of the operation command signal E 400 to keep the differential pressure ΔP LS constant, and the discharge control device 400 controls the discharge rate of the main pump 200 dependent on the operation command signal E 400.

In parallel, the controller 407 also calculates values of the operation command signals E 216, E 217 for the solenoid proportional pressure reducing valves 216, 217. In this case, since the swing flow control valve 203 is not driven, the operation detected signal E 402 or E 403 is not applied, whereby the drive signal E H for the solenoid proportional pressure reducing valve 216 is set to the maximum value E HMAX and the distribution compensating valve 205 is hence held at its fully closed position, as with the foregoing non-operative condition. On the other hand, for the boom distribution compensating valve 206, step S11 calculates a value of the basic drive signal E HL corresponding to the differential pressure ΔP LS in the vicinity of the target differential pressure ΔP LS0 from the relationship shown in FIG. 43. The calculated basic drive signal E HL is output, as the operation command signal E 217, to the solenoid proportional pressure reducing valve 217. Here, the functional relationship of FIG. 43 is substantially the same as that shown in FIG. 36. Accordingly, the distribution compensating valve 206 is held at its fully open position with the second control force f-Nc2 acting against the first control force in the valve-closing direction based on the differential pressure across the flow control valve 204, so that the boom cylinder 202 is supplied with the hydraulic fluid at the flow rate corresponding to an opening degree of the flow control valve 204.

When the swing motor 207 is solely operated, or when the flow control valves 203, 204 are simultaneously driven to perform combined operation of swing and boom-up, for example, an operator first operates the selector device 406 to output the flow increasing speed signal E s for setting the change amount ΔE per one cycle of the operation command signal E 216, as mentioned above. Practically, the change amount ΔE is set to be a smaller value in the case of requiring a moderate swing acceleration and a larger value in the case of requiring a higher swing acceleration.

Then, only the flow control valve 203 or both of the flow control valves 203, 204 are operated to start sole operation of swing or combined operation of swing and boom-up. At this time, the discharge pressure P s of the main pump 200 is increased while holding the differential pressure ΔP LS under load-sensing control by discharge control device 400.

At the same time, the controller 407 calculates values of operation command signals E 216, E 217 for the solenoid proportional pressure reducing valve 216, 217. In this case, since the swing flow control valve 203 is driven and the operation detected signal E 402 or E 403 is applied, the decision of step S12 shown in FIG. 42 is responded by YES, and the drive signal E H is derived through the operation process of steps S14–S16. In other words, there is obtained the drive signal E H which can limit the change speed below ΔE with the basic drive signal E HL set as a target value. Then, that drive signal E H is output, as the operation command signal E 216, to the solenoid proportional pressure reducing valve 216 so that the distribution compensating valve 205 starts opening gradually from its fully closed position at a speed corresponding to the change amount ΔE. Correspondingly, the hydraulic fluid is supplied to the swing motor 201 at a flow increasing speed corresponding to the change amount ΔE. Thus, the swing motor 201 is driven at an acceleration corresponding to the change amount ΔE.

Figure 44:
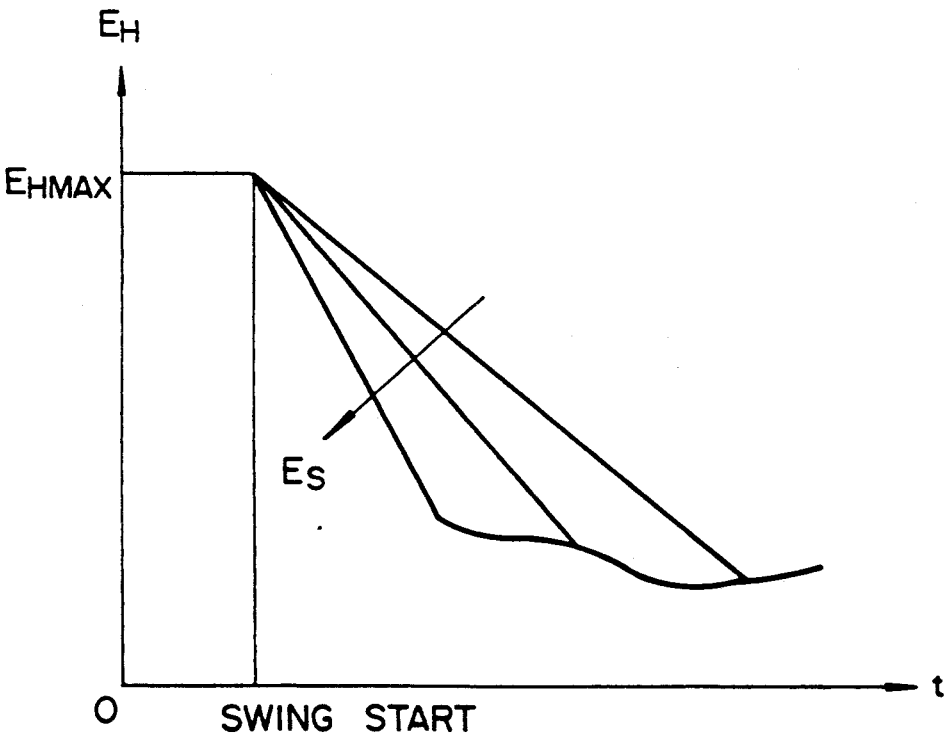
FIG. 44 is a graph showing the relationship between a swing operation start time t, a drive signal E H and a flow increasing rate signal E s.

Here, the relationship between the elapse of time t of the swing operation, the drive signal E H, and the flow increasing speed signal E s is shown in FIG. 44. After starting of swing, the drive signal E H is reduced at a gradient corresponding to the change amount ΔE. That gradient is increased with an increase in the flow increasing speed signal E s, i.e., change amount ΔE. That gradient also corresponds to a flow increasing speed of the hydraulic fluid supplied to the swing motor 201, i.e., a drive acceleration of the swing motor 201.

Meanwhile, the boom distribution compensating valve 206 is operated in a like manner to the sole operation of boom. Specifically, step S11 calculates a value of the basic drive signal E HL corresponding to the differential pressure ΔP LS in the vicinity of the target differential pressure ΔP LS0 from the relationship shown in FIG. 43. The calculated basic drive signal E HL is output, as the operation command signal E 217, to the solenoid proportional pressure reducing valve 217. Thus, the control force Nc2 corresponding to the signal E 217 is applied to the distribution compensating valve 206 in the valve-opening direction against the force of the spring 213. During the sole operation of swing, the distribution compensating valve 206 is thereby held at its fully open position with the second control force f-Nc2. During the combined operation of swing and boom-up, since the boom cylinder 202 is an actuator on the lower load pressure side, the distribution compensating valve 206 is so restricted as to hold the differential pressure across the flow control valve 204.

During the above process where the swing operation is started and the swing speed is increased in the combined operation of swing and boom-up, the discharge rate of the main pump 200 reaches its maximum and the differential pressure ΔP LS is reduced, whereupon the value of the basic drive signal E HL calculated by step S11 in FIG. 42 is increased. Thus, the distribution compensating valves 205, 206 are controlled for limiting an absolute amount of the hydraulic fluid supplied to the actuators 201, 202, while distributing the total flow rate properly.

After start of the swing operation, when the swing speed reaches a value corresponding to an opening degree (demanded flow rate) of the flow control valve 203, the control force Nc1 applied from the drive part 205*c* of the distribution compensating valve 205 also reaches a value corresponding to the drive signal E HL calculated by step S11, and E H=E HL is always obtained in step S16. Accordingly, at this time, the second control forces f-Nc1, f-Nc2 in the valve-opening direction of the distribution compensating valves 205, 206 become equal to each other. Thus, during the combined operation of swing and boom-up, the actuators 201, 202 are supplied with the flow rates in proportion to respective opening degrees of the flow control valves 203, 204, permitting the combined operation of swing and boom-up at the speed ratio as demanded.

As described above, with this embodiment, since the flow increasing speed of the hydraulic fluid supplied to the swing motor 201 can optionally be set at start of the swing operation, it is possible to desirously change the flow rate ratio of the hydraulic fluid supplied to both the actuators at start of the combined operation of swing and boom-up, and to perform that combined operation at the speed ratio optimum for the intended work.

Furthermore, since the flow increasing speed of the hydraulic fluid supplied to the swing motor 201 can optionally be set at start of the swing operation, it is possible to suppress an abrupt rise of the swing load pressure, to reduce an amount of the hydraulic fluid restricted and discarded by the swing relief valve, and hence to reduce energy loss. In the case of setting a flow increasing speed to a relatively small value, the drive pressure of the swing motor can be restrained below the relief pressure, resulting in further reduction of energy loss. Also, since the discharge pressure of the main pump 200 can be lowered, the discharge rate can be increased upon a decrease in the discharge pressure, when the main pump 200 is subjected to the input limiting control (input torque limiting control), to thereby increase the flow rate of the hydraulic fluid supplied to the boom cylinder for raising a drive speed.

MODIFICATIONS OF SIXTH EMBODIMENT

A first modification of the sixth embodiment will be described below with reference to FIGS. 45 and 46. This embodiment shows a modification of the selector device.

Figure 45:
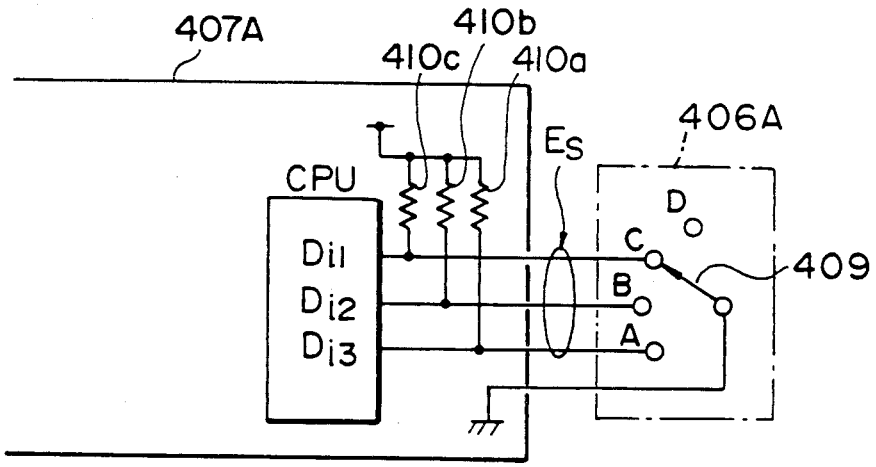
FIG. 45 is a view showing the configuration of a select command device according to a first modification of the sixth embodiment.

Referring to FIG. 45, a selector device 406A comprises a switch unit including movable taps 409 which can be contacted with four contacts A-D. The contacts A-C are connected to input terminals Di1, Di2 and Di3 of the CPU in a controller 407A, the input terminals Di1, Di2 and Di3 being connected to a power supply through resistors 410*a*, 410*b* and 410*c*, respectively. With such arrangement, when the movable tap 409 is in a position contacted with the contact C as shown, for example, the input terminal Di1 is grounded to reduce its voltage to 0, while the other input terminals Di2, Di3 remain supplied with the source voltage.

Figure 46:
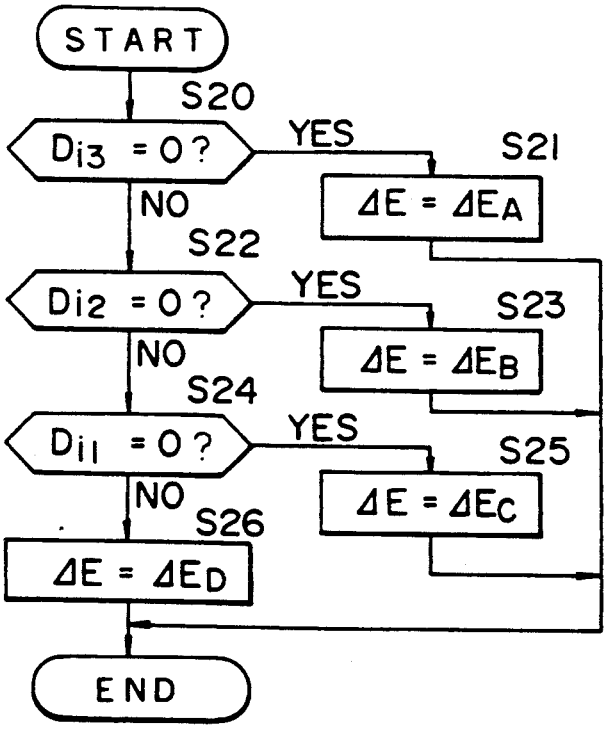
FIG. 46 is a flowchart showing the procedure for determining the amount of change ΔE dependent on operation of the select command device.

Dependent on the voltage levels at the input terminals Di1, Di2 and Di3, the controller 407A sets a flow increasing speed as shown in FIG. 46. First, step S20 determines whether or not the voltage at the input terminal Di3 is 0. If it is 0, the change amount ΔE per one cycle of the operation command signal E 216 for the solenoid proportional pressure reducing valve 216 is set in step S21 to a value ΔE A previously stored. If the voltage at the input terminal Di3 is not 0, the control goes to step S22 to determine whether or not the voltage at the input terminal Di2 is 0. If it is 0, the change amount ΔE is set in step S23 to a value ΔE B previously stored. If the voltage at the input terminal Di2 is not 0, the control goes to step S24 to determine whether or not the voltage at the input terminal Di1 is 0. If it is 0, the change amount ΔE is set in step S25 to a value ΔE C previously stored. Finally, if the voltage at the input terminal Di1 is not 0, the control goes to step S26 for setting the change amount ΔE to a value ΔE D previously stored.

In this manner, by switching a position of the movable tap 409, the change amount ΔE can be set dependent on a switched current position.

Figure 47:
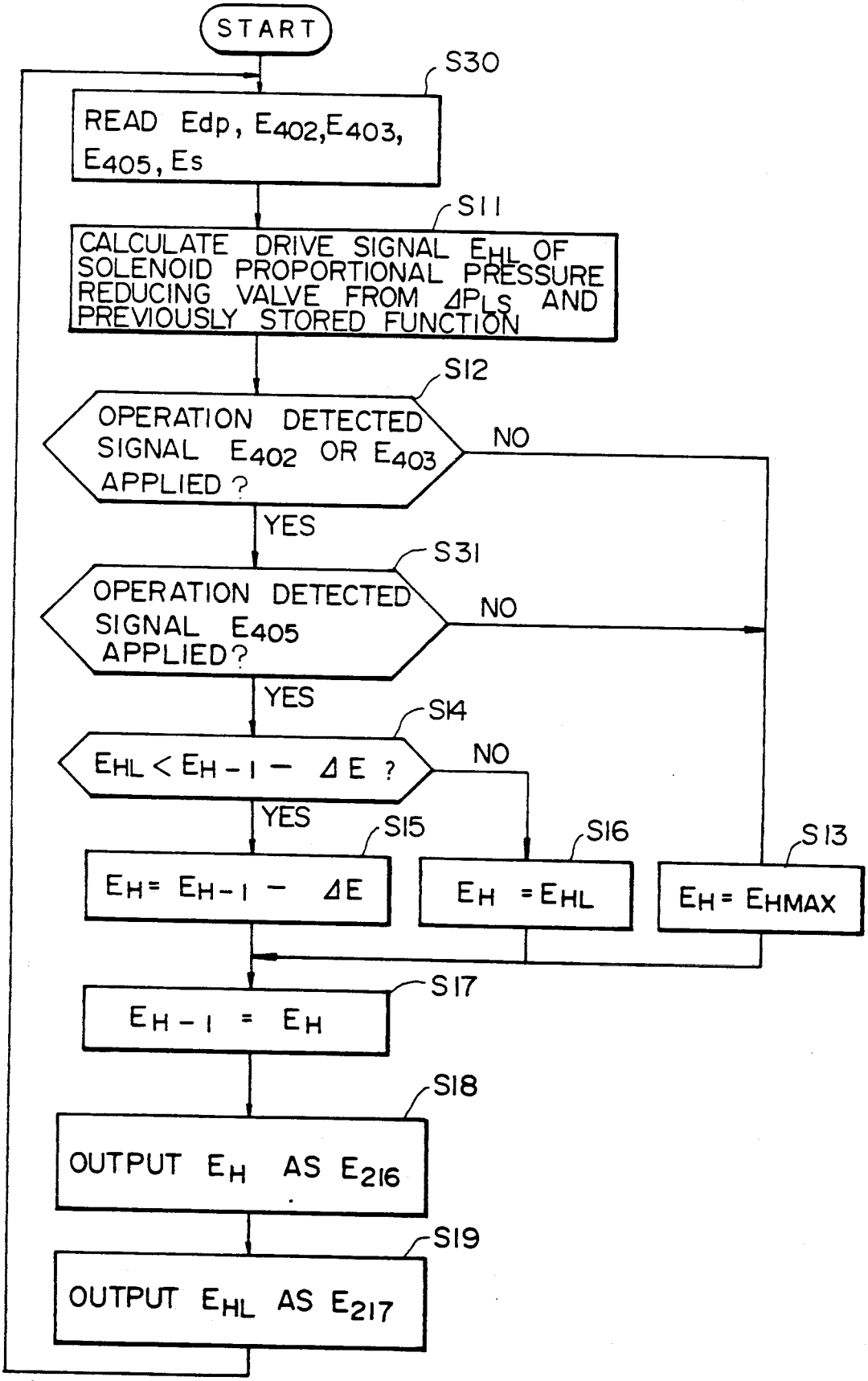
FIG. 47 is a flowchart showing the content of operation process performed by a controller in a second modification of the sixth embodiment.

Next, a second modification of the sixth embodiment will be described below with reference to FIGS. 39 and 47. In FIG. 47, the same steps as those in FIG. 42 are denoted by the same characters. This embodiment is intended to perform the flow increasing speed control for the swing motor 201 only during the combined operation of swing and boom-up.

A hydraulic drive system of this embodiment further includes, as indicated by imaginary lines in FIG. 39, an operation detector 405 for detecting delivery of the pilot pressure into a pilot line 404*a* associated with boom-up out of pilot lines 404*a* and 404*b*, which leads the pilot pressures to the drive parts of the flow control valve 204 from boom pilot valves (not shown), and then outputting a signal E 405. The signal E 405 is sent to the controller 407.

In step S30 shown in FIG. 47, the controller 407 reads the operation detected signal E 405 from the operation detector 405 in addition to the signals E dp, E 402, E 403 and E s. Then, subsequent to the decision of step S12, step S13 determines whether or not the operation detected signal E 405 is applied. The decision of step S13 is also responded by YES, the control can goes to steps S14–S16 through which the drive signal E H for limiting its change amount below ΔE is derived with the basic drive signal E HL set as a target value.

With this embodiment, there is achieved an advantageous effect that can control a flow increasing speed of the hydraulic fluid supplied to the swing motor and make acceleration control of swing only during the combined operation of swing and boom-up.

INDUSTRIAL APPLICABILITY

With the hydraulic drive system for construction machines of the present invention arranged as mentioned above, individual pressure compensating characteristics are given to first and second distribution compensating valves, making it possible to provide the optimum distribution ratio dependent on types of the actuators and improve operability and/or working efficiency, during combined operation of the first and second actuators simltaneously driven.

What is claimed is:

1. A hydraulic drive system for a construction machine comprising a hydraulic pump, at least first and second hydraulic actuators driven by a hydraulic fluid supplied from said hydraulic pump, first and second flow control valves for controlling flows of the hydraulic fluid supplied to said first and second actuators, respectively, first and second distribution compensating valves for controlling first differential pressures produced between inlets and outlets of said first and second flow control valves, respectively, and discharge control means responsive to a second differential pressure between a discharge pressure of said hydraulic pump and a maximum load pressure out of said first and second actuators for controlling a flow rate of the hydraulic fluid discharged from said hydraulic pump, said first and second distribution compensating valves having respective drive means for applying control forces in accordance with said second differential pressure to the associated distribution compensating valves, to thereby set target values of said first differential pressures, comprising:

first means for detecting said second differential pressure from the discharge pressure of said hydraulic pump and the maximum load pressure out of said first and second actuators;

second means for calculating individual values, as values of said control forces applied from the respective drive means of said first and second distribution compensating valves, in accordance with at least the second differential pressure detected by said first means; and first and second control pressure generator means provided in association with said first and second distribution compensating valves, respectively, said first and second control pressure generator means producing control pressures dependent on the individual values obtained by said second means and outputting said control pressures to the respective drive means of said first and second distribution compensating valves.

2. A hydraulic drive system for a construction machine according to claim 1, wherein said second means has first arithmetic means for deriving values of first and second control forces corresponding to said second differential pressure, based on both said second differential pressure detected by said first means and first and second functions preset associated with said first and second distribution compensating valves.

3. A hydraulic drive system for a construction machine according to claim 2 in which said first actuator is an actuator for driving an inertial load and said second actuator is an actuator for driving a normal load, wherein said first and second functions are set to have such relationships between said second differential pressure and the values of said first and second control forces that as said second differential pressure is reduced, the target values of said first differential pressures are reduced with rates of reduction different from each other.

4. A hydraulic drive system for a construction machine according to claim 2 in which said first actuator is an actuator for driving an inertial load and said second actuator is an actuator for driving a normal load, wherein at least said first function associated with said first actuator is set to have such relationship between said second differential pressure and the value of said first control force that when said second differential pressure exceeds above a predetermined value, the target value of said first differential pressure is suppressed from its further increase.

5. A hydraulic drive system for a construction machine according to claim 2 in which said first and second actuators are travel actuators, wherein said first and second functions are both set to have such relationships between said second differential pressure and the values of said first and second control forces that the target values of said first differential pressures become larger than said second differential pressure.

6. A hydraulic drive system for a construction machine according to claim 2 in which said first actuator is one of travel actuators and said second actuator is an actuator for digging work, wherein said second control means also has second arithmetic means which provide a relatively large time delay for change of the value of said first control force derived from said first function and a relatively small time delay for change of the value of said second control force derived from said second function.

7. A hydraulic drive system for a construction machine according to claim 2 in which said first actuator is a hydraulic motor and a second actuator is a hydraulic cylinder, wherein said hydraulic drive system further comprises third means for detecting a temperature of the hydraulic fluid discharged from said hydraulic pump, and wherein said second means also has third arithmetic means for deriving a temperature-dependent modification factor based on both the temperature of the hydraulic fluid detected by said third means and a third function preset, and fourth arithmetic means for calculating the value of said second control force derived from said second function and said temperature-dependent modification factor to thereby modify the value of said second control force.

8. A hydraulic drive system for a construction machine according to claim 1, wherein said hydraulic drive system further comprises fourth means for outputting select command signals dependent on types or contents of the works to be performed by driving said first and second actuators, and wherein said second means has fifth arithmetic means for deriving values of third and fourth control forces based on said second differential pressure detected by said first means, fourth and fifth functions preset respectively associated with said first and second distribution compensating valves, and the select command signals output from said fourth means.

9. A hydraulic drive system for a construction machine according to claim 8, wherein said fifth arithmetic means includes, as each of said fourth and fifth functions, a plurality of functions having respective characteristics different from each other, select ones of said plurality of functions dependent on the respective select command signals output from said fourth means, and derive the values of said third and fourth control forces corresponding to said second differential pressure, based on both said second differential pressure detected by said first means and the selected functions.

10. A hydraulic drive system for a construction machine according to claim 1 in which said first actuator is an actuator for driving an inertial load and said second actuator is an actuator for driving a normal load, wherein said hydraulic drive system further comprises fifth means for detecting the discharge pressure of said hydraulic pump, and wherein said second means has sixth arithmetic means for deriving a value of a fifth control force corresponding to said second differential pressure, based on both said second differential pressure detected by said first means and a sixth function preset, and setting the value as a value of said control force applied from said drive means of said first distribution compensating valve, and seventh arithmetic means for deriving a value of a sixth control force required to hold said discharge pressure at a predetermined value, based on both said discharge pressure detected by said fifth means and a seventh function preset, and setting either one of the values of said fifth and sixth control forces which makes larger the target value of said first differential value, as a value of said control force applied from said drive means of said second distribution compensating valve.

11. A hydraulic drive system for a construction machine according to claim 10, wherein said hydraulic drive system further comprises sixth means operable from the outside for outputting a select command signal for a predetermined value of said discharge pressure, and wherein said seventh arithmetic means can modify a characteristic of said seventh function responsive to said select command signal to change the predetermined value of said discharge pressure.

12. A hydraulic drive system for a construction machine according to claim 1 in which said first actuator is an actuator for driving an inertial load and said second actuator is an actuator for driving a normal load, wherein said hydraulic drive system further comprises seventh means for detecting operation of said first actuator and eighth means for setting a flow increasing speed of the hydraulic fluid supplied through said first distribution compensating valve, and wherein said second means has eighth arithmetic means for deriving a value of a seventh control force corresponding to said second differential pressure, based on both said second differential pressure detected by said first means and an eighth function preset, and setting the value as a value of said control force applied from said drive means of said second distribution compensating valve, and ninth arithmetic means for deriving a value of an eighth control force, which is changed at a speed below the change rate corresponding to said flow increasing speed, with the value of said seventh control force set as a target value, and setting the value of said eighth control force as the value of said control force applied from said drive means of said second distribution compensating valve.

13. A hydraulic drive system for a construction machine according to claim 12, wherein said hydraulic drive system further comprises ninth means for detecting operation of said second actuator, and wherein said ninth arithmetic means derives the value of said eighth control force when said seventh and ninth means detect start of operation of said first and second actuators.

14. A hydraulic drive system for a construction machine according to claim 1, wherein said hydraulic drive system further comprises tenth means for detecting the discharge pressure of said hydraulic pump, and wherein said second means has tenth arithmetic means for calculating, based on said second differential pressure derived by said first means, such a differential pressure target discharge rate of said hydraulic pump as to hold said second differential pressure constant, eleventh arithmetic means for calculating an input limiting target discharge rate of said hydraulic pump based on both the discharge pressure detected by said tenth means and a preset input limiting function of said hydraulic pump, twelfth arithmetic means for deriving a deviation between said differential pressure target discharge rate and said input limiting target discharge rate, and thirteenth arithmetic means for calculating individual values, as the values of said control forces applied from the respective drive means of said first and second distribution compensating valves in accordance with said deviation between said two target discharge rates, when said input limiting target discharge rate is selected, as a discharge rate target value of said hydraulic pump, out of said differential pressure target discharge rate and said input limiting target discharge rate.

15. A hydraulic drive system for a construction machine according to claim 1, wherein said hydraulic drive system further comprises drive means, separate from said first-mentioned drive means, provided on said first and second distribution compensating valves for urging the respective distribution compensating valves in the valve-opening direction, and pilot pressure supply means for leading a substantially constant common pilot pressure to said separate drive means, said first mentioned-drive means being disposed on the side to act on said first and second distribution compensating valves in the valve-closing direction.

* * * * *